US008133645B2

(12) United States Patent
Inagaki et al.

(10) Patent No.: US 8,133,645 B2
(45) Date of Patent: Mar. 13, 2012

(54) METHOD OF MANUFACTURING ELECTROPHOTOGRAPHIC PHOTORECEPTOR, ELECTROPHOTOGRAPHIC PHOTORECEPTOR, IMAGE-FORMING APPARATUS, AND PROCESS CARTRIDGE

(75) Inventors: Tomotake Inagaki, Kanagawa (JP); Kazuyuki Tada, Kanagawa (JP); Tomomasa Sato, Kanagawa (JP); Masaru Agatsuma, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1051 days.

(21) Appl. No.: 12/038,347

(22) Filed: Feb. 27, 2008

(65) Prior Publication Data

US 2008/0299473 A1 Dec. 4, 2008

(30) Foreign Application Priority Data

Jun. 4, 2007 (JP) ..... 2007-148158

(51) Int. Cl.
*G03G 5/00* (2006.01)

(52) U.S. Cl. ..... 430/66; 399/159

(58) Field of Classification Search ..... 430/66; 399/159

See application file for complete search history.

(56) References Cited

U.S. PATENT DOCUMENTS

| | | | | |
|---|---|---|---|---|
| 2003/0104295 | A1 | 6/2003 | Niimi | |
| 2007/0003850 | A1 | 1/2007 | Yamada et al. | |
| 2007/0122724 | A1 * | 5/2007 | Suzuki et al. | 430/58.7 |

FOREIGN PATENT DOCUMENTS

| | | |
|---|---|---|
| JP | A 08-123051 | 5/1996 |
| JP | A 2000-112159 | 4/2000 |
| JP | A-2006-227400 | 8/2006 |

* cited by examiner

*Primary Examiner* — Mark A Chapman
(74) *Attorney, Agent, or Firm* — Oliff & Berridge, PLC

(57) ABSTRACT

An aspect of the present invention provides a method of manufacturing an electrophotographic photoreceptor. The method includes forming at least one layer selected from the group consisting of an undercoat layer, a photosensitive layer, and a protective layer, by jetting by an inkjet method a first coating liquid and a second coating liquid from liquid drop discharging heads which are different from each other, and mixing the first coating liquid and the second coating liquid on a conductive substrate. The first coating liquid and the second coating liquid react with each other when they are mixed.

6 Claims, 18 Drawing Sheets

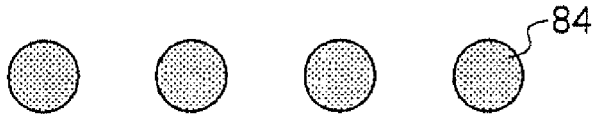
FIG. 2A
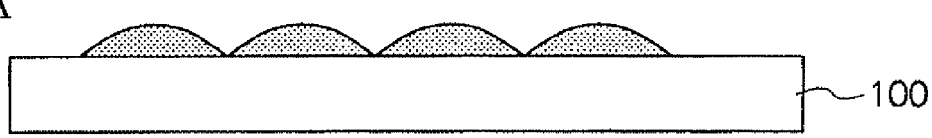
FIG. 2B
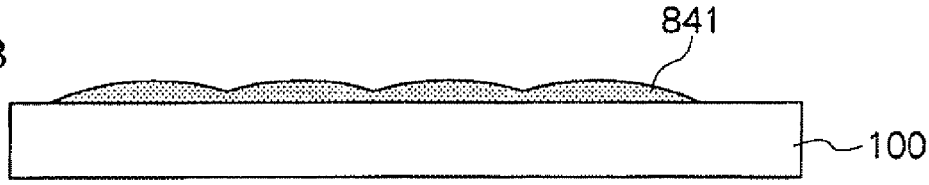
FIG. 2C
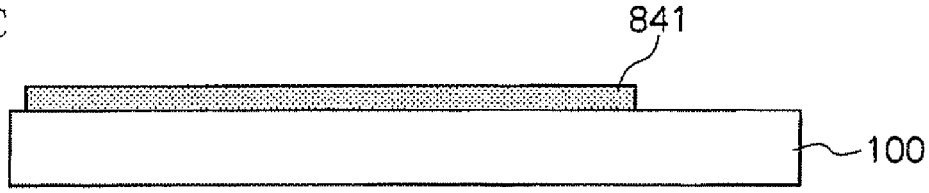

METHOD OF MANUFACTURING ELECTROPHOTOGRAPHIC PHOTORECEPTOR, ELECTROPHOTOGRAPHIC PHOTORECEPTOR, IMAGE-FORMING APPARATUS, AND PROCESS CARTRIDGE

CROSS-REFERENCE TO RELATED APPLICATION

This application is based on and claims priority under 35 USC 119 from Japanese Patent Application No. 2007-148158 filed Jun. 4, 2007.

BACKGROUND

1. Technical Field

The present invention relates to an electrophotographic photoreceptor that is used to form an electrophotographic image, a method of manufacturing the electrophotographic photoreceptor, an image-forming apparatus, and a process cartridge.

2. Related Art

In a xerographic image-forming apparatus, images are formed by an electrophotographic process using an electrophotographic photoreceptor (hereinafter this may be simply referred to as "photoreceptor"), a charging device, an exposing device, a developing device, and a transfer device.

With the recent technical development of the constitutive members and systems thereof, significant improvements in the speed and operable life span of a xerographic image-forming apparatus have been sought. With this, the requirements for high-speed operability and high reliability of the respective sub-systems of the apparatus have been increasing. In particular, improvements in the speed and reliability of the photoreceptor used for image writing thereon and the cleaning member for cleaning the photoreceptor are desired. Furthermore, the photoreceptor and the cleaning member receive more stress than any other members owing to their mutual sliding against each other. Therefore, the photoreceptor is often scratched or abraded, causing image defects.

In order to prevent problems such as this scratching or abrasion, a resin having a crosslinked structure may be provided on a surface of a photoreceptor to form a layer having high mechanical strength, thereby ensuring a long life span. As to the resin layer having the crosslinked structure, since molecules in a coating liquid each have a crosslinking reaction group before coating is performed, activation energy such as heat or light can be applied if necessary, after the coating liquid is coated on the photoreceptor, to perform a crosslinking reaction, thus forming a crosslinking structure.

However, the crosslinking reaction frequently occurs gradually in the coating liquid before the coating liquid that is used to perform the crosslinking reaction can be coated on an object to be coated. Thus, there is a problem in that physical properties of the coating liquid or the layer after the crosslinking reaction are changed. In particular, since this significantly affects the mechanical strength, the mechanical strength is reduced together with the change in the coating liquid over time.

Therefore, there have been many studies on ensuring the stability of the reactive coating liquid.

The invention has been made in view of the above circumstances.

SUMMARY

According an aspect of the invention, there is provided a method of manufacturing an electrophotographic photoreceptor, the method comprising forming at least one layer selected from the group consisting of an undercoat layer, a photosensitive layer and a protective layer, by:

jetting by an inkjet method a first coating liquid and a second coating liquid from liquid drop discharging heads which are different from each other, and mixing, the first coating liquid and the second coating liquid on a conductive substrate, the first coating liquid and the second coating liquid reacting with each other when mixed.

BRIEF DESCRIPTION OF THE DRAWINGS

Exemplary embodiments of the present invention will be described in detail based on the following figures, wherein:

FIGS. 2A to 2C are views illustrating liquid drops of the coating liquid when the liquid drops are deposited in an inkjet method;

DETAILED DESCRIPTION

Figure 1:
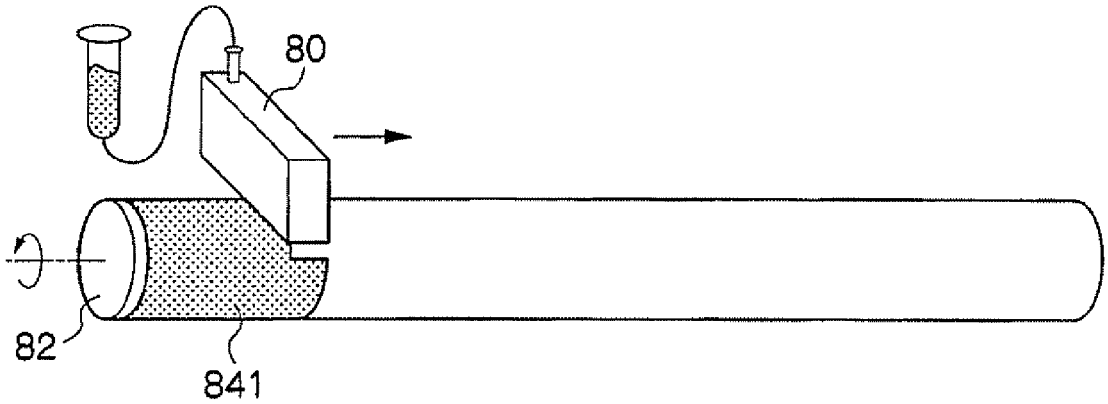
FIG. 1 is a view illustrating an inkjet method using a liquid drop discharging head 80 of a known inkjet printer.

Hereinafter, exemplary embodiments of the present invention will be described in detail with reference to the accompanying drawings. Furthermore, in the drawings, the same reference numerals are used for the same or corresponding parts, respectively and overlapping explanation for the reference numerals is omitted.

<Method of Producing an Electrophotographic Photoreceptor According to an Exemplary Embodiment of the Invention>

The method of manufacturing an electrophotographic photoreceptor according to an exemplary embodiment of the invention, is a method including forming at least one layer of an undercoat layer, a photosensitive layer, and a protective layer, by jetting by an inkjet method a first coating liquid and a second coating liquid from liquid drop discharging heads that are different from each other, and mixing the first coating liquid and the second coating liquid on a conductive substrate. The first coating liquid and the second coating liquid react with each other when mixed.

In particular, by jetting small liquid drops which are jetted by an inkjet method (1 fl or more and 100 pl or less and more preferably 1 fl or more and 50 pl or less), the mixing efficiency may be improved and a reduction in strength due to the curing nonuniformity and electric property nonuniformity may be prevented.

The first coating liquid and the second coating liquid according to an exemplary embodiment of the invention react with each other when mixed. In this connection, the term "reaction (or react)" means that molecules of compounds are bonded to each other, which is accompanied by chemical reaction, and examples of the reaction include a polymerization reaction and a crosslinking reaction. In the reaction, energy such as heating, UV radiation and electronic beam radiation may be required from the outside if necessary.

As to the combination of the first coating liquid and the second coating liquid, which causes the polymerization reaction or the crosslinking reaction, examples thereof include the combination in which the first coating liquid contains at least a curable resin and the second coating liquid contains at least a curing agent or a curing catalyst. Various combinations of the curable resin and the curing agent or the curing catalyst may be used, and examples thereof will be listed below. However, the invention is not limited thereto:

(1) A combination of a novolac resin and a basic catalyst (2) A combination of a resol phenol resin and an acid catalyst (3) A combination of a polyol that is a base compound of a urethane resin and polyisocyanate that is a curing agent (4) A combination of a polyamine that is a base compound of a polyurea resin and a polyisocyanate that is a curing agent (5) A combination of an epoxy resin and amineimidazole, an acid anhydride, an organic acid, or an inorganic acid that is a curing agent In particular, as to the combination in which the reaction occurs immediately after the mixing to cause gelation, stable coating may be performed using a coating method of the exemplary embodiment of the invention.

The method of jetting the first coating liquid and the second coating liquid that react with each other when mixed by using the liquid drop discharging heads that are separated from each other and mixing them on the substrate (hereinafter this may be simply referred to as "layer forming method of the invention") may be used to form any one layer of the undercoat layer, the photosensitive layer, and the protective layer, or to form two or more layers of them.

In views of electric properties of the photoreceptor, the film thickness nonuniformity, or suppression of the reaction nonuniformity, it is preferable to use the layer forming method of the invention to form the undercoat layer. A detailed description will be given of the first coating liquid and the second coating liquid when the layer forming method of the invention is used to form the undercoat layer below.

In views of electric properties of the photoreceptor, the film thickness nonuniformity, or suppression of the reaction nonuniformity, it is preferable to use the layer forming method of the invention to form the charge-generating layer that is a constituent layer of the photosensitive layer. A detailed description will be given of the first coating liquid and the second coating liquid when the layer forming method of the invention is used to form the charge-generating layer below.

In views of contact resistance to cleaning members or electric properties when the electrophotographic apparatus is used, it is preferable to use the layer forming method of the invention to form the charge-transporting layer that is a constituent layer of the photosensitive layer. A detailed description will be given of the first coating liquid and the second coating liquid when the layer forming method of the invention is used to form the charge-transporting layer below.

It is preferable to use the layer forming method of the invention to form at least the protective layer. The layer forming method may be used to increase crosslinking density of the resin and the mechanical strength of the electrophotographic photoreceptor, thus prolonging a life span.

In views of stability and improvement of the mechanical strength of the protective layer, curability of the curable resin is generally increased by heating. In general, energy that is provided from the outside more affects the surface of the protective layer as compared to the inner side of the layer. Thus, the curability of the inner side is often different from that of the surface of the layer.

Therefore, in order to obtain a longer life span due to improved hardness of the inner side, when the second coating liquid contains the curing catalyst, the jetting is preferably performed so that the concentration of the second coatings liquid is increased in the inner side of the layer (photosensitive layer side) to cause a concentration gradient. Even though the above-mentioned layer is formed, since the concentration gradient is continuous, the electrophotographic properties are not affected. Thus, a high-quality image may be obtained.

Furthermore, since the curing catalyst functions to improve conduction of the charges, it is preferable that content ratio of the curing catalyst is increased in a film thickness direction of the protective layer in a direction toward the photosensitive layer in order to prevent the ghost from being formed. The layer forming method of the invention may suppress the occurrence of the film thickness nonuniformity or the curing nonuniformity even with a high concentration of the curing catalyst, and thus is useful to manufacture a photoreceptor having a concentration gradient of the curing agent or the curing catalyst in a film thickness direction of the protective layer.

When the protective layer is formed using the layer forming method of the invention, from the viewpoints of suppressing deterioration due to charging when being used in a electrophotographic device, and suppressing image degradation in a high temperature and high humidity environment, it is more preferable that the first coating liquid contain at least a resol phenol resin and the second coating liquid contain the curing catalyst.

(Layer Forming Method of the Invention)

Hereinafter, the layer forming method of the invention will be described in detail.

In the layer forming method of the invention, the first coating liquid and the second coating liquid which react with each other when mixed are jetted by using the inkjet method from the liquid drop discharging heads that are separated from each other, and are mixed with each other on the substrate.

From the viewpoint of uniform mixing, fine liquid drops having a uniform size may be applied such that the deposited liquid drops contact each other, using the inkjet method. The size of liquid drop is preferably 1 fl or more and 100 pl or less and more preferably 1 fl or more and 50 pl or less.

The resolution (the number of pixels of the coating liquid in 1 inch: dpi) of the jetted liquid drop may be controlled so that the liquid drops form a uniform layer. The coating may be performed in consideration of surface tension of the substrate side, the way the liquid drop are enlarged when deposited, the size of liquid drop, concentration of a coating solvent, and a vaporization speed of a solvent.

The above-mentioned conditions depend on the type of material and a material composition of the coating liquid, and physical properties of a surface of an object to be coated. It is preferable to appropriately control the conditions. The inkjet method is suitable as a method for uniformly coating the fine liquid drops onto a predetermined position. In the inkjet method, a waste of the coating liquid does not occur and the first coating liquid and the second coating liquid may be uniformly mixed with each other.

Examples of the conductive substrate used in the invention are not limited to a flat plate, but may include a cylindrical substrate. As to the cylindrical substrate (cylindrical support), the cylindrical substrate rotates while the inkjet head moves parallel to a surface of the cylindrical substrate to apply the liquid drops such that the deposited liquid drops contact each other as described above, thus obtaining a continuous concentration gradient of the curable resin.

The resolution of the liquid drops may be appropriately controlled in consideration of parameters such as the number of rotation of the cylindrical substrate, the number of jetting of liquid drops per unit time, a moving speed, a speed of the head moving parallel to the surface of the cylindrical substrate, surface tension of the substrate side, the way the liquid drop are enlarged when deposited, a dilution ratio in respects to a solvent, and a vaporization speed of the solvent, so as to form a layer having a flat surface.

The first coating liquid and the second coating liquid are charged in the inkjet heads which are different from each other, jetted, and mixed with each other when they are attached to the substrate. The first coating liquid and the second coating liquid may be jetted simultaneously or at time intervals, and it is preferable to mix the solutions before the solvent is volatilized. Furthermore, the first coating liquid and the second coating liquid are not necessarily mixed with each other in the same amount, and the second coating liquid may be jetted at intervals in order to ensure the uniform mixing.

Either the first coating liquid containing the curable resin or the second coating liquid containing the curing agent or the curing catalyst may be coated first.

To desirably mix the first coating liquid and the second coating liquid with each other on the substrate, it is preferable that a difference in viscosity be insignificant. Specifically, the difference in viscosity is preferably 100 mPa·s or less, more preferably 50 mPa·s or less, and even more preferably 30 mPa·s or less.

In this exemplary embodiment, the viscosity is measured at 25° C. by means of an E-type viscometer (trade name: RE550L, manufactured by TOKI SANGYO Co., Ltd., standard corn rotor, rotation speed of 60 rpm).

A head cleaning function may be provided to prevent solidification at the inkjet head or clogging of the inkjet head due to drying of the coating liquid. For example, it is preferable to provide the head cleaning function or to perform cleaning by using an organic solvent which is used in the coating liquid. Furthermore, a suction mechanism or a dissolution mechanism using an ultrasonic wave may be provided in preparation for the complete clogging.

In the inkjet method, examples of the jetting method include a continuous type and an intermittence type (a piezo type, a thermal type, a static electricity type and the like). It is preferable to use the continuous type or intermittence type using the piezo type, and it is more preferable to use the intermittence type using the piezo type.

FIGS. 1 to 9 are views illustrating a scanning type inkjet method. However, the method for forming the charge-generating layer according to the exemplary embodiment of the invention is not limited thereto. In the scanning type method, the liquid drops are discharged while the liquid drop discharging head 80 moves parallel to the axis of the cylindrical support 82 to perform the coating.

In FIGS. 1 to 9, the cylindrical substrate (cylindrical support) 82 is illustrated as the conductive substrate. However, the shape of conductive substrate is not limited to a cylinder as described above, but a flat substrate may be used.

FIG. 1 is a view illustrating an inkjet method using a liquid drop discharging head 80 of a common inkjet printer. The liquid drop discharging head 80 includes plural nozzles (not shown) in a longitudinal direction. In the drawing, a simple syringe is provided to supply liquid. When the axis of the cylindrical support 82 is horizontal, the coating is performed while the cylindrical support 82 rotates. The resolution of jetting, which affects the quality of coating layer, is determined depends on an angle of the scanning direction and the nozzle.

FIGS. 2A to 2C illustrate that liquid drops 84 that are jetted from the inkjet type liquid drop discharging head 80 are deposited on an object 100 to be coated, and then the deposited liquid drops form one liquid layer.

As shown in FIG. 2A, the liquid drops 84 are jetted from the inkjet type liquid drop discharging head 80. A concentration of solids in the liquid drops is increased during flying to the object 100 to be coated, and then the liquid drops arrive at the subject 100 to be coated. Thereafter, as shown in FIG. 2B, the liquid drops come together on the object 100 to be coated, to form a liquid layer as shown in FIG. 2C. The liquid layer is leveled and thus the liquid layer 841 is obtained. The liquid layer 841 is dried and solidified to form a dried coating layer.

As shown in FIGS. 2A to 2C, the resolution (the number of pixels of the coating liquid in 1 inch) of the jetted liquid drops may be controlled so that the liquid drops are deposited and are enlarged to come into contact with each other and form a layer. The coating may be performed in consideration of surface tension of the substrate side, the way the liquid drop are enlarged when deposited, the size of liquid drop when jetted, concentration of a coating solvent, and a vaporization speed of the solvent depending on the type of coating solvent.

The above-mentioned conditions may be decided depending on the type of material of the coating liquid, a material composition, and physical properties of a surface of the object 100 to be coated, and may be appropriately adjusted.

Figure 3A:
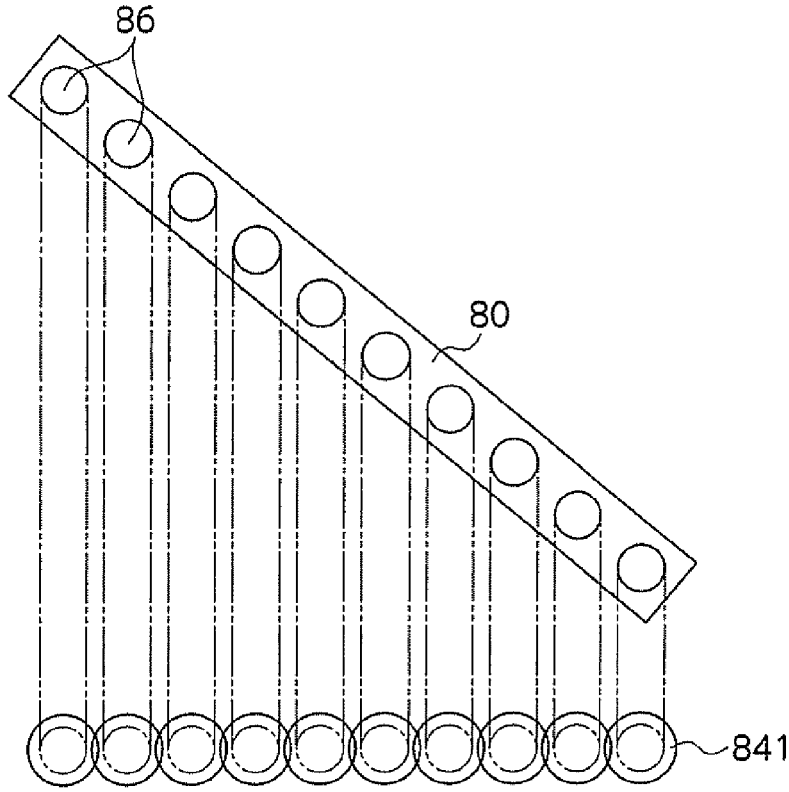
FIGS. 3A and 3B are views illustrating a method for improving resolution of an appearance in the inkjet method.

However, in the above-mentioned piezo type inkjet liquid drop discharging head 80, it is difficult to reduce a distance between nozzles, which obstructs an increase in resolution. Accordingly, in consideration of the distance between the nozzles, it is preferable to incline the liquid drop discharging head 80 shown in FIGS. 3A and 3B with respects to the axis of the photoreceptor so that the liquid drops which have been jetted from the nozzle 86 and deposited come into contact with each other, which is shown in FIG. 2A, and to increase the apparent resolution. As shown in FIG. 3A, the diameter of the liquid drop is similar to that of the nozzle 86 indicated by the dotted line when the liquid drops are jetted. After the liquid drops are deposited onto the surface of the photoreceptor A, the liquid drops are enlarged, which is indicated by the full line, and come into contact with each other to form a liquid layer 841.

Figure 4:
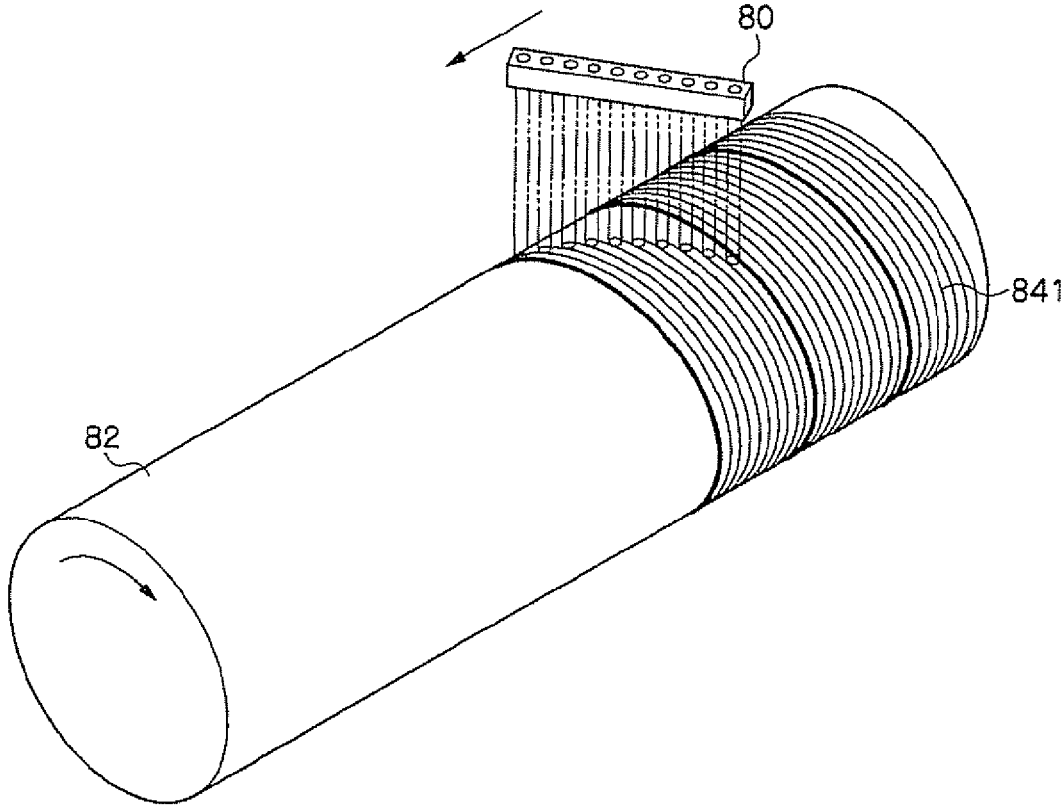
FIG. 4 is a view illustrating formation of layers in the inkjet method.

In this state, the cylindrical support 82 rotates and the coating liquid is jetted from the nozzles 86. As shown in FIG. 4, the liquid drop discharging head 80 horizontally moves from one end of the cylindrical support 82 to the other end thereof.

Specifically, the cylindrical support 82 is provided in a device that can horizontally rotates, and the liquid drop discharging head 80 containing a charge-generating layer coating liquid is provided so that the liquid drops are jetted onto the cylindrical support 82. Since an object on which the liquid drops are jetted is a cylinder having a small diameter, it is preferable to off nozzles 86 of the liquid drop discharging head 80 through which the coating liquid is not jetted, in views of reduction in the amount of waste liquid.

Furthermore, the cylindrical substrate (cylindrical support) 82 to be coated is illustrated in the drawing. If a flat substrate to be coated is used, the substrate and the liquid drop discharging head 80 may move relatively.

Figure 5:
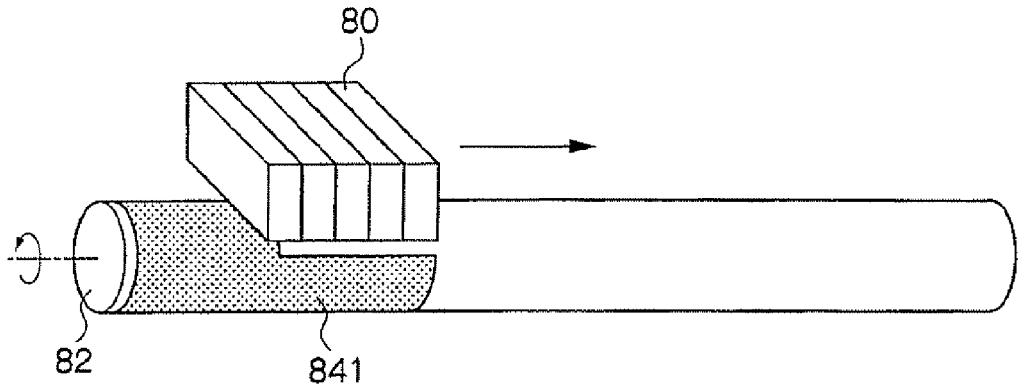
FIG. 5 illustrates an example of an inkjet method when plural liquid drop discharging heads 80 of FIG. 1 are arranged in a matrix form.

FIG. 5 illustrates an inkjet method in which plural liquid drop discharging heads 80 of FIG. 1 are arranged in a matrix form. The liquid drops may be discharged in a large amount at the same time, and thus the area onto which the liquid drops are ejected may become larger. Therefore, it is possible to perform high speed coating. Furthermore, the type of nozzles (not shown) for jetting may be selected or the nozzles having different sizes may be arranged in a matrix form, to easily control a jetting amount.

Figure 6:
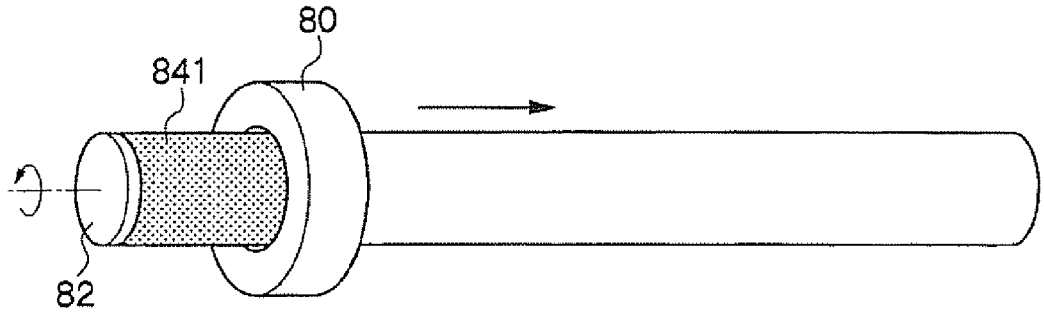
FIG. 6 illustrates an example of an inkjet method using a cylindrical liquid drop discharging head 80 that are made to circumferentially surround a cylindrical support 82.

FIG. 6 illustrates a cylindrical liquid drop discharging head 80 that are made to circumferentially surround a substrate to be coated. Nozzles for discharging (not shown) are disposed on the surface of the head at regular intervals in a circumferential direction. When the cylindrical liquid drop discharging head 80 is used, it is possible to reduce nonuniformity of the film thickness in the circumferential direction, and to form a layer in which spiral marks are rarely noticeable.

Figure 7:
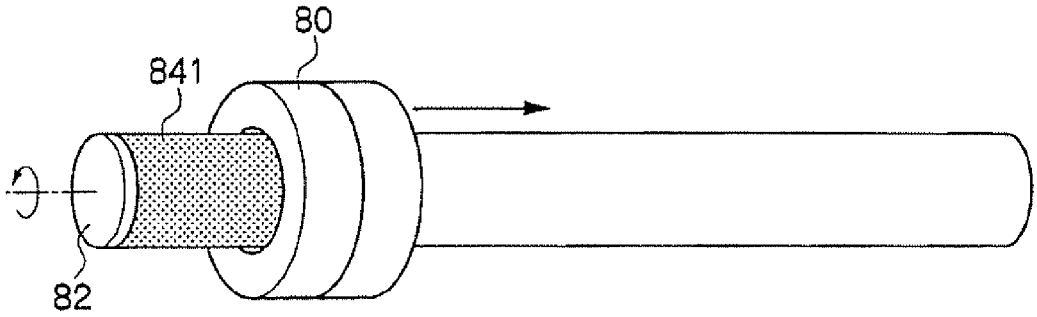
FIG. 7 illustrates an example of an inkjet method when plural cylindrical liquid drop discharging heads 80 of FIG. 6 are arranged in a matrix form.

FIG. 7 illustrates an inkjet method when plural cylindrical liquid drop discharging heads 80 of FIG. 6 are arranged in a matrix form. Advantages of this case are the same as those of the liquid drop discharging head 80 of FIG. 6.

Figure 8:
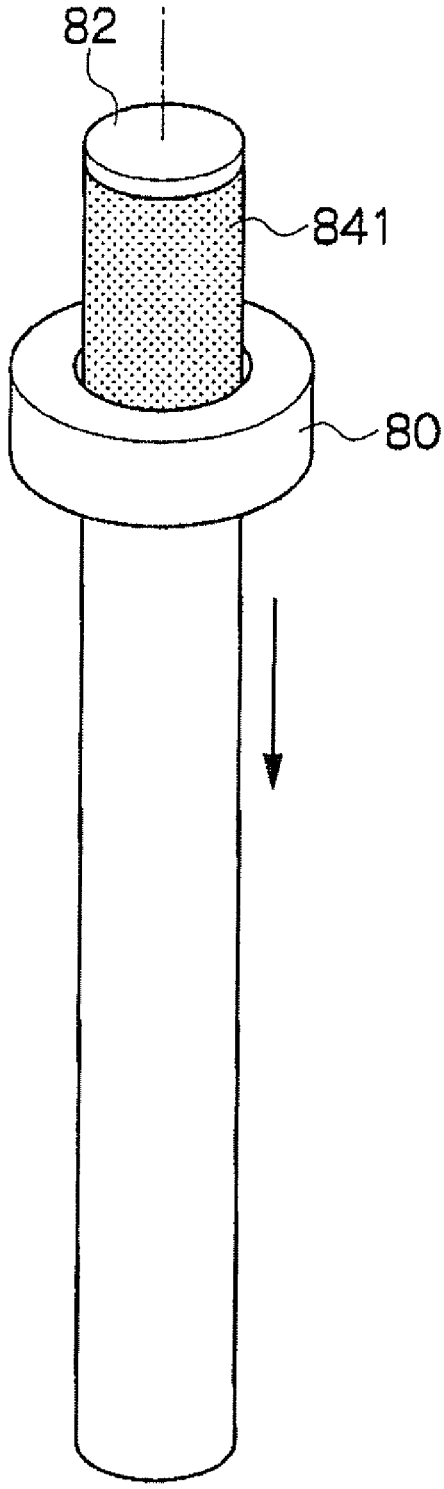
FIG. 8 illustrates an example of an inkjet method when the structure of FIG. 6 is vertically arranged.

FIG. 8 illustrates an inkjet method when the heads of FIG. 6 are vertically arranged. In connection with this, the term "vertical" may mean not only an angle of 90°, but also an angle that is close to 90°.

In FIGS. 6 to 8 the layer may be formed without rotating the substrate to be coated does. In this connection, the method of FIGS. 3A and 3B, which increases the apparent resolution by using a predetermined angle between the rotation axis and the row of nozzles 86, may not be used.

Figure 9:
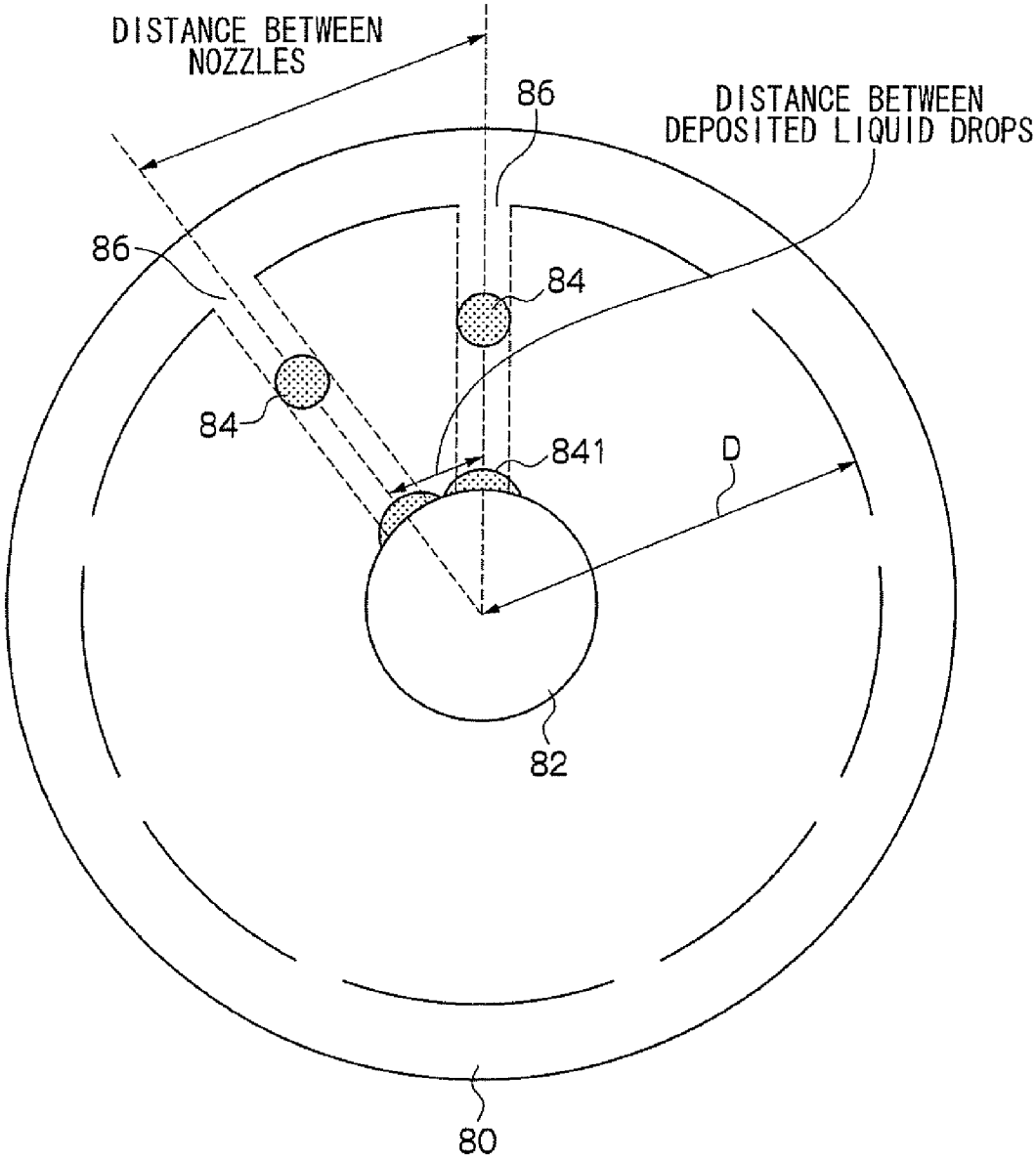
FIG. 9 is a view illustrating a method for improving resolution of the cylindrical liquid drop discharging heads 80.

However, in the cylindrical liquid drop discharging head 80 shown in FIG. 9, the diameter D of the liquid drop discharging head 80 may be increased to reduce a distance between the liquid drops deposited, thus improving the resolution on the substrate. Therefore, in the piezo type liquid drop discharging head 80, it is difficult to reduce the distance between the nozzles 86 due to manufacturing. However, when the cylindrical liquid drop discharging head 80 is used, a high-quality layer may be formed.

Hereinafter, an inkjet method other than the scanning type will be described.

Figure 10:
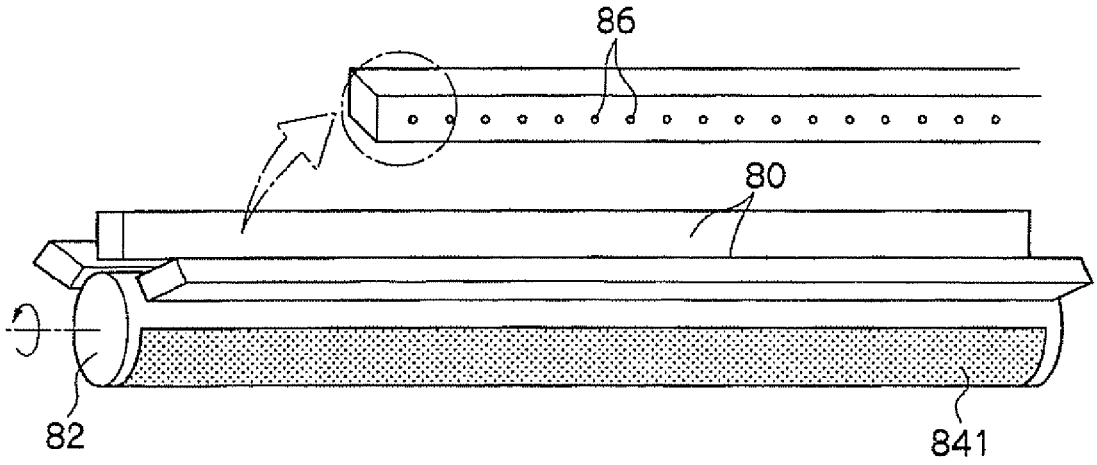
FIG. 10 illustrates an example of an inkjet method where coating is performed at a time in respects to an entire axis length of the cylindrical support 82 when each of the liquid drop discharging heads 80 has a width that is the same as or larger than that of the cylindrical support 82.

FIG. 10 illustrates an inkjet method where coating is performed at a time in respects to an entire axis length of the cylindrical support 82 when the liquid drop discharging heads 80 has a width that is the same as or larger than that of the cylindrical support 82. When the axis of the cylindrical support 82 is horizontally provided, the coating is generally performed while the cylindrical support 82 rotates. In the piezo type inkjet liquid drop discharging head 80, it is difficult to reduce the distance between the nozzles 86. Thus, it is difficult to ensure the resolution which is required to form a high-quality layer.

Therefore, as a solution, as shown in FIG. 10, two or more liquid drop discharging heads 80 may be provided. Even though the single liquid drop discharging head 80 is used, when the liquid drop discharging head scans very small distance in a axis direction so as to fill the interval between the nozzles 86, continuous layer may be formed.

In an exemplary embodiment of the invention, the so-called continuous discharging type inkjet method, which may exhibit stable discharging performance even if the coating liquid has high viscosity, may be used. In the continuous discharging, the coating liquid is continuously pressurized to be discharged in a form of liquid column through the nozzles 86, and the coating liquid discharged in a form of liquid column is converted into liquid drops to be applied on an object 100 to be coated.

A continuous discharging type coating device (hereinafter this may be simply referred to as "continuous type coating device") includes a pressurizing part that continuously pressurizes the coating liquid to supply the coating liquid into a coating liquid chamber and discharges the coating liquid in a form of liquid column from the nozzles 86, and a liquid drop forming part that converts the coating liquid discharged through the nozzles 86 as a form of liquid column into liquid drops.

Preferably, the liquid drop forming part may be a vibration providing part that provides vibration to the coating liquid supplied to the coating liquid chamber.

Furthermore, the vibration providing part may be disposed such that vibration is provided to the coating liquid from a direction perpendicular to a discharging direction of the coating liquid, and a vibration absorption part that absorbs the vibration provided by the vibration providing part may be disposed to face the vibration providing part.

The continuous discharging type coating device may further include a viscosity detection part that detects viscosity of the coating liquid.

The continuous discharging type coating device may further include a pressure controlling part that changes pressure to the coating liquid by using the pressurizing part according to the viscosity detected by the viscosity detection part. In addition, the continuous discharging type coating device may further include a liquid drop formation controlling part that changes a liquid drop formation conditions for forming liquid drops by the liquid drop forming part, according to the viscosity detected by the viscosity detection part.

The continuous discharging type coating device may further include a liquid drop interval detection part that detects the interval between the liquid drops formed from the coating liquid.

The continuous discharging type coating device may further include a pressure controlling part that changes pressure to the coating liquid by using the pressurizing part according to the interval between the liquid drops of the coating liquid which is detected by the liquid drop interval detection part. Furthermore, the continuous discharging type coating device may further include a liquid drop formation controlling part that changes a liquid drop formation condition of the coating liquid by using the liquid drop forming part according to the interval between the liquid drops of the coating liquid which is detected by the liquid drop interval detection part. Additionally, the continuous discharging type coating device may further include the viscosity controlling part that changes the viscosity of the coating liquid according to the interval between the liquid drops of the coating liquid which is detected by the liquid drop interval detection part.

The continuous discharging type coating device may further include plural heads for discharging functional material. In addition, the different coating liquids may be discharged from the different plural functional material discharging heads.

In the continuous discharging type coating device, the recording material discharging head may have a width that is the same as or larger than a coating width of an object 100 to be coated.

In the intermittence type, when a heating part for heating the coating liquid that is used in a commercial bar code printer is provided in the liquid drop discharging head 80, and the viscosity at the jetting part is reduced, material having high viscosity may be used. Although the range of the choices of the coating liquid is narrow, the electrostatic and intermittence type inkjet liquid drop discharging head 80 may be used for the coating liquid having high viscosity.

Hereinafter, the mixing of the first coating liquid and the second coating liquid on the conductive substrate by using the inkjet method will be described.

FIGS. 11A to 11E illustrate liquid drops of the first coating liquid 84A and liquid drops of the second coating liquid 84B after the liquid drops are deposited.

Figure 11A:
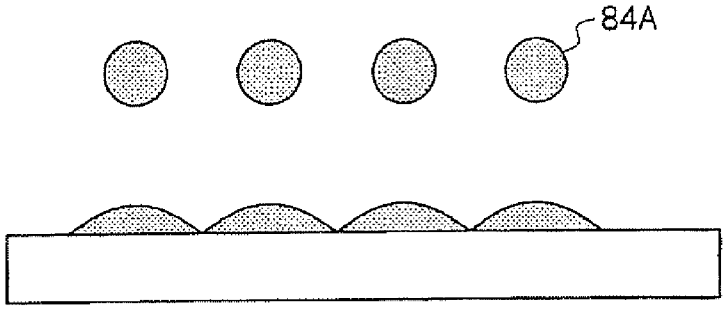
FIGS. 11A to 11E are views illustrating the liquid drops of a first coating liquid and a second coating liquid after the liquid drops are deposited.
Figure 11B:
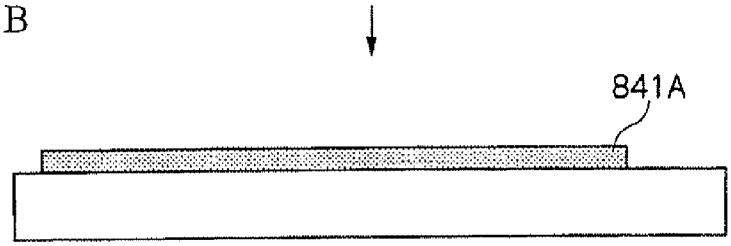

As shown in FIG. 11A, when the liquid drops of the coating liquid 84A are discharged from the liquid drop discharging head 80A, the liquid drops are applied on the object 100 to be coated, and as shown in FIG. 11B, liquid layer 841A of the coating liquid 84A is formed.

Figure 11C:
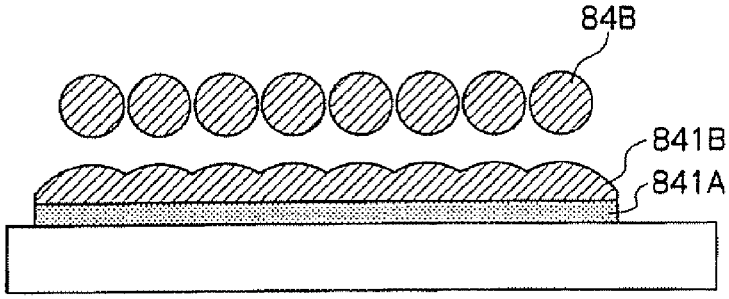

In FIG. 11C, as to the liquid layer 841A of the coating liquid applied on the object 100 to be coated, when the liquid drops of the coating liquid 84B are discharged from the liquid drop discharging head 80B, the liquid drops 84B are applied on the liquid layer 841A of the coating liquid 84A of the object 100 to be coated. If an excessive amount of solvent is volatilized from the liquid layer 841A, the coating liquid 84B which is to be provided later may not be mixed with the liquid layer. It is preferable to consider a time between supplying of the coating liquid 84B and supplying of the coating liquid 84A.

Figure 11D:
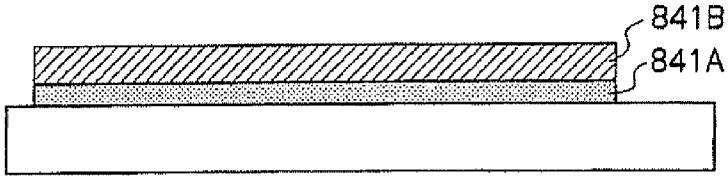
Figure 11E:
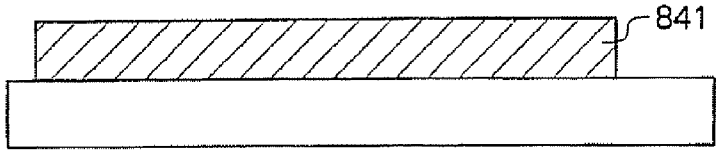

Next, as shown in FIG. 11D, the liquid layer 841A and the liquid layer 841B are leveled with each other, and as shown in FIG. 11E, the single liquid layer 841 is formed.

In FIGS. 11A to 11E, reference numeral 841A denotes a liquid layer of the coating liquid 84A and reference numeral 841B denotes a liquid layer of the coating liquid 84B.

FIGS. 12A to 12D illustrate the liquid drops of the first coating liquid 84A and the liquid drops of the second coating liquid 84B after the liquid drops are deposited, when the liquid drops are applied in a pattern form. The pattern is not limited to that of FIGS. 12A to 12D.

Figure 12A:
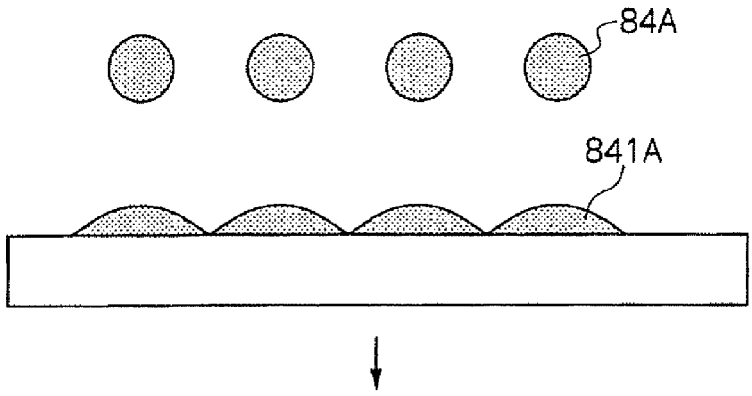
FIGS. 12A to 12D are views illustrating the liquid drops of the first coating liquid and the liquid drops of the second coating liquid applied to form a pattern, after the liquid drops are deposited.
Figure 12B:
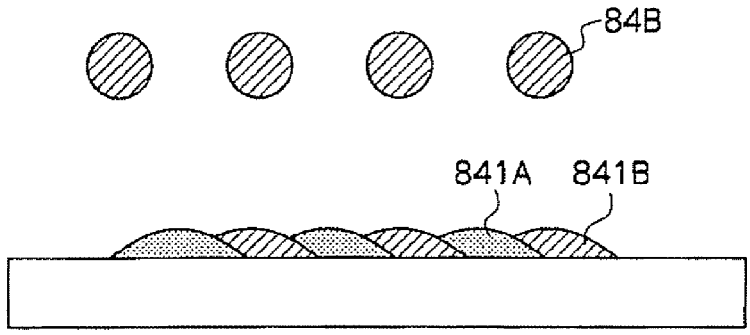
Figure 12C:
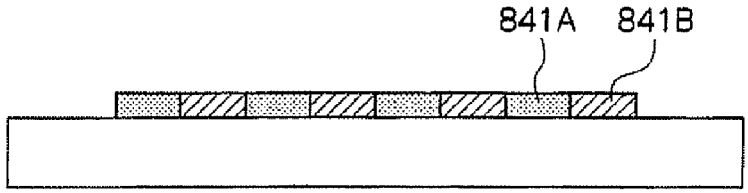

As shown in FIG. 12A, when the liquid drops of the coating liquid 84A are discharged from the liquid drop discharging head 80A, the liquid drops are deposited on the object 100 to be coated. Next, as shown in FIG. 12B, when the liquid drops of the coating liquid 84B are discharged from the discharging head 80B so as to be adjacent to the coating liquid 84A and to form a pattern, as shown in FIG. 12C, the patterns of the liquid layer 841A of the coating liquid 84A and the liquid layer 841B of the coating liquid 84B are formed.

Figure 12D:
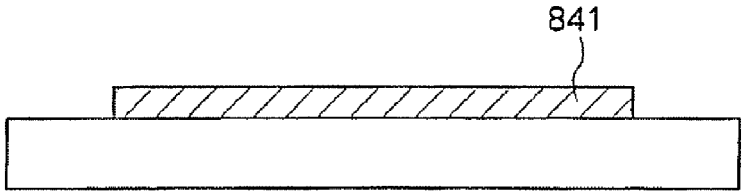

Next, as shown in FIG. 12D, the liquid layer 841A and the liquid layer 841B are leveled with each other to form a single liquid layer 841.

In the layer thus formed, the first coating liquid 84A and the second coating liquid 84B are mixed with each other to perform a reaction sufficiently.

(Method of Forming a Layer Having a Concentration Gradient)

In an exemplary embodiment of the invention, the method of forming the layer as described above may be used to change the concentration of a compound contained in the first coating liquid or the second coating liquid in a film thickness direction. In the protective layer, the concentration gradient may be formed so that the content of the curing agent or the curing catalyst is increased in a film thickness direction of the protective layer toward the photosensitive layer.

Figure 13A:
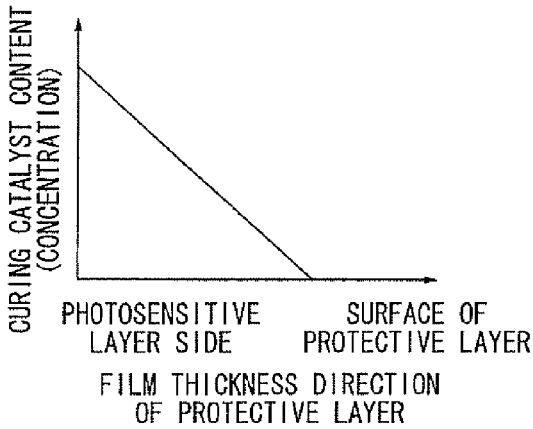
FIGS. 13A to 13F are graphs illustrating a concentration gradient of a curing catalyst in respects to a film thickness direction of a protective layer.
Figure 13B:
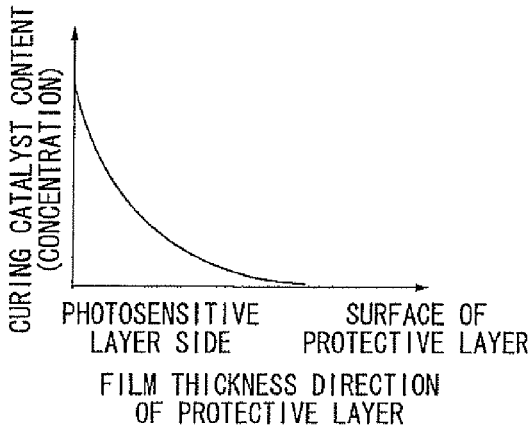
Figure 13C:
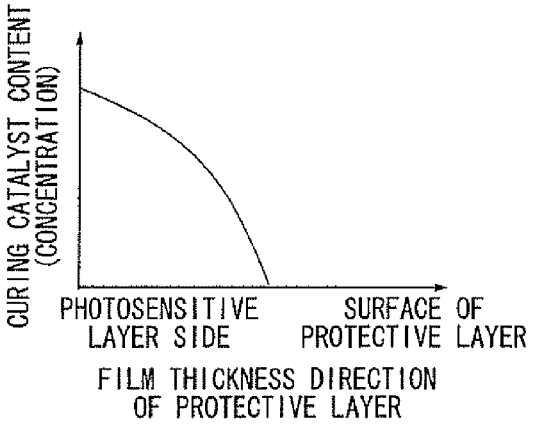
Figure 13D:
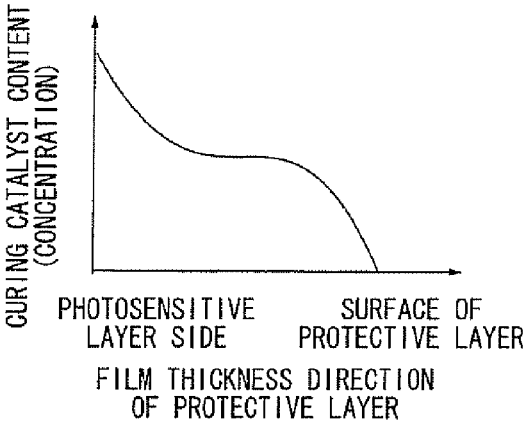

In an exemplary embodiment of the invention, the concentration gradient in a film thickness direction may be a concentration gradient in which the concentration is linearly increased in a film thickness direction as shown in FIG. 13A, or may be a concentration gradient in which the concentration is increased in a curve as shown in FIGS. 13B, 13C, and 13D.

Figure 13E:
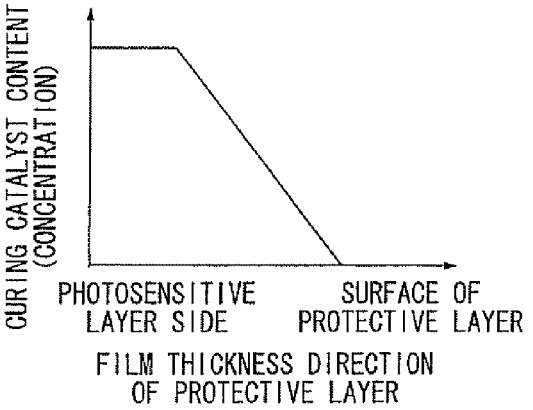
Figure 13F:
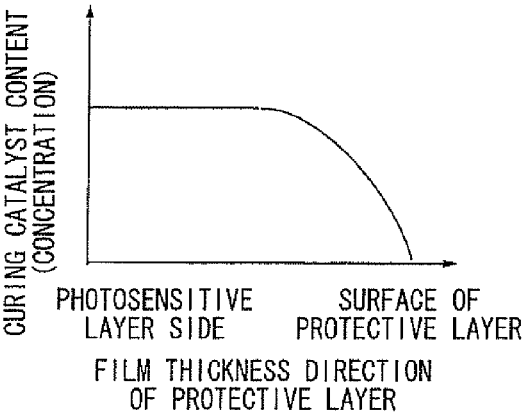

Additionally, as shown in FIG. 13E or 13F, the concentration gradient may partially occur in a film thickness direction.

In order to cause the concentration gradient in a film thickness direction, a ratio of the first coating liquid and the second coating liquid may be changed in a film thickness direction. The liquid drop amount per one drop may be changed or the number of liquid drops per unit area may be chanced to change the ratio.

The liquid drop amount per one drop may be changed by changing pressure of a piezoelectric device. Furthermore, if the coating is performed only on the same type of substrate to be coated during the production, the size of nozzle 86 may be changed. That is, the size of nozzle 86 may be increased in order to increase the ratio.

The number of liquid drops per unit area may be changed by changing a driving frequency of the piezoelectric device.

Furthermore, the number of liquid drops per unit area may be chanced to change a scanning speed of the liquid drop discharging head 80. The number of liquid drops per unit area may be reduced when the scanning speed of the liquid drop discharging head 80 is increased. Therefore, at least two liquid drop discharging heads 80 of which the scanning speeds are independently changed may be prepared to change the scanning speeds of the liquid drop discharging head 80A containing the first coating liquid and the liquid drop discharging head 80B containing the second coating liquid.

Furthermore, the ratio of the first coating liquid and the second coating liquid may be changed by using a combined method of the above-mentioned methods.

If the jetting ratio of the first coating liquid and the second coating liquid is changed whenever the coating is repeated by using the above-mentioned method, the concentration gradient may occur in a film thickness direction.

Figure 14:
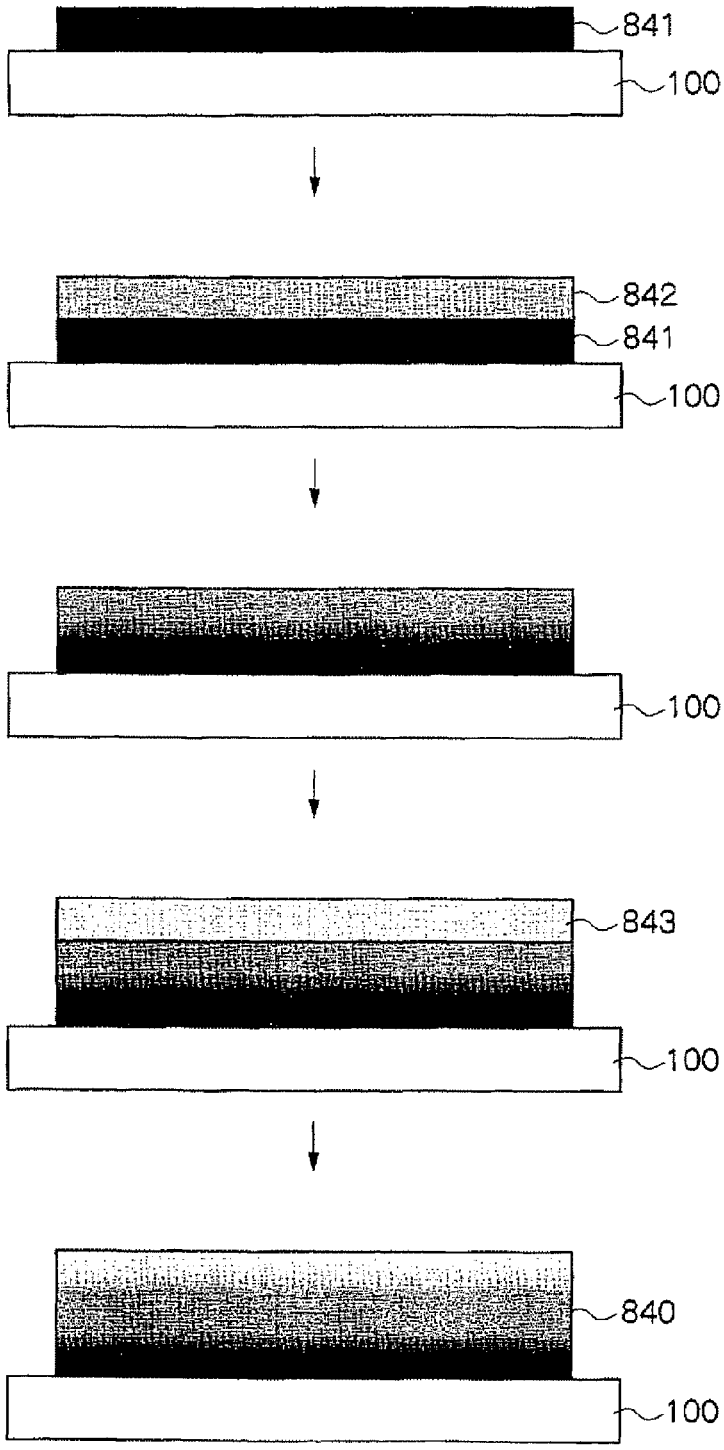
FIG. 14 is a view illustrating formation of a layer having a concentration gradient in a film thickness direction.

That is, as shown in FIG. 11E or 12D, the liquid layer 842 in which the ratio of the first coating liquid and the second coating liquid is changed is formed on the liquid layer 841 including the first coating liquid and the second coating liquid mixed with each other, and the liquid layer 843 in which the ratio of the first coating liquid and the second coating liquid is changed is formed thereon. The above-mentioned procedure is repeated to form a layer having a concentration gradient in a film thickness direction. This is shown in FIG. 14.

The concrete ratio is not limited. However, for example, the jetting ratio of the first coating liquid and the second coating liquid may be set to 5:5 in the first liquid layer 841, 5:4 in the second liquid layer 849, 5:3 in the third liquid layer 843, and 5:2 and 5:1 in subsequent layers to cause the concentration gradient in a film thickness direction in the signal layer.

FIGS. 11A to 11E, 12A to 12D, and 14 are image views illustrating the formation using the inkjet method, but the exemplary embodiment of the present invention is not limited to these image views.

<Electrophotographic Photoreceptor>

Next, the layers of the electrophotographic photoreceptor according to the exemplary embodiment of the invention will be described.

Figure 15:
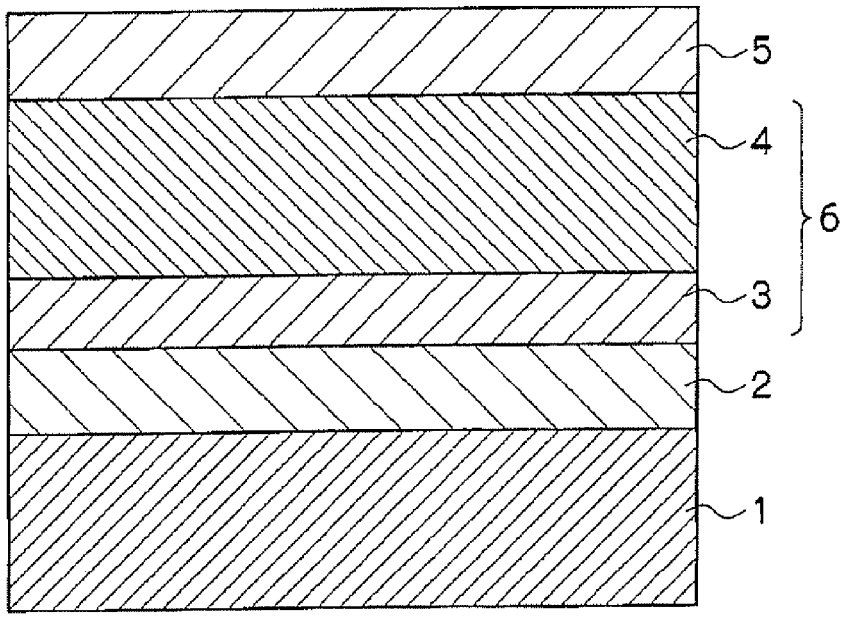
FIG. 15 is a view illustrating a section of an electrophotographic photoreceptor according to an exemplary embodiment of the invention.

FIG. 15 is a sectional view illustrating an electrophotographic photoreceptor according to an exemplary embodiment of the invention. The electrophotographic photoreceptor shown in FIG. 15 is a function separation type photoreceptor including a charge-generating layer 3 and a charge-transporting layer 4 that are separated from each other in a photosensitive layer 6. Specifically, the electrophotographic photoreceptor shown in FIG. 15 includes an undercoat layer 2, a charge-generating layer 3, a charge-transporting layer 4, and a protective layer 5 sequentially layered on a conductive substrate 1.

Next, elements of the electrophotographic photoreceptor 10 shown in FIG. 15 will be described.

(Conductive Substrate 1)

Examples of the conductive substrate 1 may include a metal plate, a metal drum, and a metal belt that are made of metal such as aluminum, copper, zinc, stainless steel, chrome, nickel, molybdenum, vanadium, indium, gold, and platinum or an alloy thereof, and a paper, a plastic film, and a belt on which a conductive polymer, a conductive compound such as indium oxide, metal such as aluminum, palladium, and gold, or an alloy thereof is coated, vapor-deposited, or laminated.

Furthermore, in the conductive substrate, the term "conductive" means a state in which volume resistivity is in the range of $10^{10}$ Ω·cm or less.

In order to prevent the formation of an interference fringe due to radiation of a laser bean it is preferable that the surface of the conductive substrate 1 be roughened and a center line average roughness Ra be 0.04 to 0.5 μm. If Ra is in the above-mentioned range, an interference prevention effect may be easily obtained and thus a high-quality image may be easily ensured.

Furthermore, when non-interference light is used as a light source, the surface roughening in order to prevent the interference fringe may be unnecessary and the occurrence of defects due to unevenness of the surface of the substrate may be prevented. Therefore, a long life span may be ensured.

Examples of surface roughening methods include a wet honing method in which an abrasive is suspended in water and the suspension is jetted onto a support, a centerless grinding method in which a support is presses on a rotating whetstone so that the support comes into contact with the whetstone and is continuously grinded, and an anodic oxidation method. Additionally, a roughening method in which a layer in which conductive or semi-conductive particles are dispersed in a resin layer is formed on a surface of a support, and a roughened surface is obtained by the particles dispersed in the layer, instead of directly roughening the surface of the support, may be used.

In anodizing, aluminum is used as an anode to be subjected to anodic oxidation in an electrolyte solution. Thus, an oxide layer is formed on a surface of aluminum. Examples of the electrolyte solution may include a sulfuric acid solution and an oxalic acid solution. However, a porous anodic oxide layer is chemically active and easily polluted, and has a high resistance fluctuation due to an environment. Thus, micropores of the anodic oxide layer are occluded by using a volume expansion due to a hydration reaction in stead under pressure or boiled water (salts of metal such as nickel may be added) to perform a sealing treatment so that stable hydrated oxides are obtained.

The thickness of the anodic oxide layer may be 0.3 to 15 μm. When the thickness of the anodic oxide layer is in the above-mentioned range, a barrier property is excellent and it is difficult to increase a residual electric potential.

A treatment using an acidic treatment liquid, which is made of a phosphoric acid, a chromic acid, and a hydrofluoric acid is as follows.

As to a mixing ratio of the phosphoric acid, the chromic acid, and the hydrofluoric acid in the acidic treatment liquid, the concentration of the phosphoric acid may be in the range of 10 to 11% by weight, the concentration of the chromic acid may be in the range of 3 to 5% by weight, the concentration of the hydrofluoric acid may be in the range of 0.5 to 2% by weight, and the total concentration of these acid may be the range of 13.5 to 18% by weight.

The treatment temperature is 42 to 48° C. The treatment temperature may be maintained to be high so as to quickly form a thick coating layer. The thickness of the coating layer may be 0.3 to 15 μm. When the thickness of the layer is in the above-mentioned range, a barrier property is excellent and it is difficult to increase a residual electric potential.

The boehmite treatment may be performed by dipping a substrate in pure water at 90 to 100° C. for 5 to 60 min or by contact with hot steam at 90 to 120° C. for 5 to 60 min.

The thickness of the coating layer may be 0.1 to 5 μm. This may be further subjected anodizing using an electrolytic solution having low layer solubility such as adipic acids, boric acids, borates, phosphates, phthalates, maleates, benzoates, tartrates, and citrates.

(Undercoat Layer 2)

Examples of material which may be used for the undercoat layer 2 may include an organic zirconium compound such as a zirconium chelate compound, a zirconium alkoxide compound, and a zirconium coupling agent, an organic titanium compound such as a titanium chelate compound, a titanium alkoxide compound, and a titanate coupling agent, an organic aluminum compound such as an aluminum chelate compound and an aluminum coupling agent, and an organic metal compound such as an antimony alkoxide compound, a germanium alkoxide compound, an indium alkoxide compound, an indium chelate compound, a manganese alkoxide compound, a manganese chelate compound, a tin alkoxide compound, a tin chelate compound, an aluminum silicon alkoxide compound, an aluminum titanium alkoxide compound, and an aluminum zirconium alkoxide compound.

Among them, an organic zirconium compound, an organic titanyl compound, and an organic aluminum compound may be preferably used, since they have low residual electric potential and excellent electrophotographic property.

In addition, the undercoat layer may include a silane coupling agent such as vinyltrichlorosilane, vinyltrimethoxysilane, vinyltriethoxysilane, vinyltris 2 methoxyethoxysilane, vinyltriacetoxysilane, γ-glycidoxypropyltrimethoxysilane, γ-methacryloxypropyltrimethoxysilane, γ-aminopropyltriethoxysilane, γ-chloropropyltrimethoxysilane, γ-2-aminoethylaminopropyltrimethoxysilane, γ-mercapropropyltrimethoxysilane, γ-ureidepropyltriethoxysilane, and β-3,4-epoxycyclohexyltrimethoxysilane.

Furthermore, a known binder resin such as polyvinyl alcohol, polyvinyl methyl ether, poly-N-vinylimidazole, polyethylenoxide, ethyl cellulose, methyl cellulose, an ethylene-acrylic acid copolymer, polyamide, polyimide, casein, gelatin, polyethylene, polyester, phenol resin, a vinyl chloride-vinyl acetate copolymer, epoxy resin, polyvinylpyrrolidone, polyvinylpyridine, polyurethane, polyglutamic acid, and polyacrylic acid that is applied to a known undercoat layer may be used. The mixing ratio may be appropriately determined as necessary.

Furthermore, in the undercoat layer 2, electron-transporting pigments may be mixed or dispersed. Examples of the electron-transporting pigments may include an organic pigment such as a perylene pigment described in JP-A No. 47-30330, a bisbenzoimidazole perylenepigment, a polycyclic quinone pigment, an indigo pigment, and a quinacridone pigment, an organic pigment such as a bisazo pigment and a phthalocyanine pigment having an electron absorption substituent group such as a cyano group, a nitro group, a nitroso group, and a halogen atom, and an inorganic pigment such as zinc oxide and titanium oxide. Among the pigments, a perylene pigment, a bisbenzoimidazole perylene pigment, a polycyclic quinone pigment, zinc oxide, and titanium oxide may be preferably used, since these pigments have high electron mobility.

The surface of the pigment may be treated using a coupling agent or a binder in order to control dispersibility and the charge-transporting property. In views of the strength or coating property of the undercoat layer, the amount of the electron-transporting pigment is preferably 95% by weight or less and more preferably 90% by weight or less based on the total weight of solids of the undercoat layer 2.

Furthermore, fine powder of various types of organic compounds or inorganic compounds may be added to the undercoat layer 2 in order to improve electric or light scattering properties. In particular, inorganic pigments such as white pigments (for example, titanium oxide, zinc oxide, zinc white, zinc sulfide, white lead, lithopone or the like), and body pigments (for example, alumina, calcium carbonate, barium sulphate or the like), polyethylene terephthalate resin particles, benzoguanamine resin particles, and styrene resin particles are useful.

The particle size of the added fine particle may be 0.01 to 2 μm. The fine powder is added if necessary. The addition amount is preferably 10 to 90% by weight and more preferably 30 to 80% by weight based on the total weight of solids of the undercoat layer 2.

A coating liquid in which the above-mentioned constituent materials are mixed/dispersed in a predetermined solvent is coated on the conductive substrate 1 and dried to form the undercoat layer 2.

The mixing/dispersion may be performed according to a typical process using a ball mill, a roll mill, a sand mill, an attritor, an ultrasonic wave or the like.

In addition, any solvent may be used as long as an organic metal compound and a resin may be dissolved in the solvent and elation or agglomeration does not occur when the electron-transporting pigments are mixed/dispersed. Examples of the solvent may include typical organic solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvent may be used singly or may be used as a mixture of two or more thereof.

Examples of coating methods of the coating liquid for forming the undercoat layer 2 may include a typical method such as a blade coating method, a Meyer bar coating method, a spray coating method, a dip coating method, a bead coating method, an air knife coating method, and a curtain coating method.

The solvent is vaporized to perform the drying at a temperature at which the layer is formed.

The thickness of the undercoat layer 2 is preferably 0.01 to 30 μm and more preferably 0.05 to 25 μm.

The undercoat layer 2 may not necessarily be provided. However, since the substrate which has been subjected to the acidic solution treatment or the boehmite treatment may tend to have poor substrate defect hiding ability, it is preferable to form the undercoat layer 2.

(Charge-Generating Layer 3)

The charge-generating layer 3 includes a charge-generating material. Examples of the charge-generating material may include azo pigments such as bisazo and trisazo, condensed aromatic pigments such as dibromoanthanthron, organic pigments such as perylene pigments, pyrrolo pyrrol pigments, and phthalocyanine pigments, and inorganic pigments such as trigonal selenium and zinc oxide. If an exposure wavelength of 380 to 500 nm is used, it is preferable to use a metallic or non-metallic phthalocyanine pigment, trigonal selenium, or dibromoanthanthron.

Among them, it is particularly preferable to use hydroxygallium phthalocyanine that is disclosed in JP-A Nos. 05-263007 and 05-279591, chlorogallium phthalocyanine that is disclosed in JP-A No. 05-98181, dichlorotin phthalocyanine that is disclosed in JP-A Nos. 05-140472 and 05-140473, and titanyl phthalocyanine that is disclosed in JP-A Nos. 04-189873 and 05-43813.

The charge-generating layer 3 may include a binder resin. The binder resin may be selected from various types of insulating resins. The term "insulating" means a state in which volume resistivity is in the range of $10^{12}$ Ω·cm or more. The binder resin may be selected from organic photoconductive polymers such as poly-N-vinylcarbazole, polyvinyl anthracene, polyvinyl pyrene, and polysilane.

Examples of the binder resin may include insulating resins such as polyvinyl butyral resins, polyarylate resins (polycondensates of bisphenol A and phthalic acids), polycarbonate resins, polyester resins, phenoxy resins, vinyl chloride-vinyl acetate copolymers, polyamide resins, acryl resins, polyacrylamide resins, polyvinylpyridine resins, cellulose resins, urethane resins, epoxy resins, casein, polyvinyl alcohol resins, and polyvinylpyrrolidone resins, but the binder resins are not limited to the above resins. The binder resins may be used alone or as a combination of two or more species thereof.

It is preferable that the mixing ratio (weight ratio) of the charge-generating material and the binder resin be in the range of 10:1 to 1:10.

The charge-generating layer 3 may be formed by coating a coating liquid in which the above-mentioned constituent materials are mixed/dispersed in a predetermined solvent on the undercoat layer 2 and drying.

The mixing/dispersion may be performed according to a typical method such as a ball mill dispersion method, an attritor dispersion method, and a sand mill dispersion method.

The dispersion is performed in a condition that a crystal type is not changed. During the mixing/dispersion, the particle size is set to preferably 0.5 μm or less, more preferably 0.3 μm or less, and even more preferably 0.15 μm or less.

Examples of the solvent may include typical organic solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. They may be used alone or as a combination of two or more species thereof.

Examples of coating methods used to form the charge-generating layer may include a typical method such as a blade coating method, a Meyer bar coating method, a spray coating method, a dip coating method, a bead coating method, an air knife coating method, and a curtain coating method.

The thickness of the charge-generating layer 3 is 0.1 to 5 μm and preferably 0.2 to 2.0 μm.

(Charge-Transporting Layer 4)

The charge-transporting layer 4 includes a charge-transporting material and a binder resin or includes a polymer charge-transporting material.

Examples of the charge-transporting material may include electron-transporting compounds such as quinone compounds (for example, p-benzoquinone, chloranyl, bromanil, anthraquinone and the like), tetracyanoquinodimethane compounds, fluorenone compounds (for example, 2,4,7-trinitrofluorenone, xanthone compounds, benzophenone compounds, cyanovinyl compounds, ethylene compounds and the like), and hole-transporting compounds such as triarylamine compounds, benzidine compounds, arylalkane compounds, aryl-substituted ethylene compounds, stilbene compounds, anthracene compounds, and hydrazone compounds.

The charge-transporting materials may be used alone or as a combination of two or more thereof, but are not limited thereto.

The charge-transporting materials may be used alone or as a combination of two or more thereof. However, in views of mobility, it is preferable to use the compound represented by the following Formulae (XII-1), (XII-2), or (XII-3).

(XII-1)

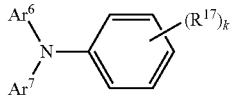

In formula (XII-1), $R^{17}$ is a hydrogen atom or a methyl group, k is 1 or 2, $Ar^6$ and $Ar^7$ are each independently a substituted or unsubstituted aryl group, $—C_6H_4—C(R^{18})=C(R^{19})(R^{20})$, or $—C_6H_4—CH=CH—CH=C(Ar)_2$, and a substituent group is a halogen atom, an alkyl group having 1 to 5 carbon atoms, an alkoxy group having 1 to 5 carbon atoms, or a substituted amino group substituted by an alkyl group having 1 to 3 carbon atoms. $R^{18}$, $R^{19}$, and $R^{20}$ are each independently a hydrogen atom, a substituted or unsubstituted alkyl group, or a substituted or unsubstituted aryl group, and Ar is a substituted or unsubstituted aryl group.

(XII-2)

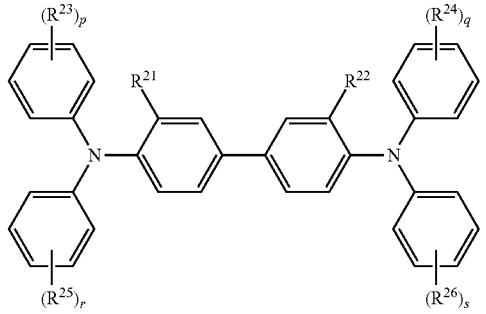

In formula (XII-2), $R^{21}$ and $R^{22}$ are each independently a hydrogen atom, a halogen atom, an alkyl group having 1 to 5 carbon atoms, or an alkoxy group having 1 to 5 carbon atoms, $R^{23}$, $R^{24}$, $R^{25}$, and $R^{26}$ are each independently a halogen atom, an alkyl group having 1 to 5 carbon atoms, an alkoxy group having 1 to 5 carbon atoms, an amino group substituted by an alkyl group having 1 to 2 carbon atoms, a substituted or unsubstituted aryl group, $—C_6H_4—C(R^{18})—C(R^{19})(R^{20})$, or $—C_6H_4—CH=CH—CH=C(Ar)_2$, and p, q, r, and s are each independently an integer from 0 to 2. $R^{18}$, $R^{19}$, and $R^{20}$ are each independently a hydrogen atom, a substituted or unsubstituted alkyl group, or a substituted or unsubstituted aryl group, and Ar is a substituted or unsubstituted aryl group.

(XII-3)

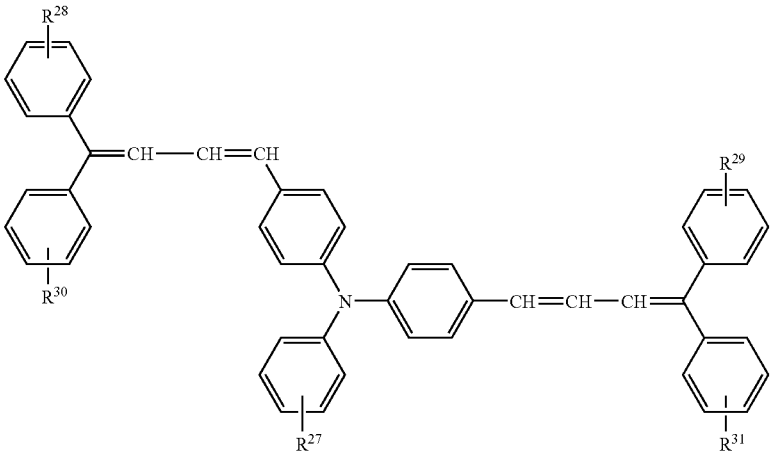

In formula (XII-3), $R^{27}$ is a hydrogen atom, an alkyl group having 1 to 5 carbon atoms, an alkoxy group having 1 to 5 carbon atoms, a substituted or unsubstituted aryl group, or —CH=CH—CH=C(Ar)$_2$. Ar is a substituted or unsubstituted aryl group. $R^{28}$, $R^{29}$, $R^{30}$, and $R^{31}$ are each independently a hydrogen atom, a halogen atom, an alkyl group having 1 to 5 carbon atoms, an alkoxy group having 1 to 5 carbon atoms, an amino group substituted by an alkyl group having 1 to 2 carbon atoms, or a substituted or unsubstituted aryl group. Examples of the binder resin used to form the charge-transporting layer 4 may include a polycarbonate resin, a polyester resin, a methacryl resin, an acryl resin, a polyvinyl chloride resin, a polyvinylidene chloride resin, a polystyrene resin, a polyvinyl acetate resin, a styrene butadiene copolymer, a vinylidene chloride acrylonitrile copolymer, a vinyl chloride-vinyl acetate copolymer, a vinyl chloride-vinyl acetate-maleic anhydride copolymer, a silicone resin, a silicone-alkyd resin, a phenol-formaldehyde resin, a styrene-alkyd resin, poly-N-vinyl carbazole, polysilane, and polymer charge-transporting materials such as polyester-based polymer charge-transporting materials disclosed in JP-A Nos. 08-176293 or 08-208820.

The above-mentioned binder resins may be used alone or as a combination of two or more thereof.

In views of electronic properties or strength, more preferable examples of the binder resin used in the charge-transporting layer 4 include a polycarbonate resin. It is preferable to increase the average molecular weight of polycarbonate in order to improve adhesion strength between the charge-transporting layer 4 and the protective layer 5. Specifically, the viscosity average molecular weight of polycarbonate is preferably 30000 or more and more preferably 40000 or more.

The mixing ratio (weight ratio) of the charge-transporting material and the binder resin is preferably 10:1 to 1:5. In views of improvement in adhesion property, it is preferable to increase the amount of the binder resin. It is more preferable that the mixing ratio (weight ratio) be 1:1 to 1:5.

Instead of using the low molecular weight charge-transporting material in conjunction with the binder resin, a polymer charge-transporting material may be used alone. Examples of the polymer charge-transporting material may include known materials having a charge-transporting property such as poly-N-vinylcarbazole and polysilane. In particular, it is preferable to use a polyester-based polymer charge-transporting material disclosed in JP-A Nos. 08-176293 and 08-208820, since it has a high charge-transporting property.

The polymer charge-transporting material may be used alone to form the charge-transporting layer. Alternatively, the polymer charge-transporting material may be mixed with the binder resin to form the layer.

The charge-transporting layer 4 may be formed by coating a coating liquid containing the above-mentioned constituent materials on the charge-generating layer 3 and drying.

Examples of solvents used in the coating liquid of the charge-transporting layer 4 may include typical organic solvents such as aromatic hydrocarbons (for example, benzene, toluene, xylene, chlorobenzene and the like), ketones (for example, acetone, 2-butanone and the like), halogenated aliphatic hydrocarbons (for example, methylene chloride, chloroform, ethylene chloride and the like), and cyclic or straight-chained ether (for example, tetrahydrofuran, ethyl ether and the like).

They may be used alone or as a combination of two or more species thereof. Examples of coating methods of the coating liquid for forming the charge-transporting layer may include a typical method such as a blade coating method, a wire bar coating method, a spray coating method, a dip coating method, a bead coating method, an air knife coating method, and a curtain coating method.

It is preferable that the solvent do not remain after the drying in order to maintain predetermined adhesion property between the charge-transporting layer 4 and the protective layer 5. Specifically, it is preferable to desirably vaporize the solvent at sufficiently high temperatures so that the amount of residual solvent be 1% or less.

The thickness of the charge-transporting layer 4 is preferably 5 to 50 μm and more preferably 10 to 30 μm.

(Protective Layer 5)

The protective layer 5 may be a crosslinking layer having a charge-transporting property in order to ensure mechanical strength. Examples of the crosslinking layer may include a phenol resin crosslinking layer, an epoxy resin crosslinking layer, a siloxane resin crosslinking layer, and a urethane resin layer, which have a charge-transporting property.

The resin which is used to form the crosslinking layer is classified into two types: a curable resin for crosslinking, to which a curing catalyst is added, and a curing base compound a curing agent, which are subjected to two liquid mixing for crosslinking. In both types, two types or more liquids which are cured when being mixed are prepared, and energy such as heat is applied to the liquids after the mixing if necessary to form the cured layer having high mechanical strength.

Examples of combination of compositions used to form the crosslinking layer include a combination of a novolac resin and a basic catalyst, a combination of a resol phenol resin and an acidic catalyst, a combination of polyol that is a base compound of a urethane resin and polyisocyanate that is a curing agent, a combination of polyamine that is a base compound of a polyurea resin and polyisocyanate that is a curing agent, a combination of an epoxy resin and amine imidazole an acid anhydride, an organic acid, or an inorganic acid that is a curing agent.

In respects to the combinations in which gelation due to the reaction occurs after immediately the mixing, stable coating may be performed by using the layer forming method of an exemplary embodiment of the invention.

Among them, in order to suppress image degradation when an electrophotographic device is used in a high temperature and high humidity environment, it is preferable to use the phenol resin and the resol resin having the charge-transporting property. It is more preferable to form a crosslinking layer that includes one or more phenol derivatives having at least a methylol group and at least one charge-transporting compound containing at least one substituent group selected from a hydroxyl group, a carboxyl group, an alkoxysilyl group, an epoxy group, a thiol group, and an amino group as the charge-transporting component.

The phenol derivative having a methylol group may be obtained as follows. A compound having a phenol structure, such as substituted phenol having one hydroxyl group (for example, resorcin, bisphenol, phenol, cresol, xylenol, p-alkylphenol, p-phenylphenol, and the like), substituted phenol having two hydroxyl groups (for example, catechol, resorcinol, hydroquinone and the like), bisphenol (for example, bisphenol A, bisphenol Z and the like), and biphenol, is allowed to react with formaldehyde, paraformaldehyde or the like in the presence of an acidic or basic catalyst, to obtain a monomethylolphenol, dimethylolphenol, or trimethylolphenol monomer, a mixture thereof, an oligomer thereof, and a mixture of the monomer and the oligomer. Among them, a relatively larger molecule having a repeating unit of a molecular structure of 2 to 20 is an oligomer and a smaller molecular is a monomer. Examples of the basic catalyst include, but are not limited to hydroxides of alkali metal or alkali earth metal, such as NaOH, KOH, and $Ca(OH)_2$, and an amine-based catalyst such as ammonia, hexamethylenetetramine, trimethylamine, triethylamine, and triethanolamine. If the basic catalyst is used, a carrier may be significantly trapped due to the residual catalyst, and thus the electrophotographic property, may be reduced. Therefore, it is preferable that the catalyst be neutralized using an acid or deactivated or removed using a contact to an adsorbing agent such as silica gel or an ion-exchange resin.

The resol phenol resin may be mixed with an acidic catalyst during the curing to form a curing layer having desirable mechanical strength. Examples of the acidic catalyst may include inorganic acids such as hydrochloric acid and sulfuric acid, organic acids such as carboxylic acids and organic sulfonic acids, and compounds in which an organic acid is blocked with an ammonium salt. In general, the resol type curable resin may be reacted with the above-mentioned acid at normal temperature while the pH is 2 or less. However, the reaction may slowly occur even though the pH is 2 or more. Thus, when the coating liquid for the protective layer is not mixed in advance, but is mixed on the substrate during coating as in an exemplary embodiment of the invention, physical properties of liquid may be unchanged and the photoreceptor protective layer having the constant strength may be formed by the continuous production.

The charge-transporting compound that is included in the protective layer 5 may be a compound having any one of structures represented by the following Formulae (I) to (V) in views of mechanical strength and stability.

$$F[-(X^1)_n-(R^1)_k-Z^1H]_m \qquad \text{Formula (I)}$$

In formula (I, F is an organic group which is derived from a compound having a hole-transporting property, $X^1$ is an oxygen atom or a sulfur atom, $R^1$ is an alkylene group, $Z^1$ is an oxygen atom, a sulfur atom, NH, or COO, n is 0 or 1, m is an integer from 1 to 4, and k is 0 or 1.

$$F-[(X^2)_{n2}-(R^2)_{n3}-(Z^2)_{n4}G]_{n5} \qquad \text{Formula (II)}$$

In formula (II), F is an organic group which is derived from a compound having a hole-transporting property, $X^2$ is an oxygen atom or a sulfur atom, $R^2$ is an alkylene group, $Z^2$ is an alkylene group, an oxygen atom, a sulfur atom, NH, or COO, G is an epoxy group, n2, n3, and n4 are each independently 0 or 1, and n5 is an integer from 1 to 4, Formula (III)

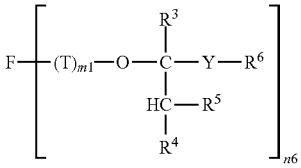

In Formula (III), F is an organic group derived from a compound having a hole-transporting property, T is a divalent group, Y is an oxygen atom or a sulfur atom, $R^3$, $R^4$, and $R^5$ are each independently a hydrogen atom or a monovalent organic group, $R^6$ is a monovalent organic group, m1 is 0 or 1, n6 is an integer from 1 to 4, and $R^5$ and $R^6$ may be bonded to each other to form a heterocycle having Y as a hetero atom.

Formula (IV)

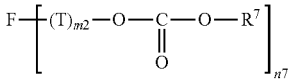

In Formula (IV), F is an organic group derived from a compound having a hole-transporting property, T is a divalent group, $R^7$ is a monovalent organic group, m2 is 0 or 1, and n7 is an integer from 1 to 4.

Formula (V)

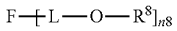

In Formula (V), F is an organic group derived from a compound having a hole-transporting property, L is an alkylene group, $R^8$ is a monovalent organic group, and n8 is an integer from 1 to 4.

In Formulae (I) to (V), the organic group F may be an organic group having a structure represented by Formula (VI).

Formula (VI)

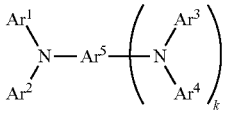

In Formula (VI), $Ar^1$ to $Ar^4$ are each independently a substituted or unsubstituted aryl group, $Ar^5$ is a substituted or unsubstituted aryl group or arylene group, k is 0 or 1, two to four of $Ar^1$ to $Ar^5$ are bonded to a monovalent organic group represented by Formulae (VII), (VIII), (IX), (X), or (XI) in Formulae (I) to (V).

$$-(X^1)_n-(R^1)_k-Z^1H \qquad \text{Formula (VII)}$$

In Formula (VII), $X^1$ is an oxygen atom or a sulfur atom, $R^1$ is an alkylene group, $Z^1$ is an oxygen atom, a sulfur atom, NH, or COO, n is 0 or 1, and k is 0 or 1.

$$-(X^2)_{n1}-(R^2)_{n2}-(Z^2)_{n3}G \qquad \text{Formula (VIII)}$$

In Formula (VIII), $X^2$ is an oxygen atom or a sulfur atom, $R^2$ is an alkylene group, $Z^2$ is an oxygen atom, a sulfur atom, NH, or COO, G is an epoxy group, n1, n2, and n3 are each independently 0 or 1.

Formula (IX)

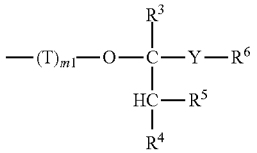

In Formula (IX), T is a divalent group, Y is an oxygen atom or a sulfur atom, $R^3$, $R^4$, and $R^5$ are each independently a hydrogen atom or a monovalent organic group, $R^6$ is a monovalent organic group, m1 is 0 or 1, and $R^5$ and $R^6$ may be bonded to each other to form a heterocycle having Y as a hetero atom.

Formula (X)

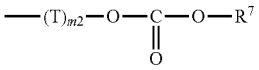

In Formula (X), T is a divalent group, $R^7$ is a monovalent organic group, and m2 is 0 or 1.

-L-O—$R^8$ Formula (XI)

In Formula (XI), L is an alkylene group, and $R^8$ is a monovalent organic group. In Formula (VI), a substituted or unsubstituted aryl group represented by $Ar^1$ to $Ar^4$ may be an aryl group represented by any one of Formulae (VI-1) to (VI-7).

In Formulae (VI-1) to (VI-7), $R^9$ is a hydrogen atom, an alkyl group having 1 to 4 carbon atoms, an alkoxy group having 1 to 4 carbon atoms, a substituted phenyl group substituted thereby or unsubstituted phenyl group, or an aralkyl croup having 7 to 10 carbon atoms, $R^{10}$ to $R^{12}$ are each independently a hydrogen atom, an alkyl group having 1 to 4 carbon atoms, an alkoxy croup having 1 to 4 carbon atoms, a substituted phenyl group substituted thereby or unsubstituted phenyl group, an aralkyl group having 7 to 10 carbon atoms, or a halogen atom, and X is a site represented by Formulae (VII) to (XI) in Formulae (I) to (V), m and s are each independently 0 or 1, and t is an integer from 1 to 3.

VI-1

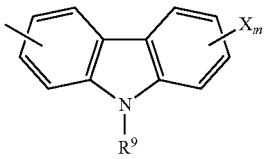

VI-2

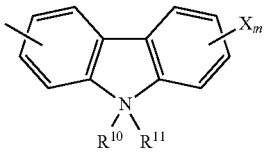

VI-3

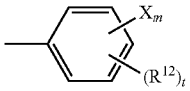

VI-4

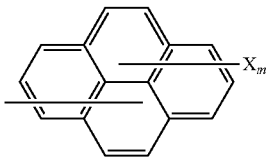

VI-5

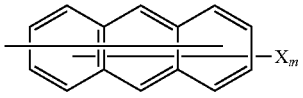

VI-6

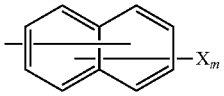

VI-7

The aryl group represented by Formula (VI-7) may be an aryl group represented by Formula (VI-8) or (VI-9).

In Formulae (VI-8) and (VI-9), $R^{13}$ and $R^{14}$ are each independently a hydrogen atom, an alkyl group having 1 to 4 carbon atoms, an alkoxy group having 1 to 4 carbon atoms, a substituted phenyl group substituted thereby or unsubstituted phenyl group, an aralkyl group having 7 to 10 carbon atoms, or a halogen atom. t is an integer from 1 to 3

VI-8

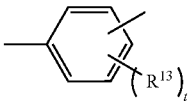

VI-9

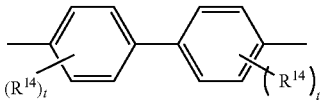

In the aryl group represented by Formula (VI-7), Z may be a divalent group represented by any one of Formulae (VI-10) to (VI-17).

In Formulae (VI-10) to (VI-17), $R^{15}$ and $R^{16}$ are each independently a hydrogen atom, an alkyl group having 1 to 4 carbon atoms, an alkoxy group having 1 to 4 carbon atoms, a substituted phenyl group substituted thereby or unsubstituted phenyl group, an aralkyl group having 7 to 10 carbon atoms, or a halogen atom. q and r are each independently an integer from 1 to 10, and t is an integer from 1 to 3.

VI-10

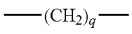

VI-11

VI-12

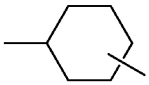

VI-13

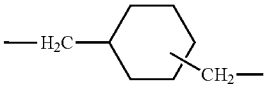

VI-14

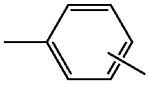

VI-15

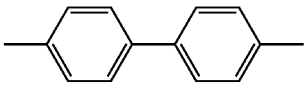

VI-16

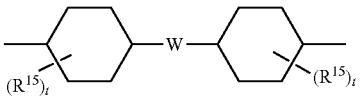

VI-17

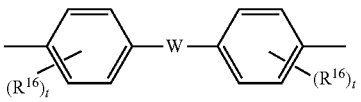

Furthermore, in Formulae (VI-16) to (VI-17), W may be a divalent group represented by any one of Formulae (VI-18) to (VI-26).

In Formula (VI-25), u is an integer from 0 to 3.

VI-18 —$CH_2$—

VI-19 —$C(CH_3)_2$—

VI-20 —O—

VI-21 —S—

VI-22 —$C(CF_3)_2$—

VI-23 —$Si(CH_3)_2$—

VI-24

VI-25

VI-26

In Formula (VI), examples of a specific structure of $Ar^5$ include specific structures of $Ar^1$ to $Ar^4$ having m of 1 when k is 0 and specific structures of $Ar^1$ to $Ar^4$ having m of 0 when k is 1.

Specific examples of the compound represented by Formula (I) include the following compounds.

I-1

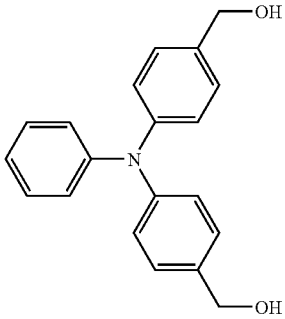

I-2

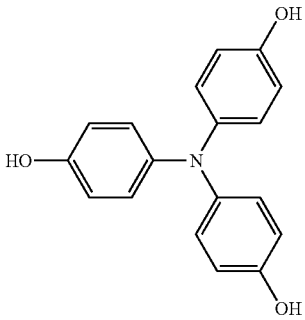

-continued

I-3

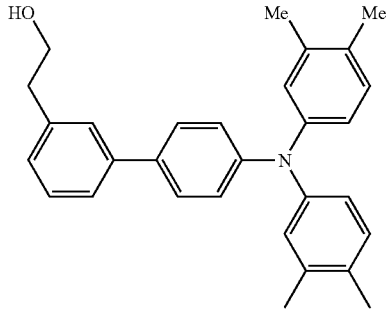

I-4

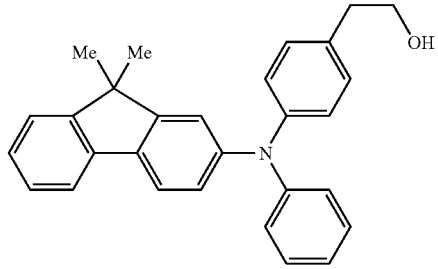

I-5

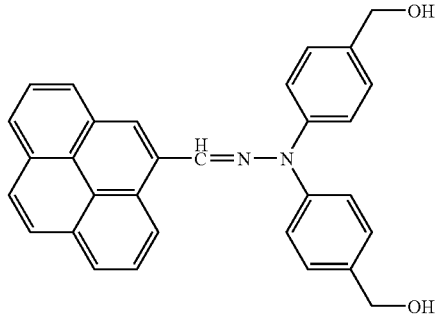

I-6

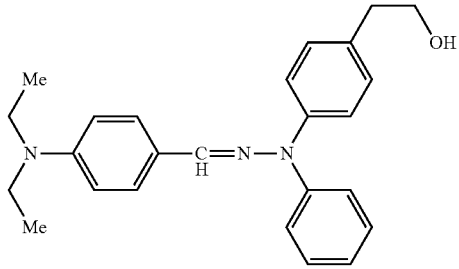

I-7

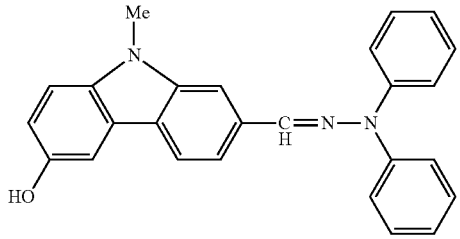

-continued
I-8
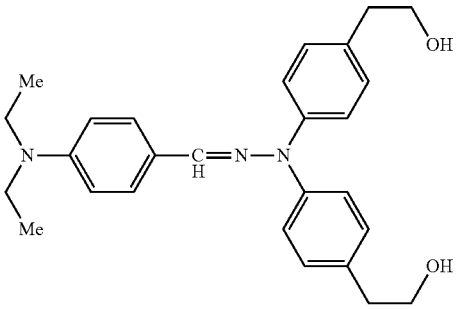
I-9
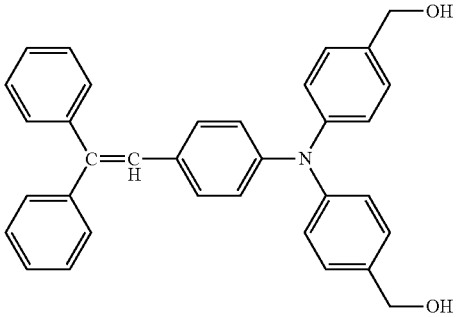
I-10
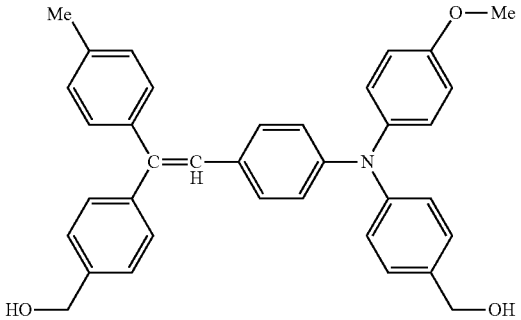
I-11
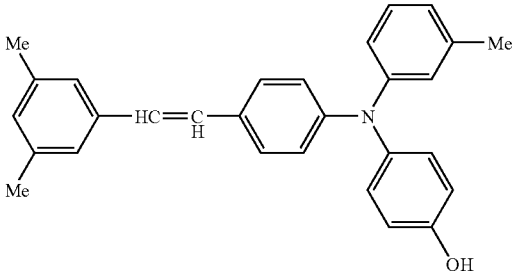
I-12
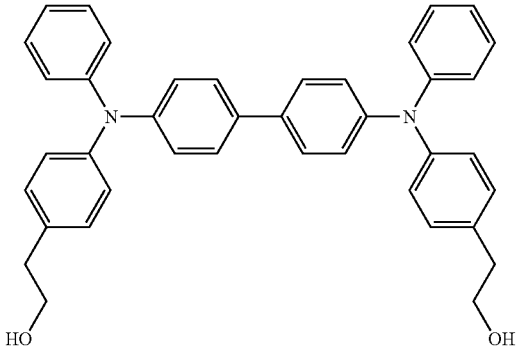
-continued
I-13
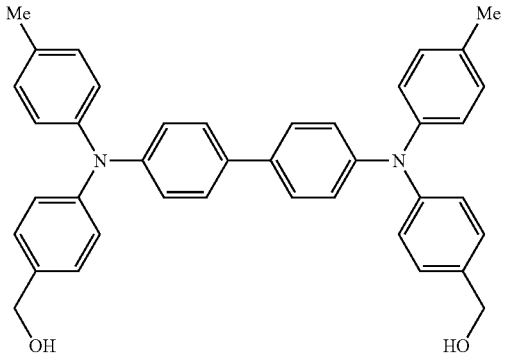
I-14
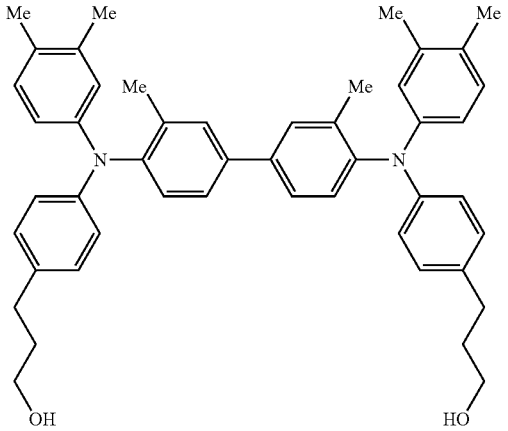
I-15
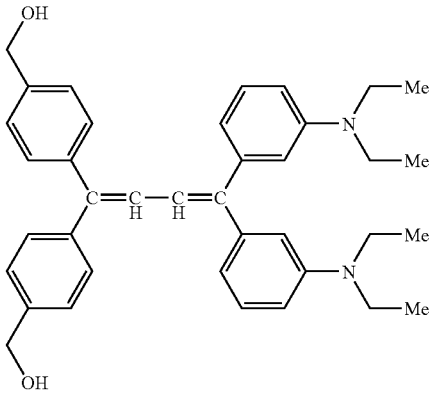
I-16
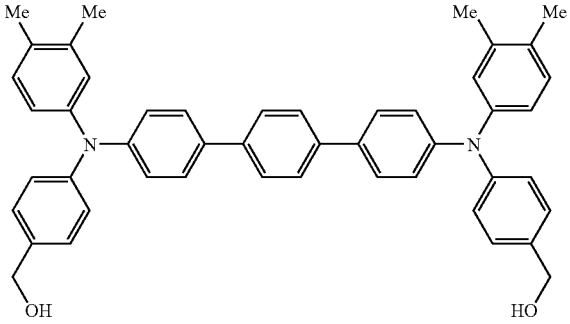

-continued
I-17
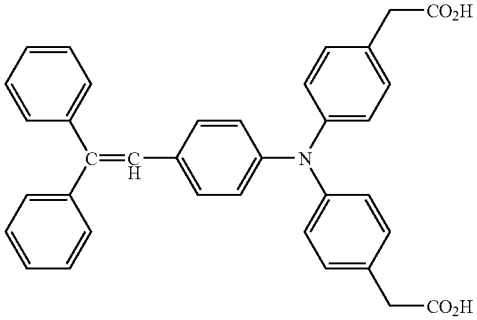
I-18
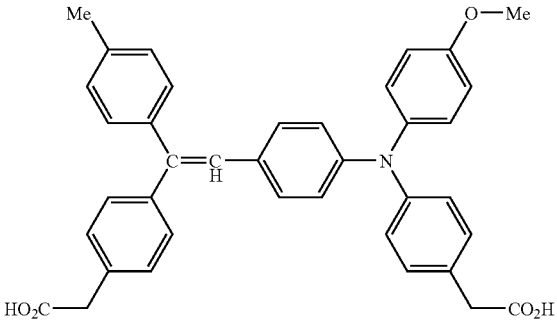
I-19
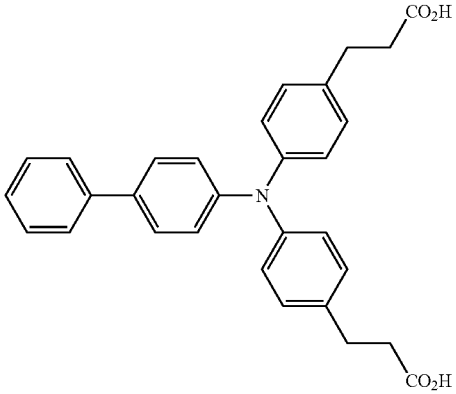
I-20
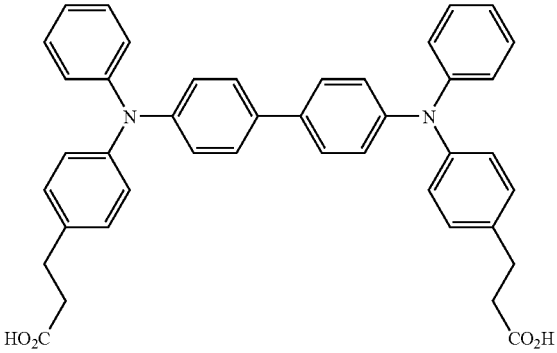
-continued
I-21
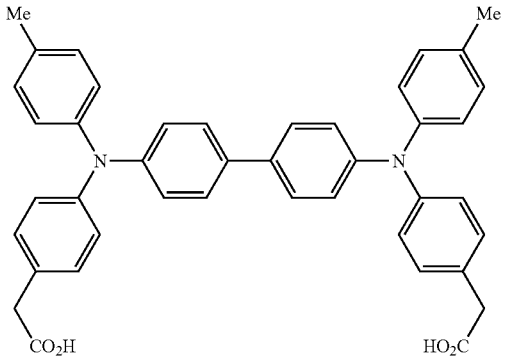
I-22
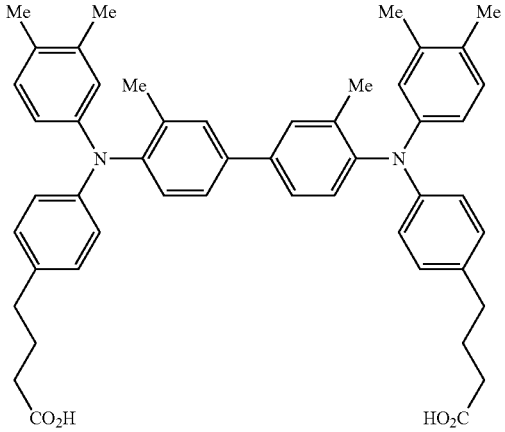
I-23
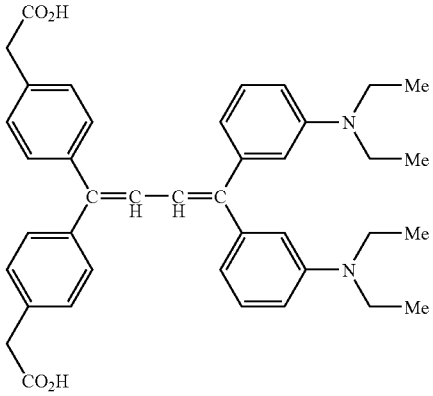
I-24
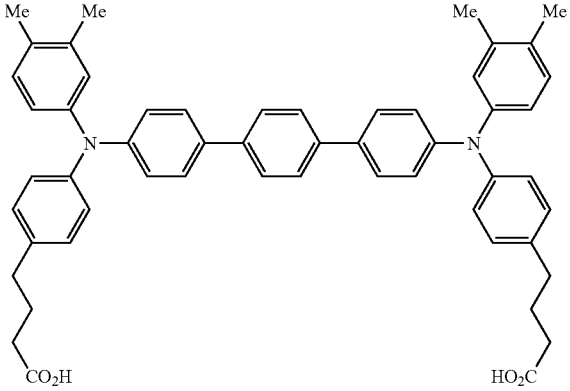

-continued
I-25
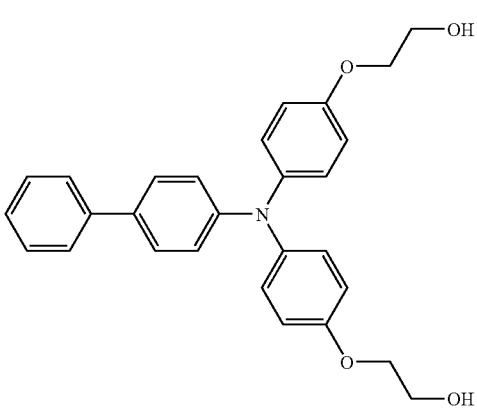
I-26
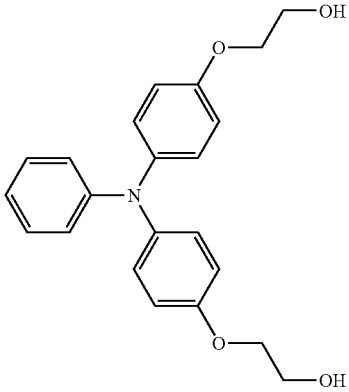
Specific examples of the compound represented by Formula (II) include the following compounds. In the following compounds, Me or a portion in which a hand to be bonded is shown but a substituent group is not denotes a methyl group, and Et denotes an ethyl group.
II-1
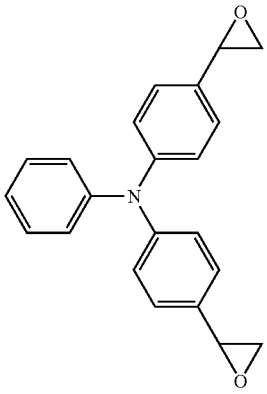
-continued
II-2
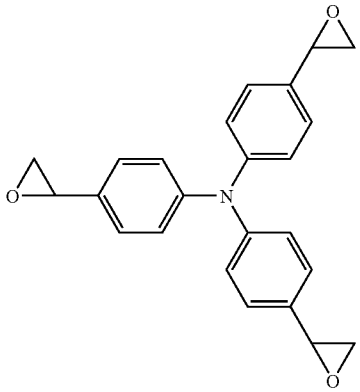
II-3
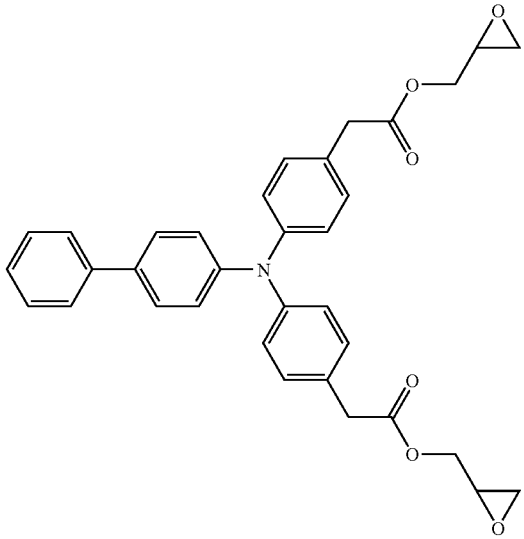
II-4
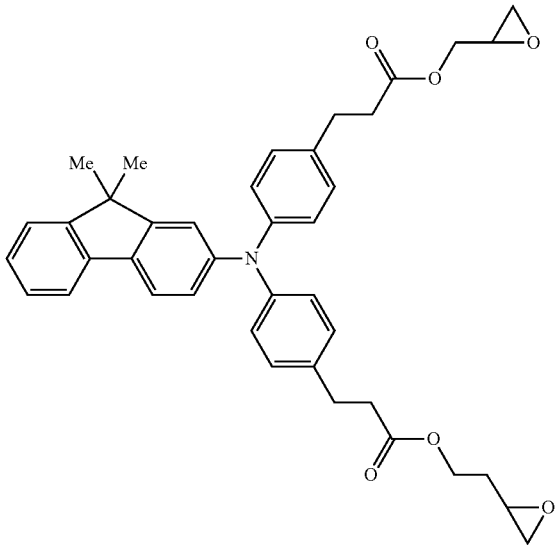

-continued
II-5
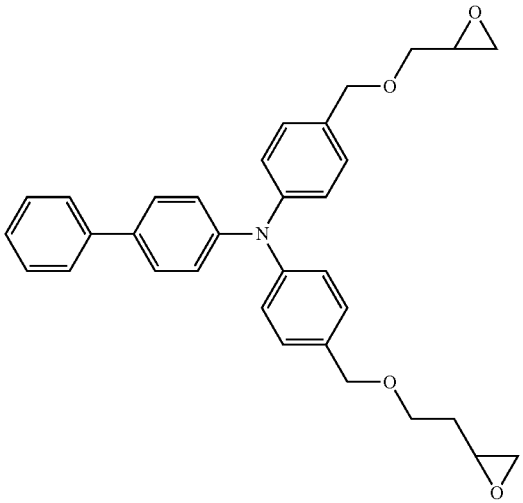
II-6
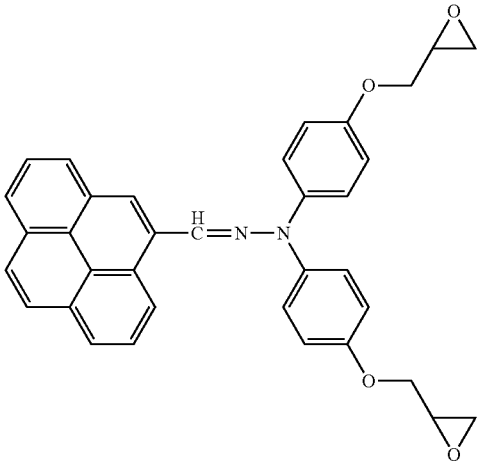
II-7
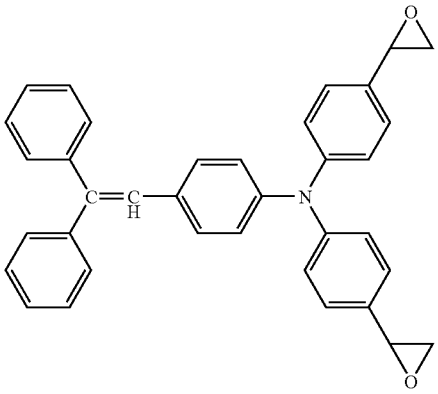
-continued
II-8
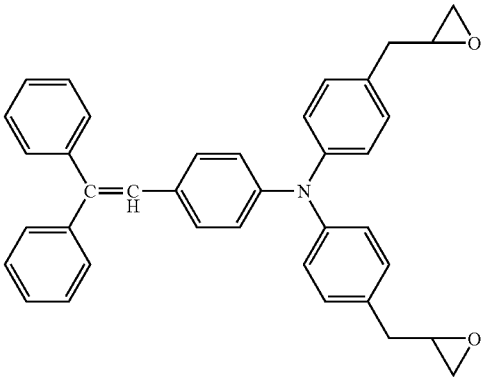
II-9
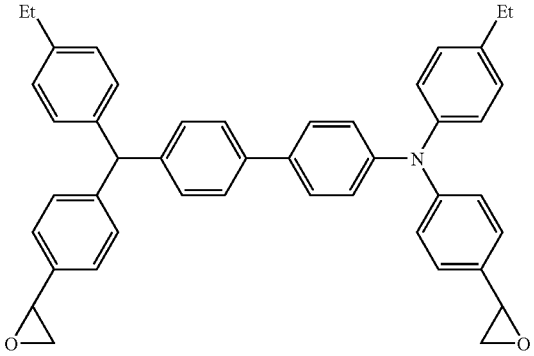
II-10
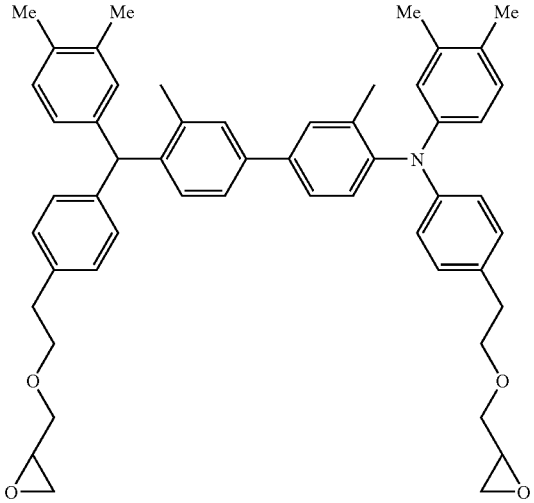

-continued
II-11
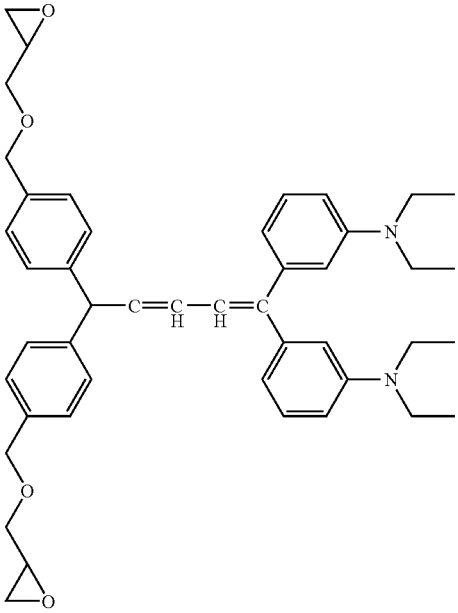
II-12
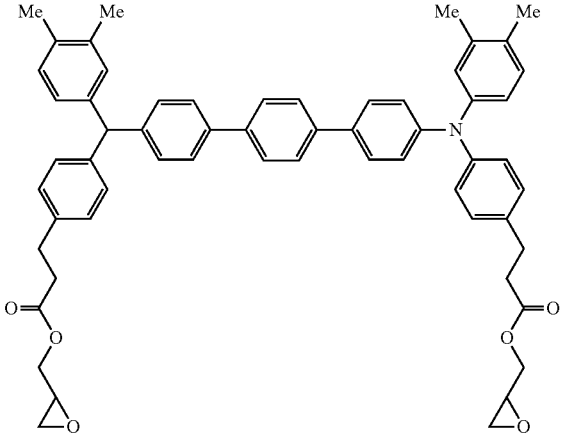
II-13
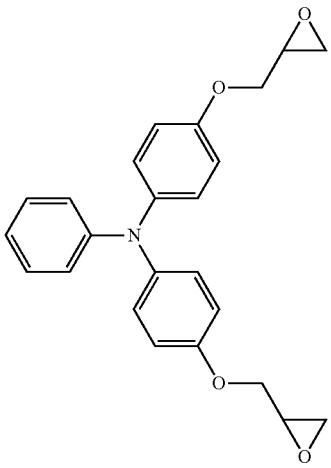
-continued
II-14
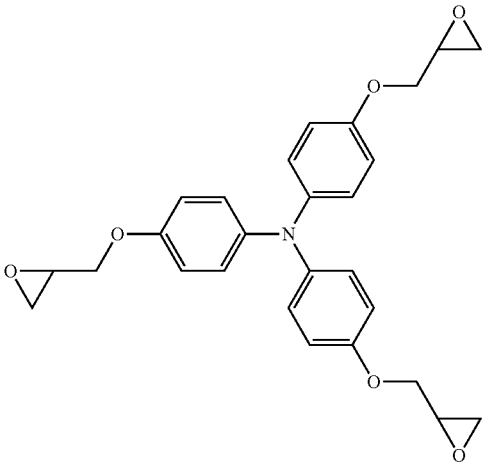
II-15
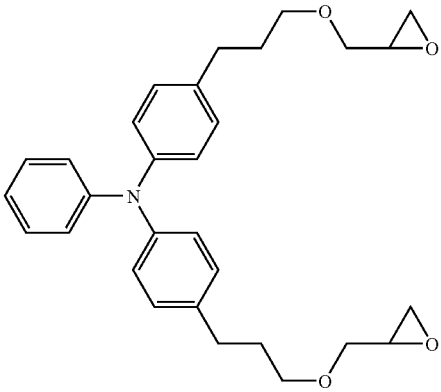
II-16
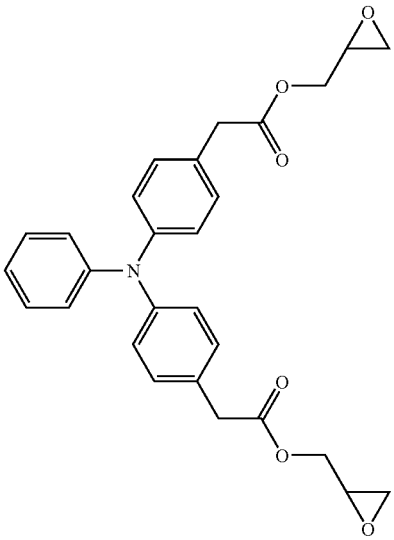

-continued
II-17
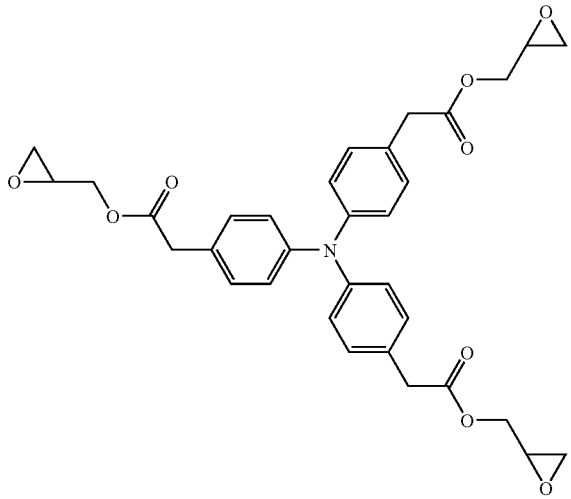
II-18
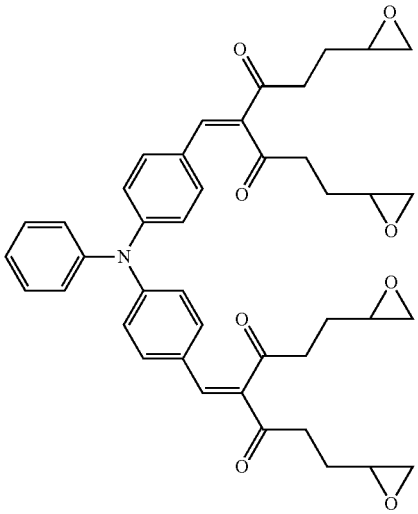
II-19
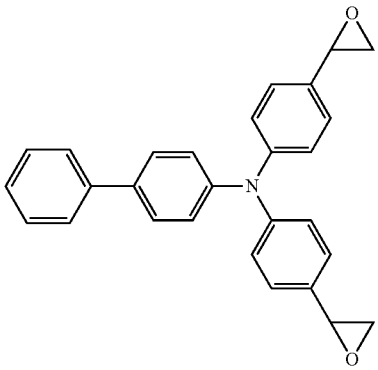
-continued
II-20
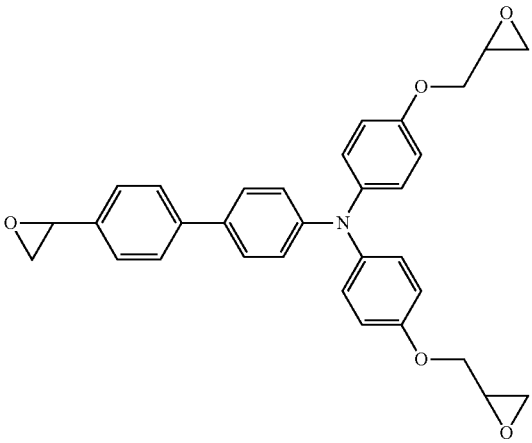
II-21
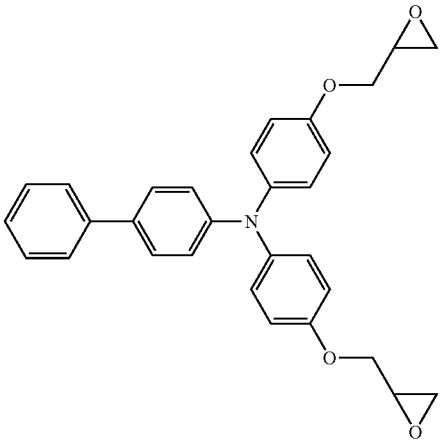
II-22
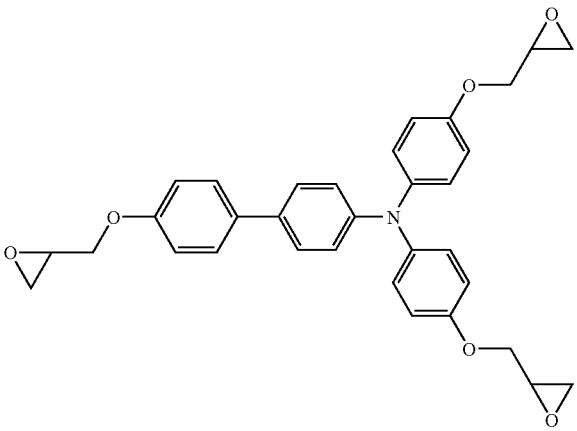

-continued
II-23
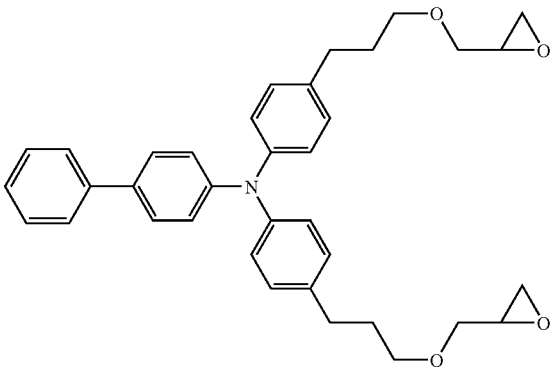
II-24
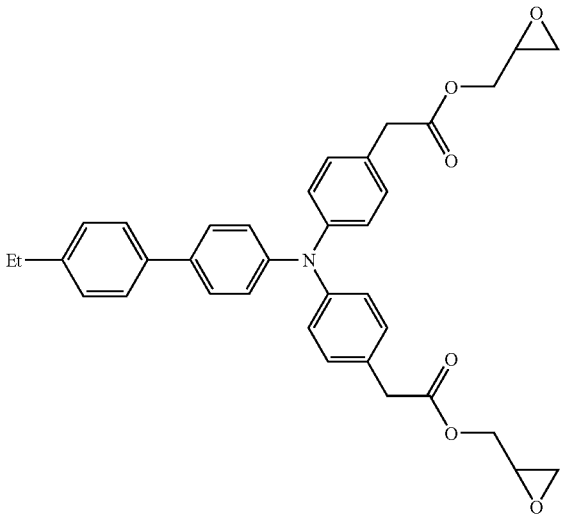
II-25
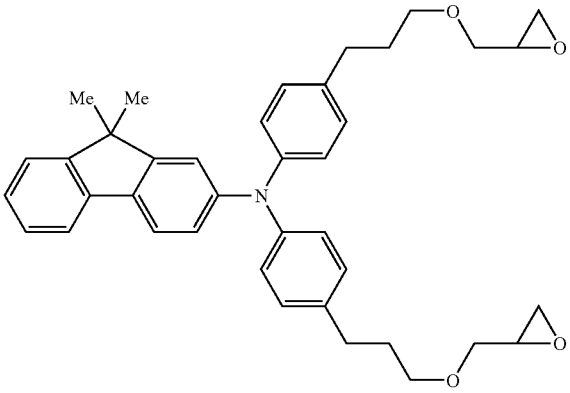
-continued
II-26
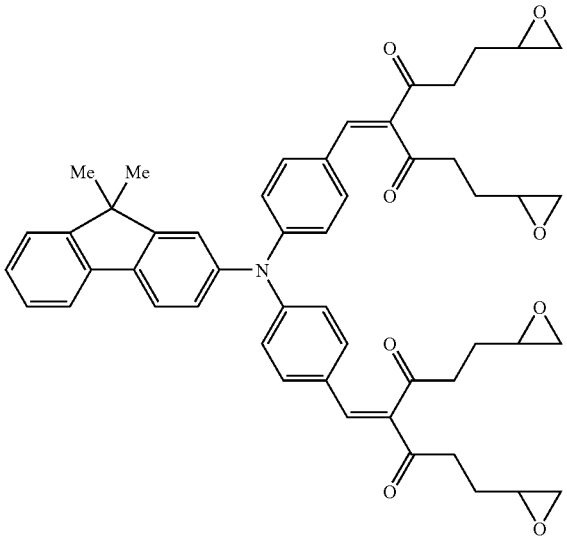
II-27
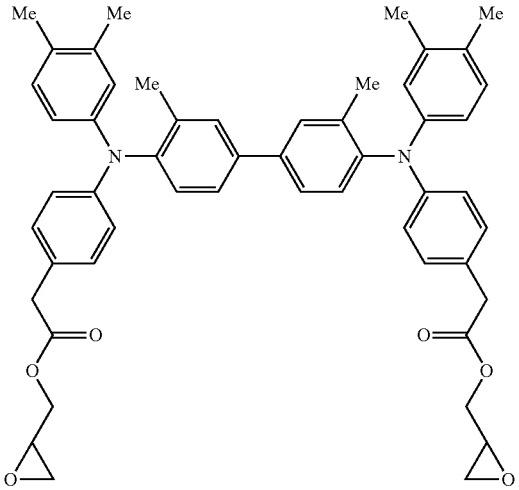
II-28
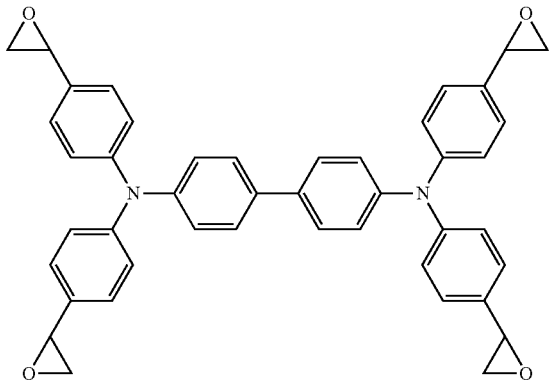

-continued
II-29
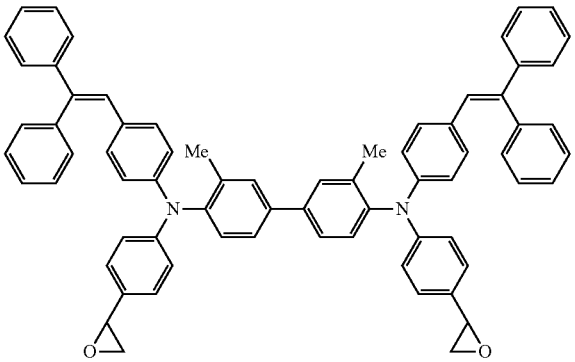
II-30
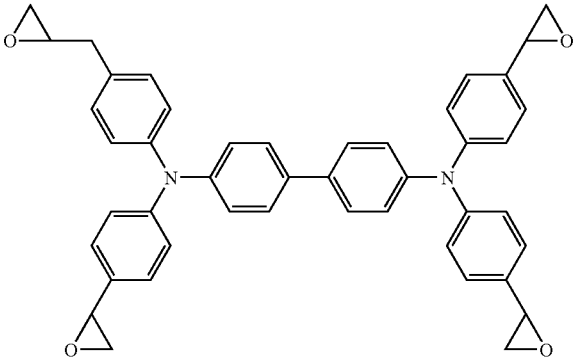
II-31
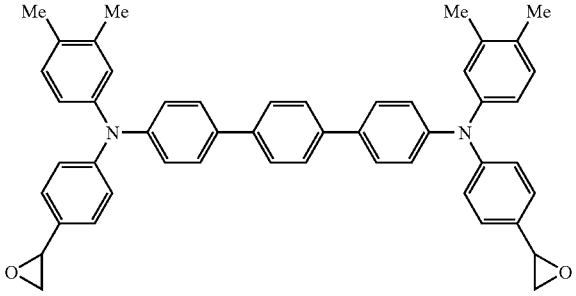
II-32
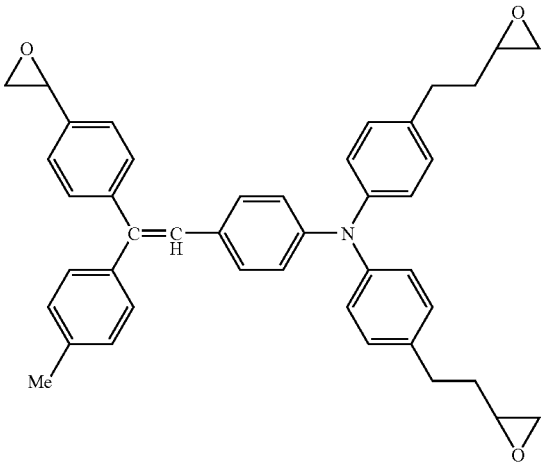
-continued
II-33
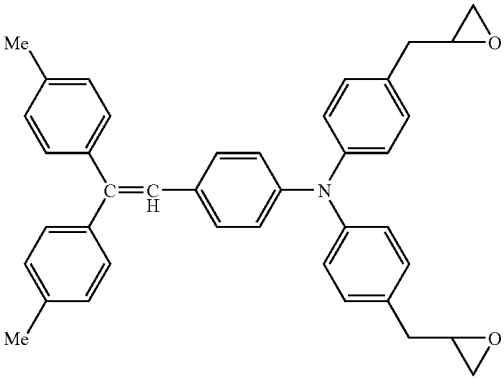
II-34
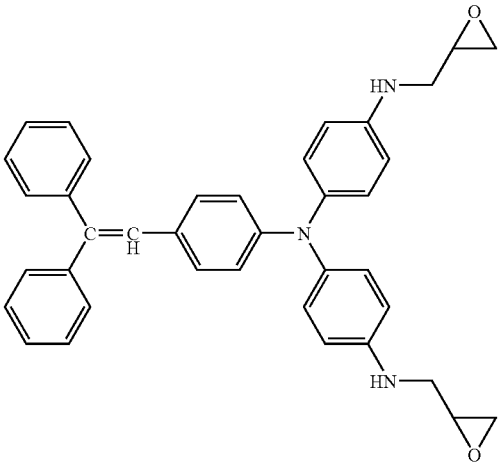
II-35
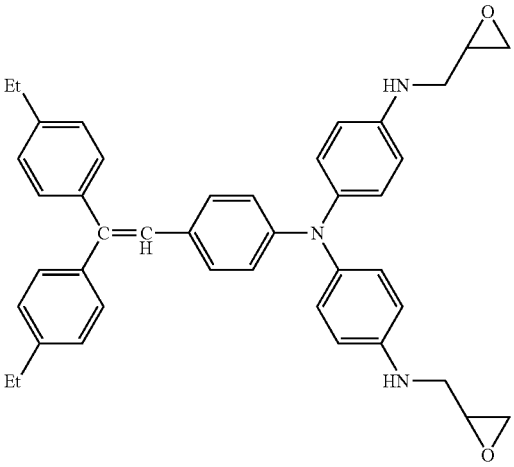

-continued
II-36
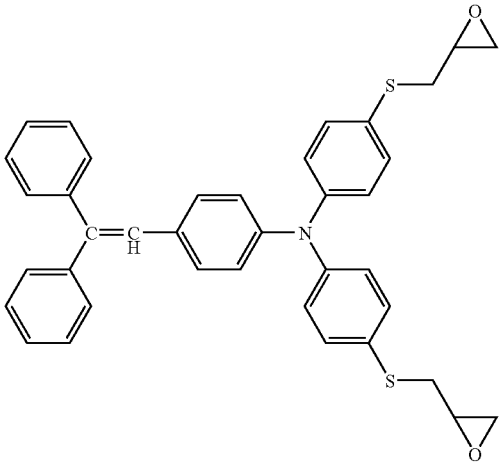
II-37
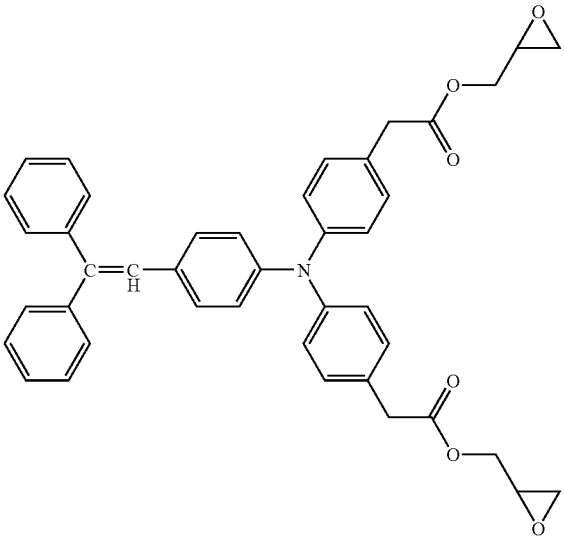
II-38
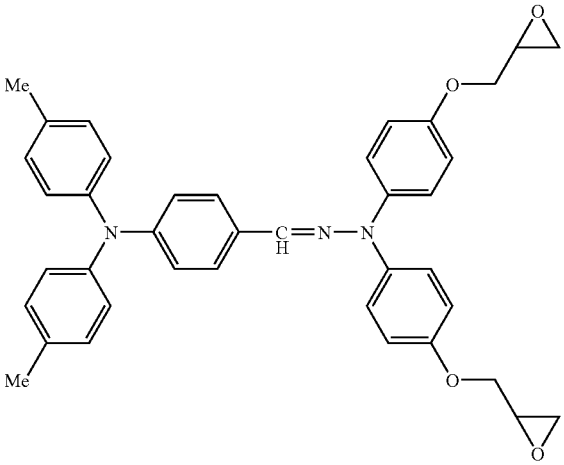
-continued
II-39
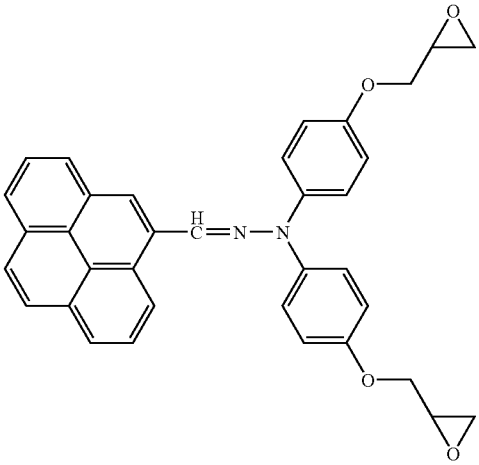
II-40
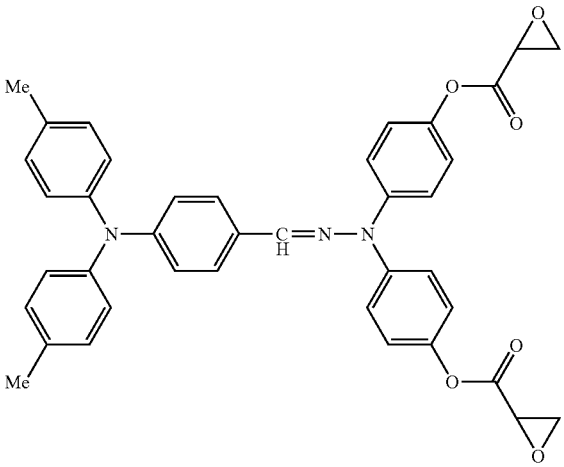
II-41
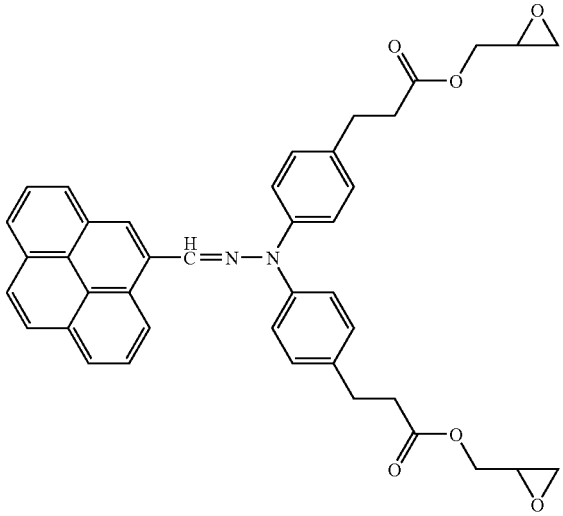

-continued
II-42
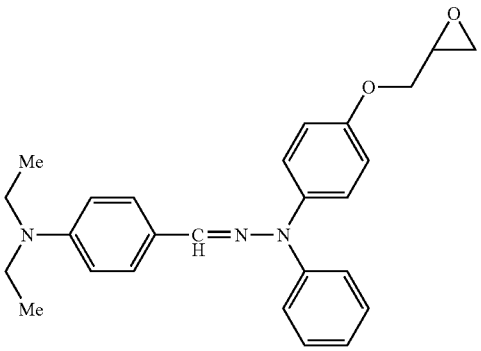
II-43
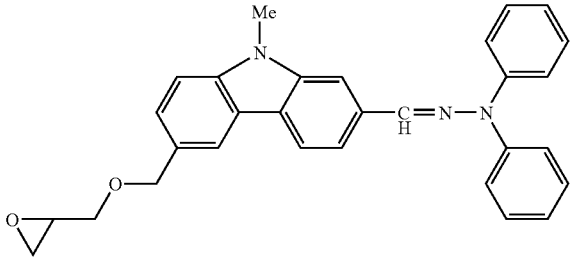
II-44
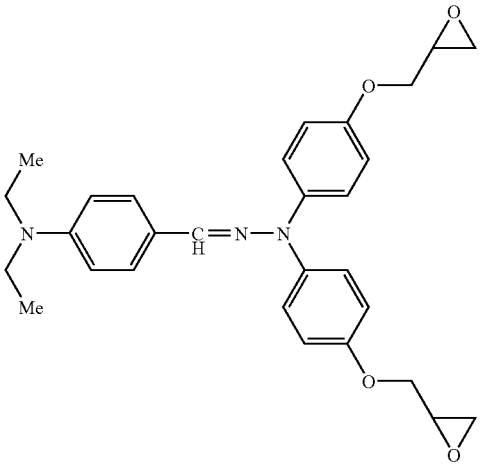
-continued
II-45
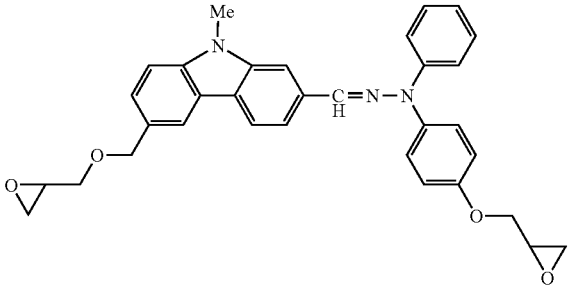
II-46
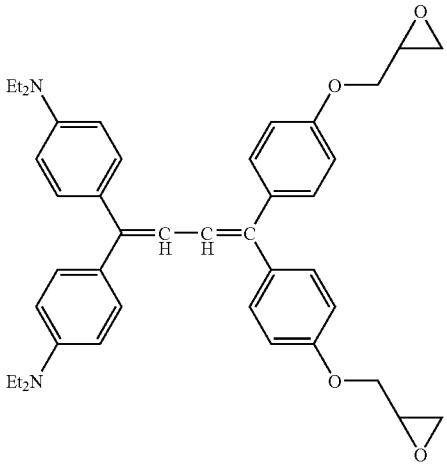
II-47
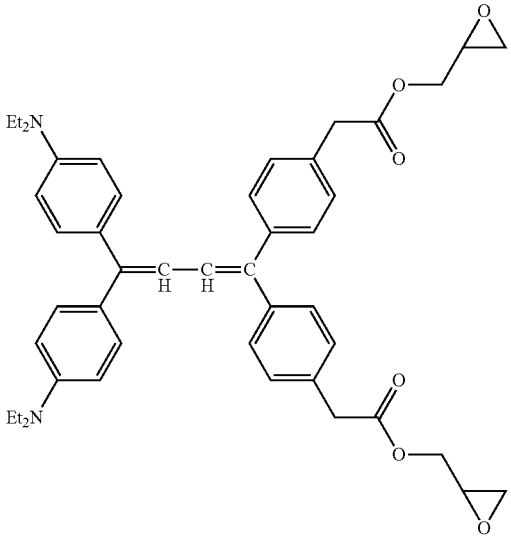
Specific examples of the compound represented by Formula (III) include the following compounds. In the following compounds, Me or a portion in which a hand to be bonded is shown but a substituent group is not denotes a methyl group, and Et denotes an ethyl group.

III-1
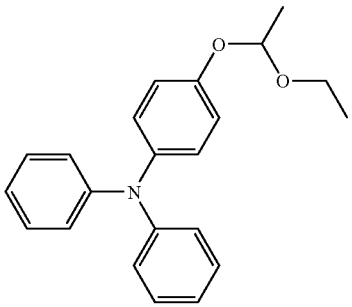
III-2
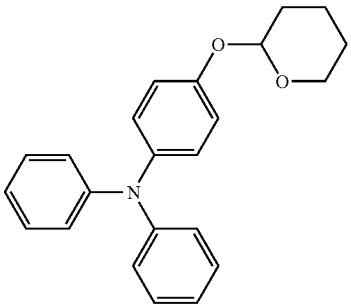
III-3
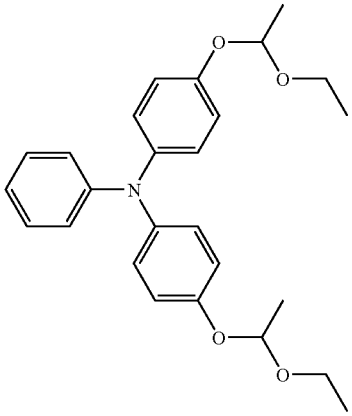
III-4
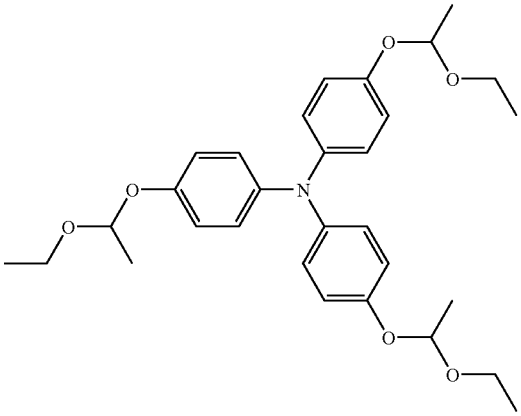
III-5
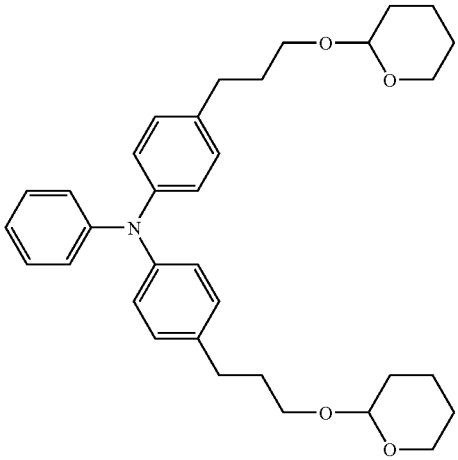
III-6
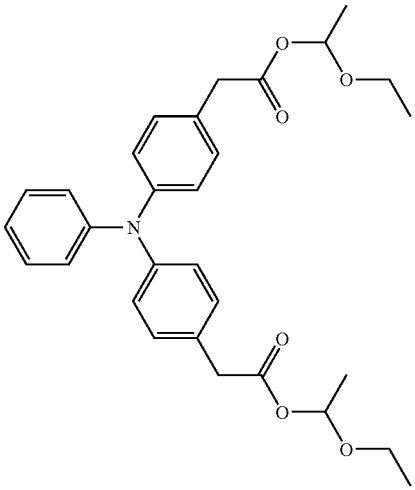

-continued
III-7
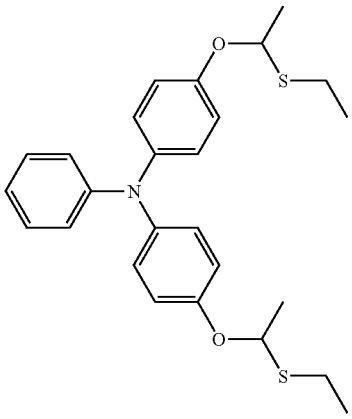
III-8
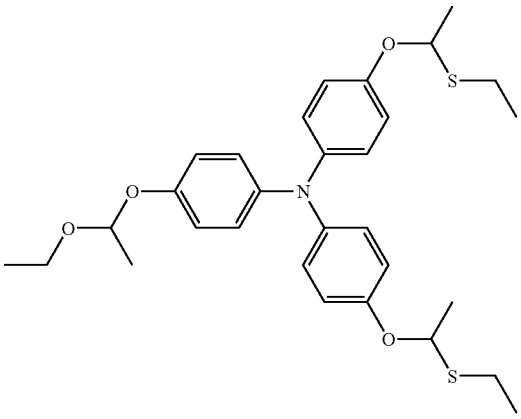
III-9
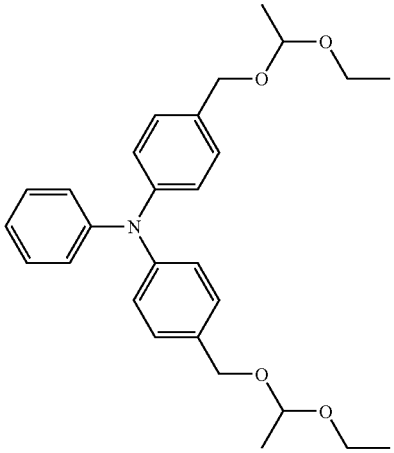
III-10
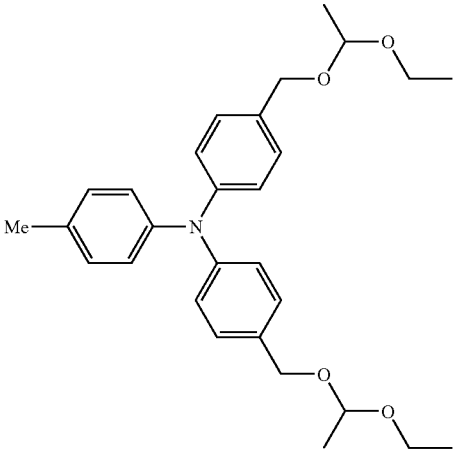
III-11
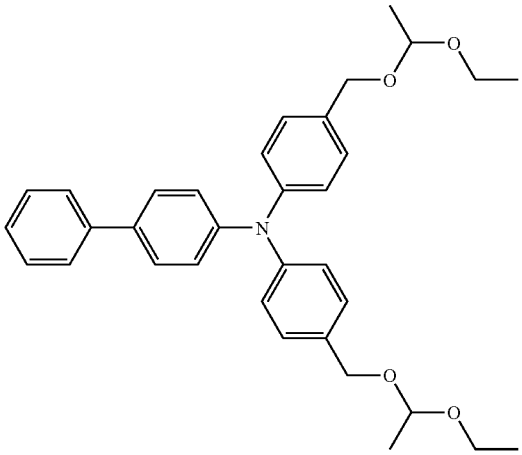
III-12
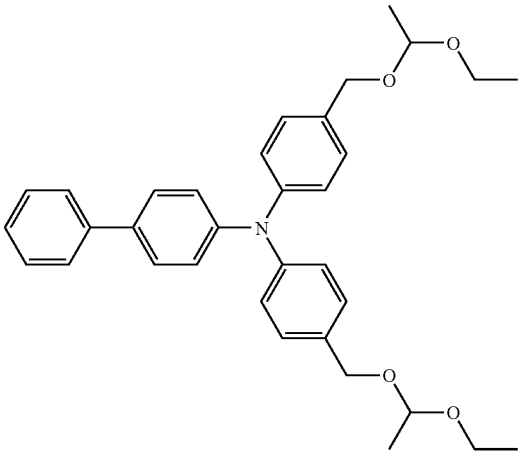

-continued
III-13
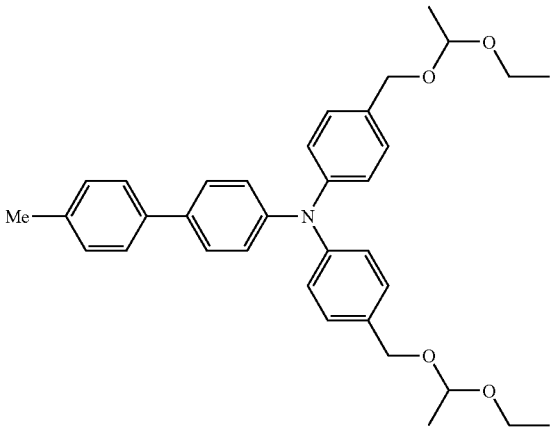
III-14
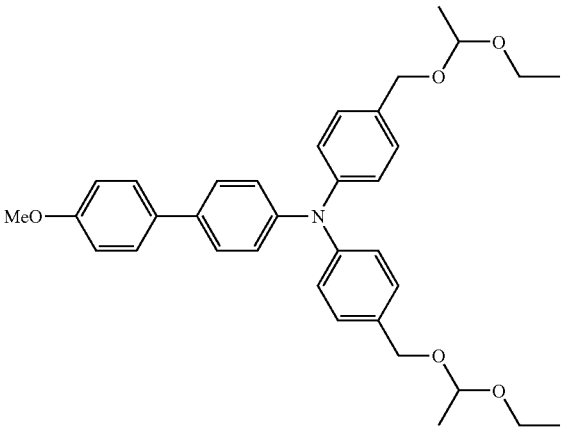
III-15
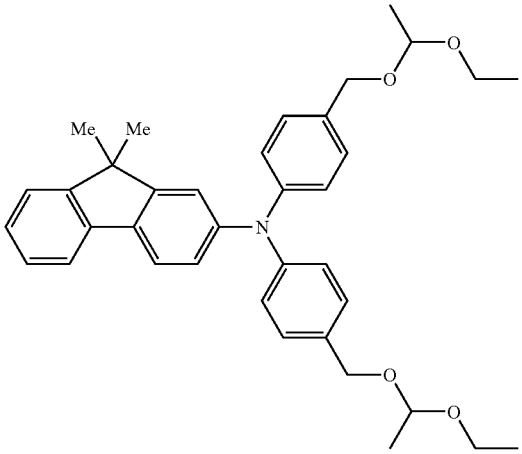
III-16
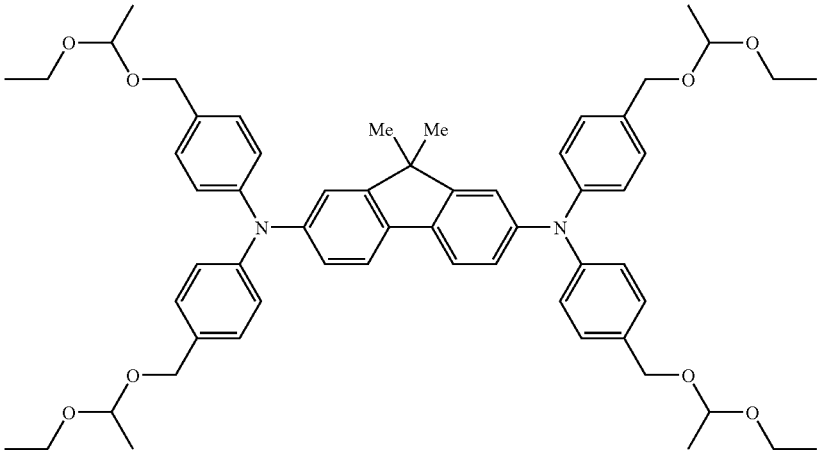

-continued
III-17
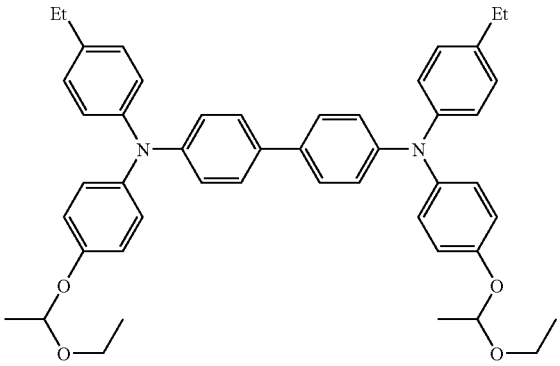
III-18
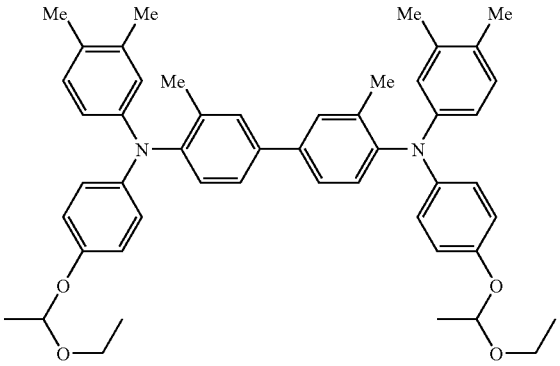
III-19
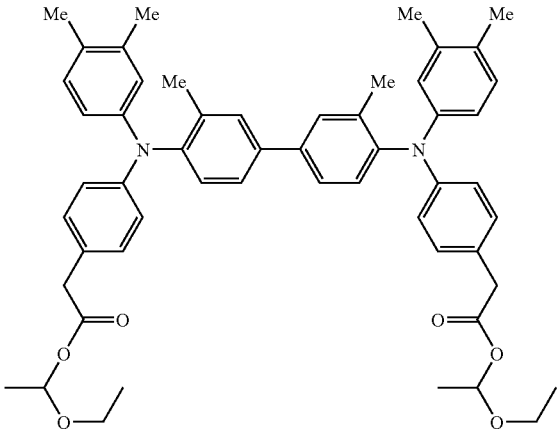
III-20
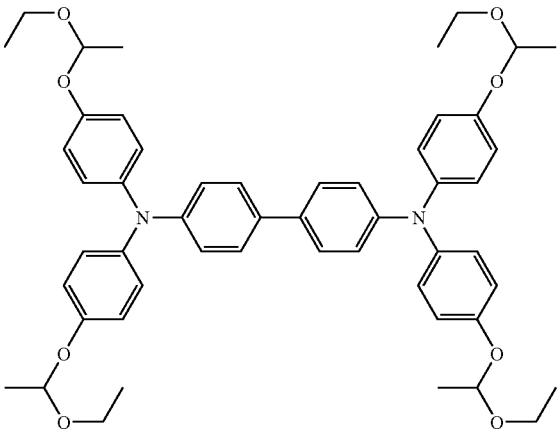
III-21
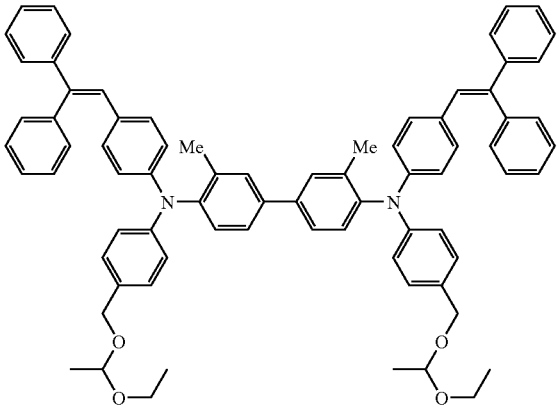
III-22
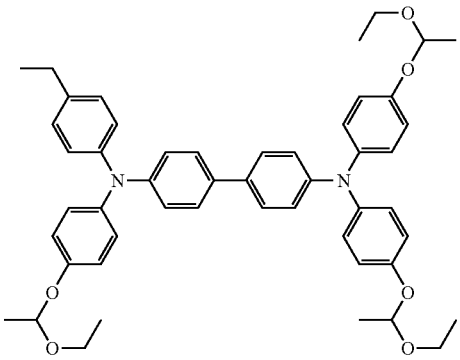

-continued
III-23
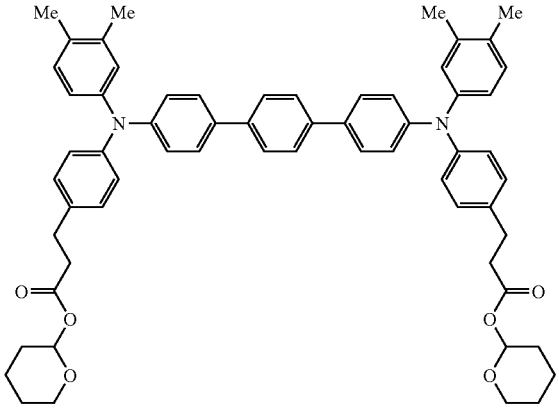
III-24
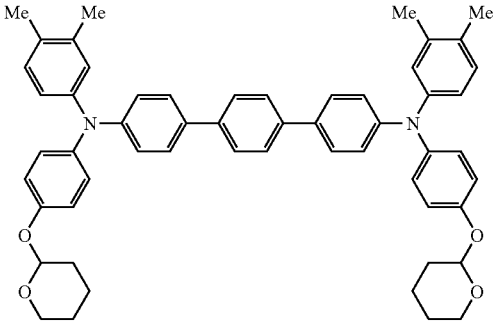
III-25
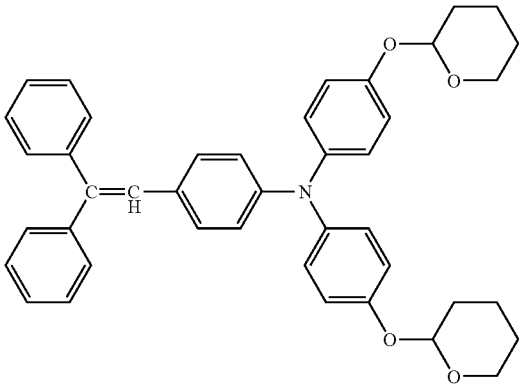
III-26
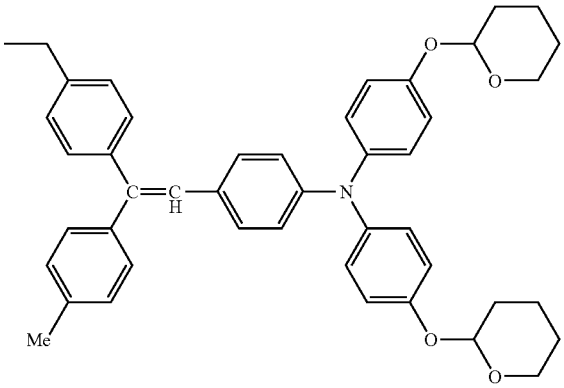
III-27
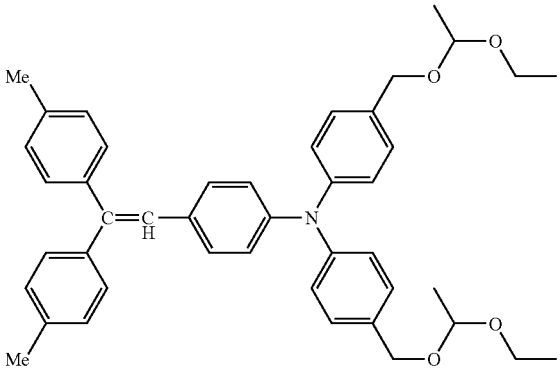
III-28
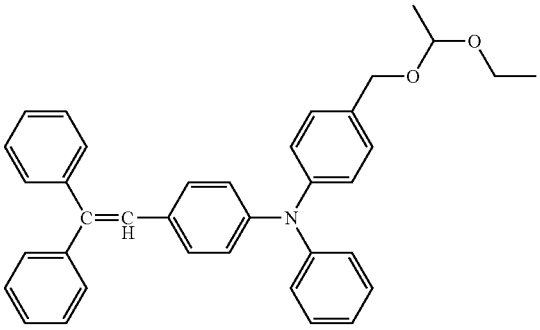

-continued
III-29
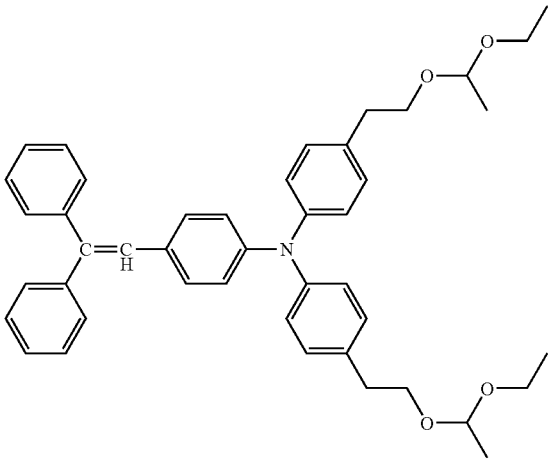
III-30
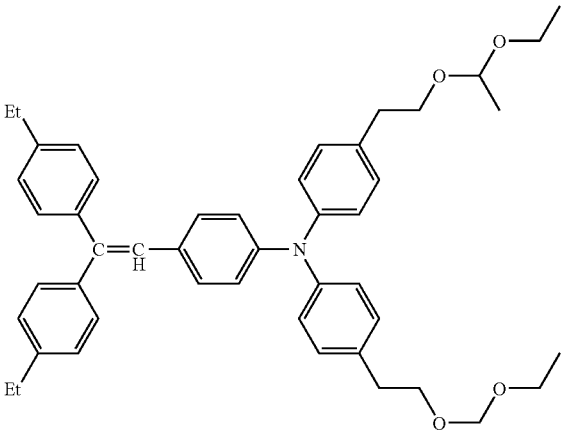
III-31
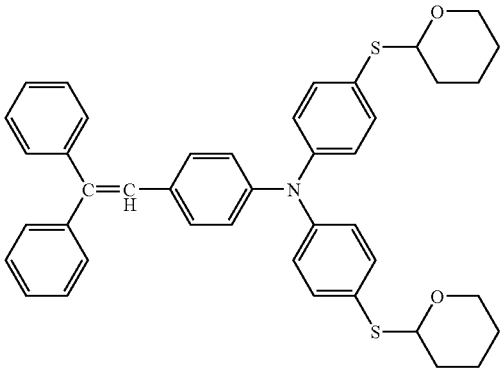
III-32
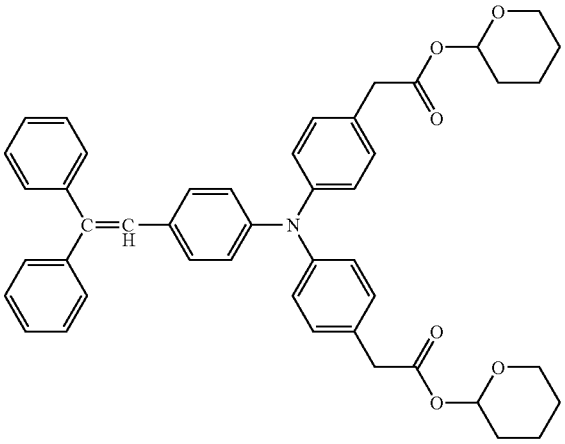
III-33
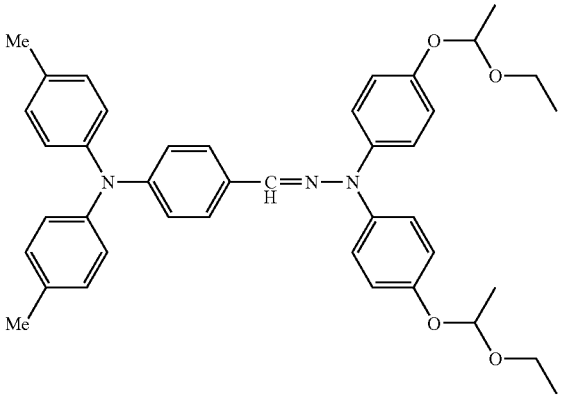
III-34
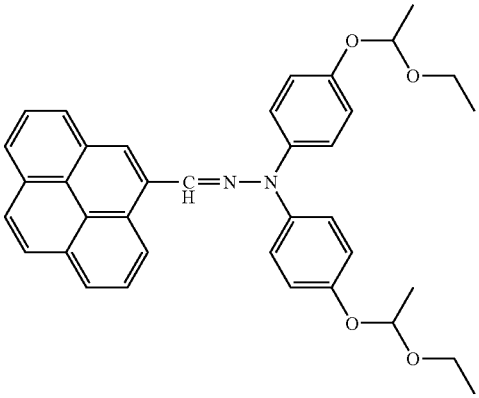

-continued
III-35
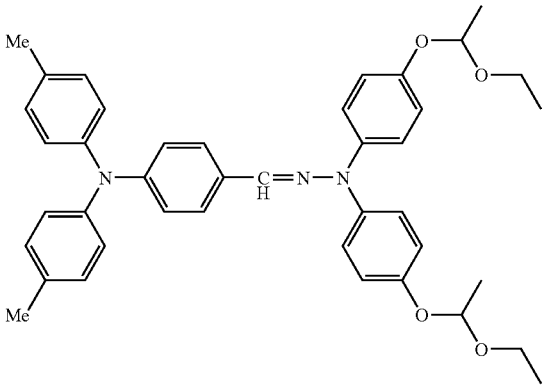
III-36
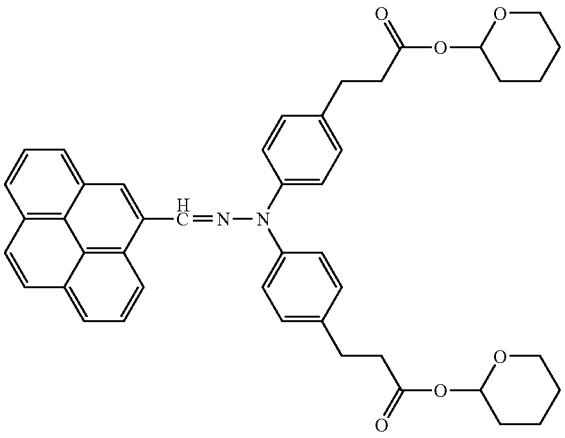
III-37
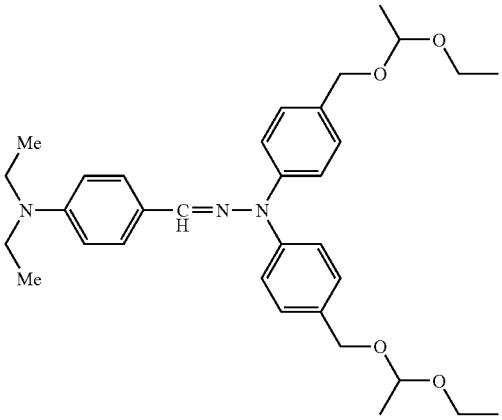
III-38
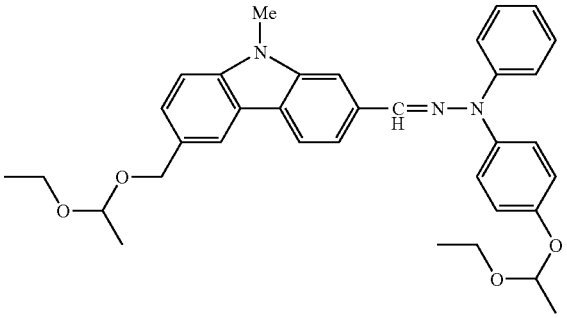
III-39
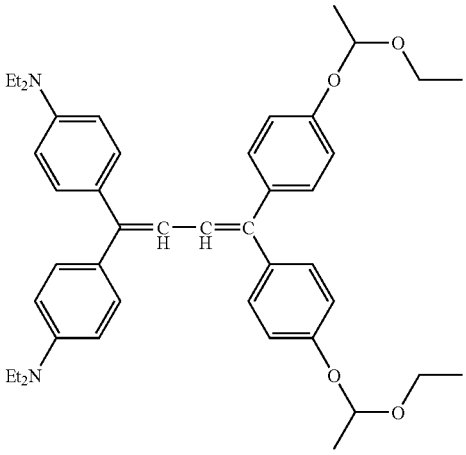
III-40
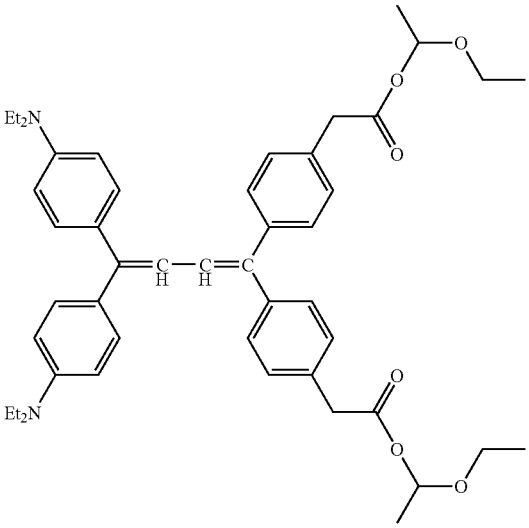

Specific examples of the compound represented by Formula (IV) include the following compounds. In the following compounds, Me or a portion in which a hand to be bonded is shown but a substituent group is not denotes a methyl group.
(IV-1)
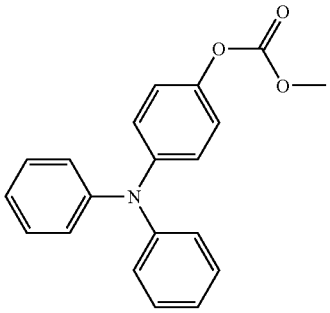
(IV-2)
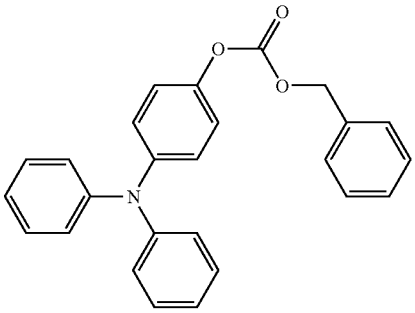
(IV-3)
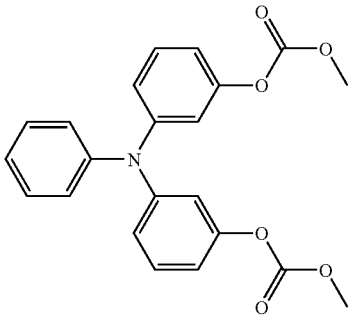
(IV-4)
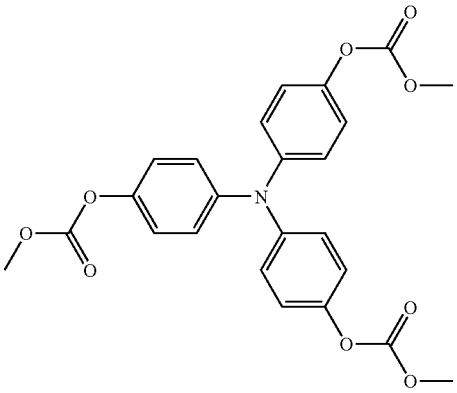
(IV-5)
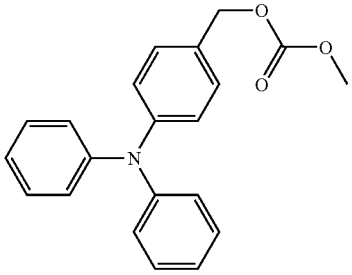
(IV-6)
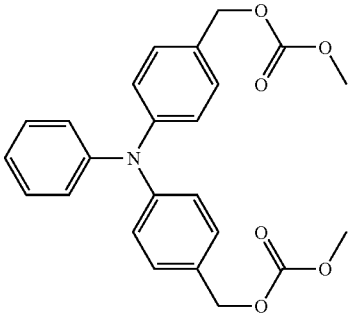
(IV-7)
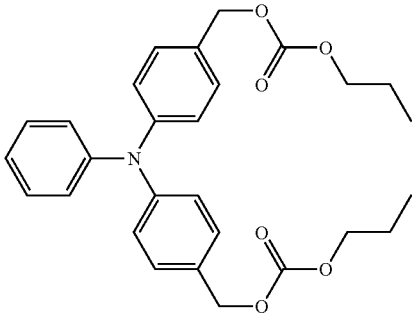
(IV-8)
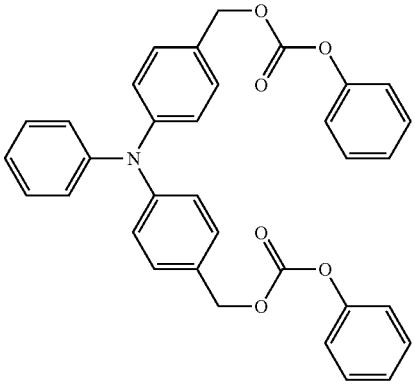

-continued
(IV-9)
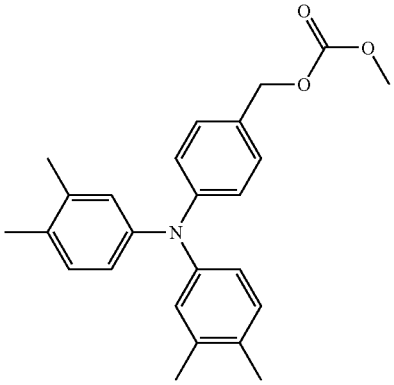
(IV-10)
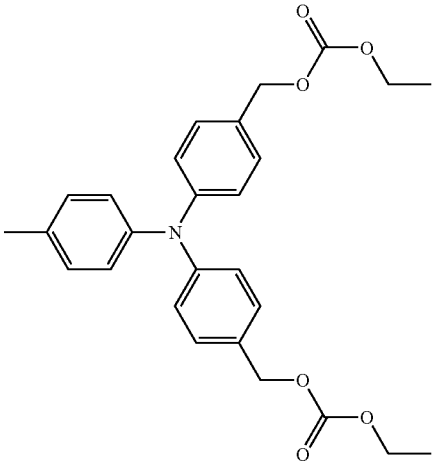
(IV-11)
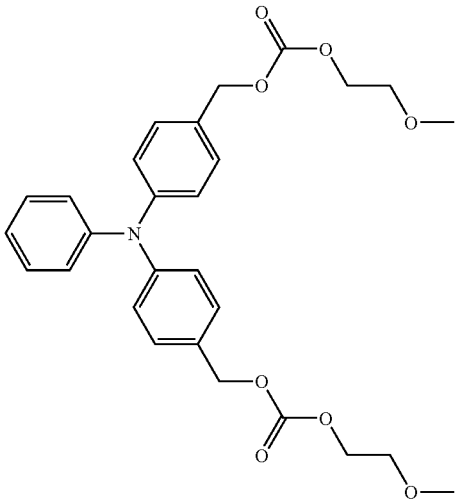
(IV-12)
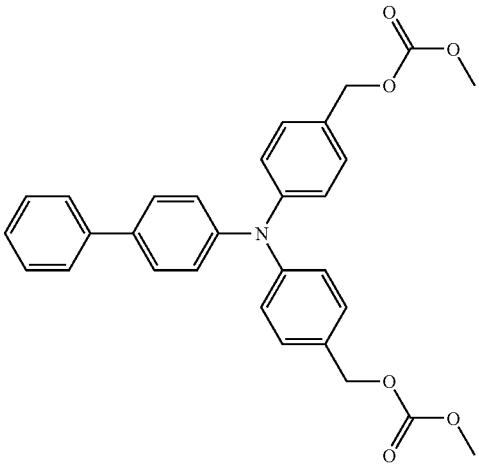
(IV-13)
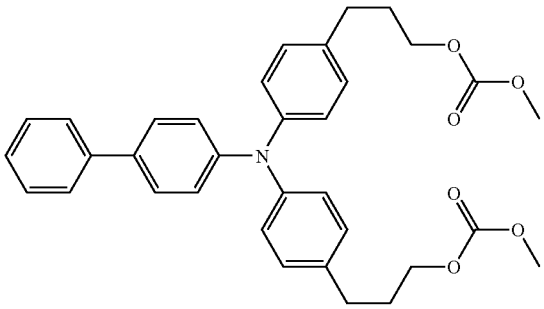
(IV-14)
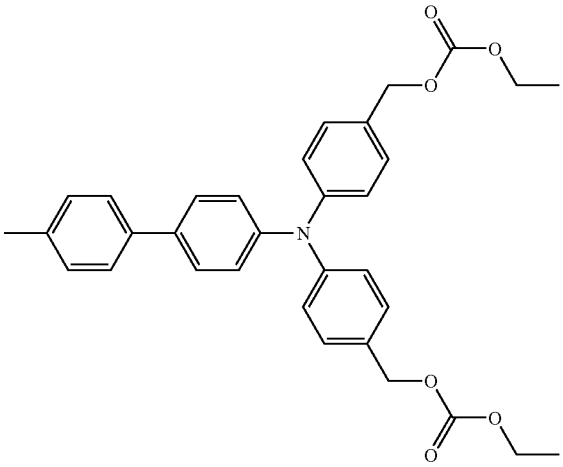

-continued
(IV-15)
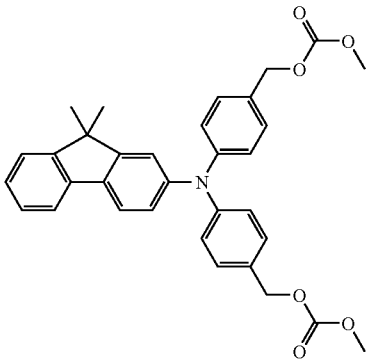
(IV-16)
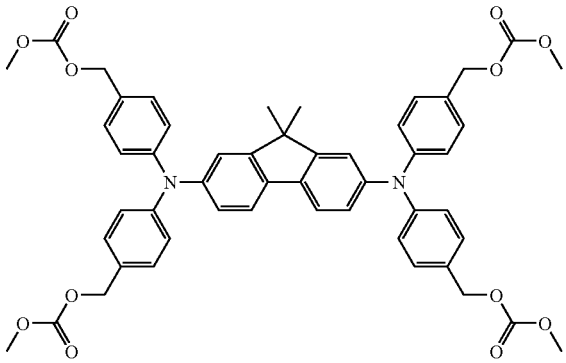
(IV-17)
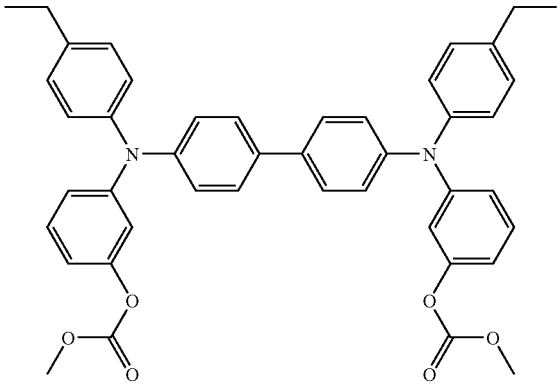
(IV-18)
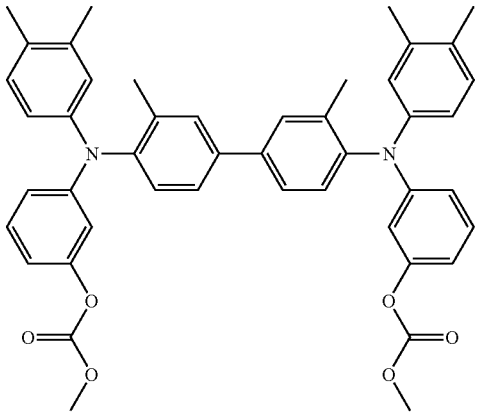
(IV-19)
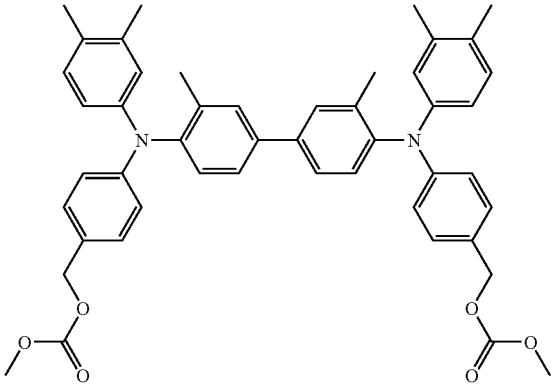
(IV-20)
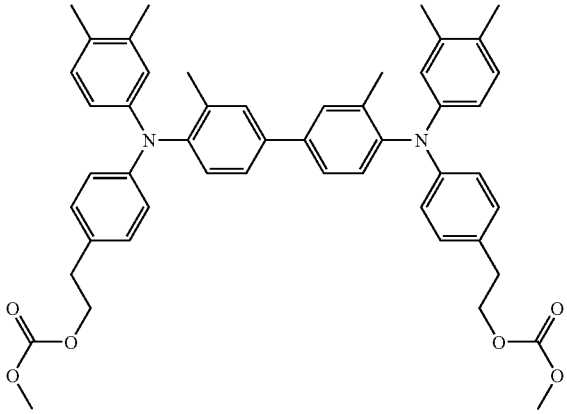

-continued
(IV-21)
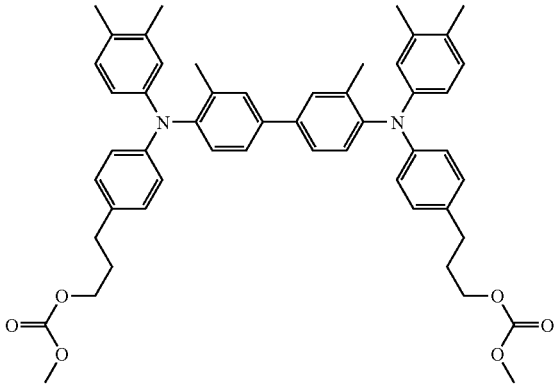
(IV-22)
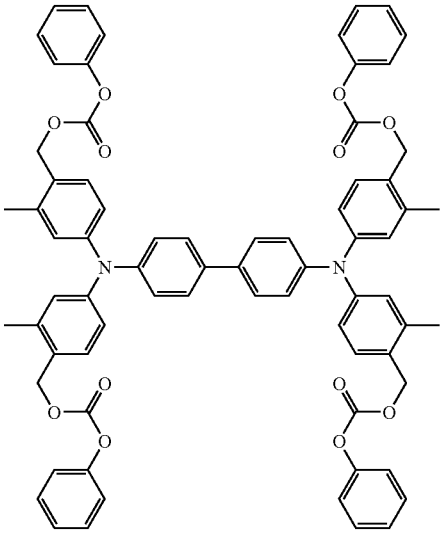
(IV-23)
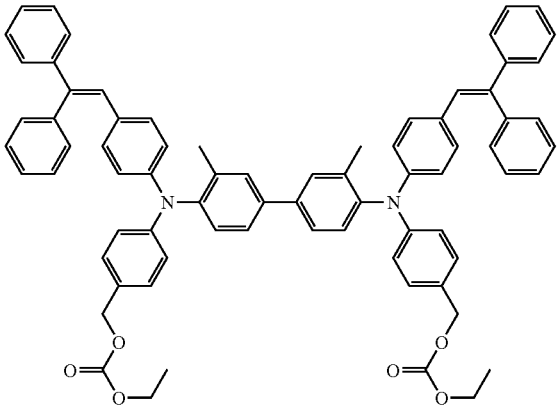
(IV-24)
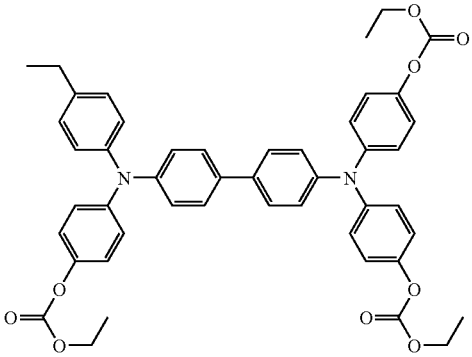
(IV-25)
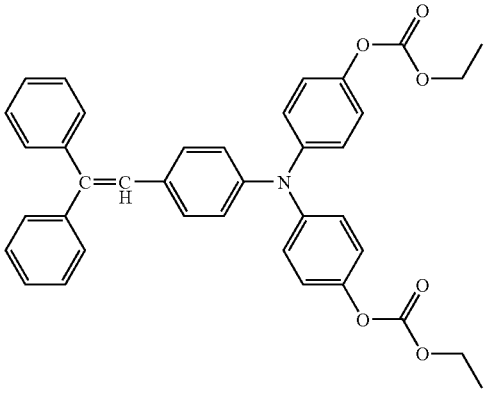
(IV-26)
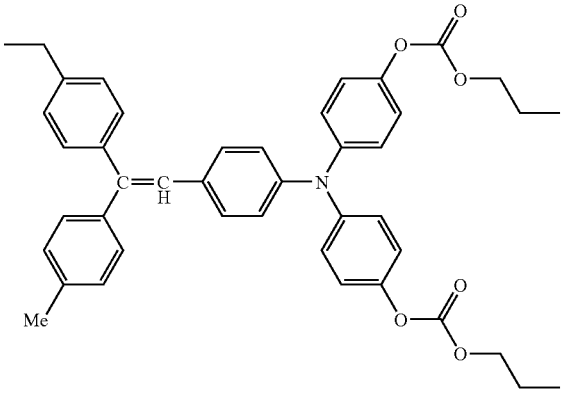

-continued
(IV-27)
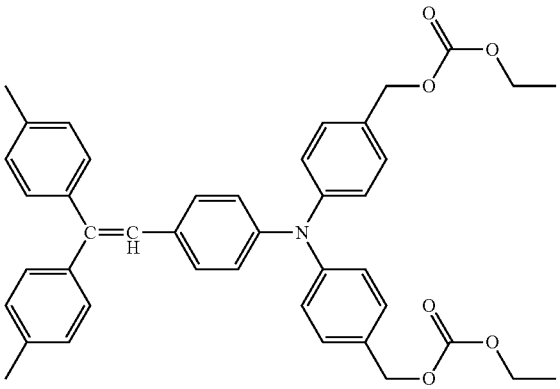
(IV-28)
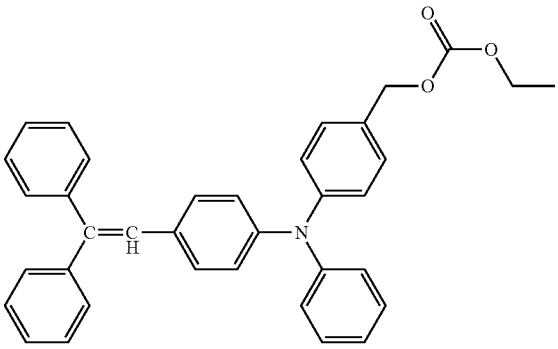
(IV-29)
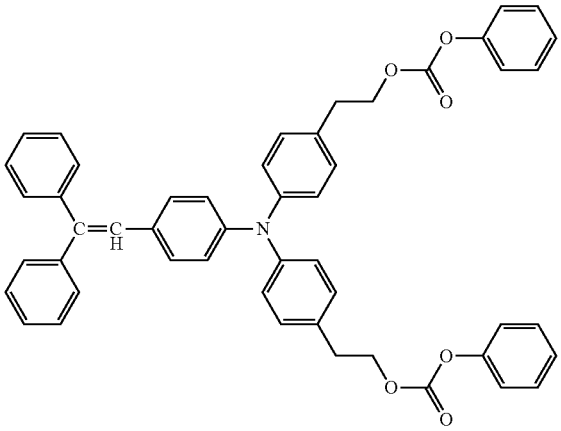
(IV-30)
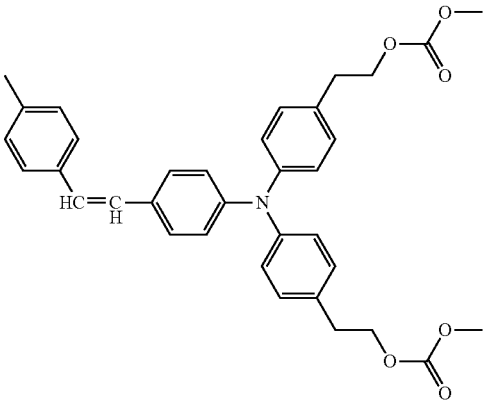
(IV-31)
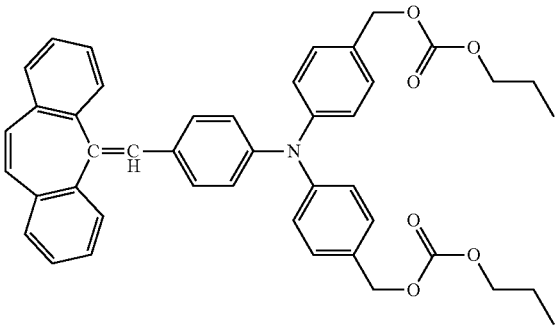
(IV-32)
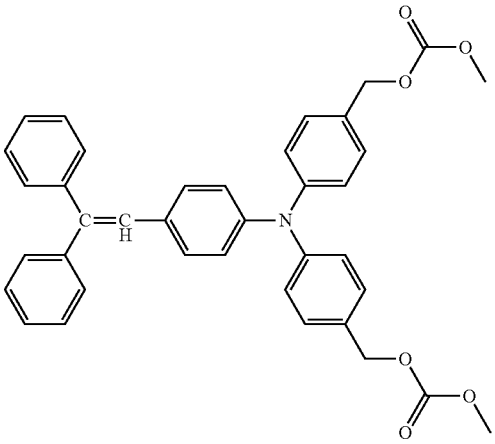
(IV-33)
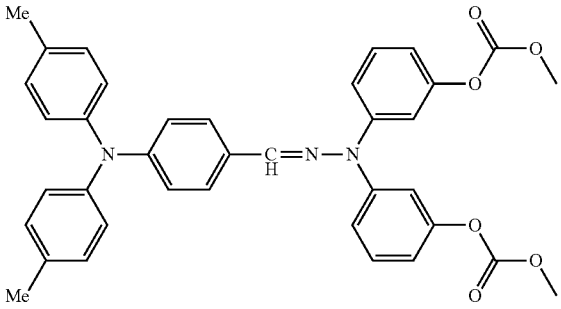
(IV-34)
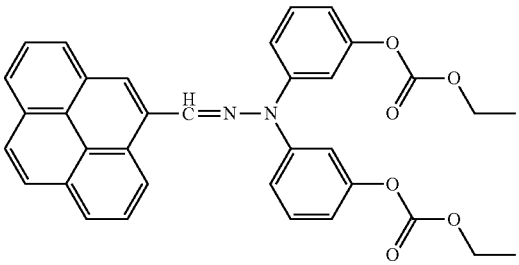

-continued
(IV-35)
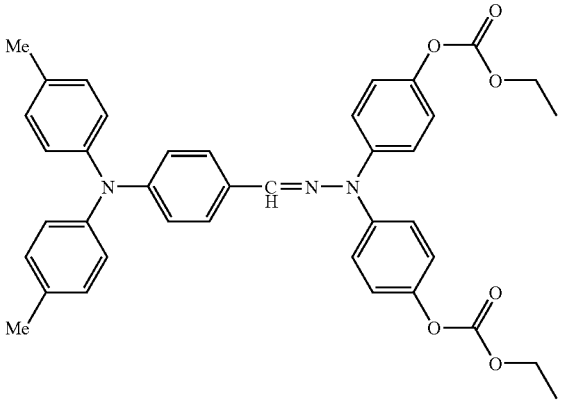
(IV-36)
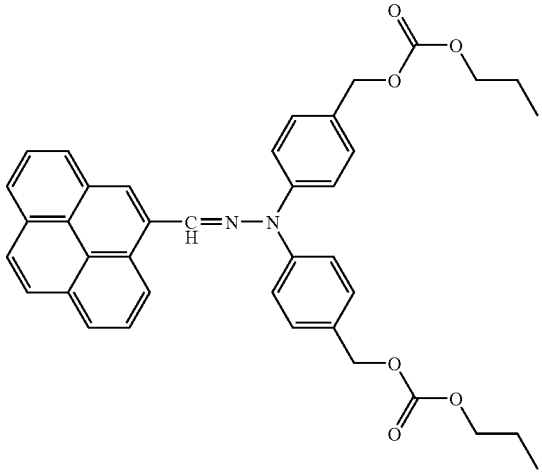
(IV-37)
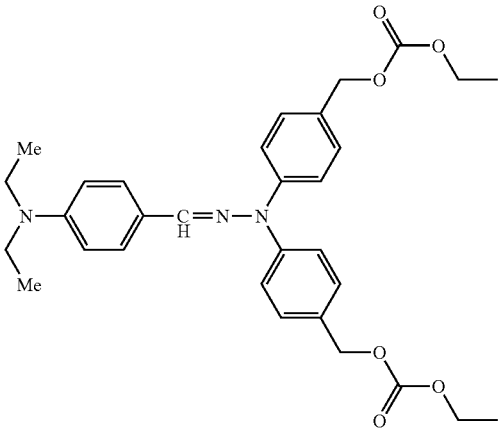
(IV-38)
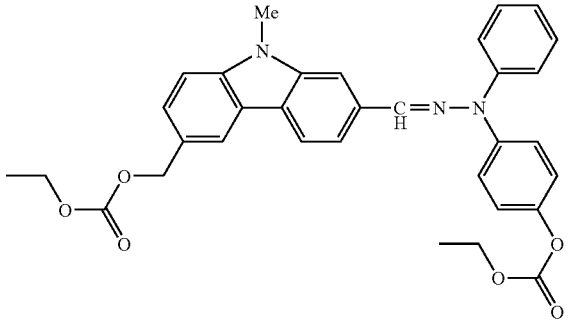
(IV-39)
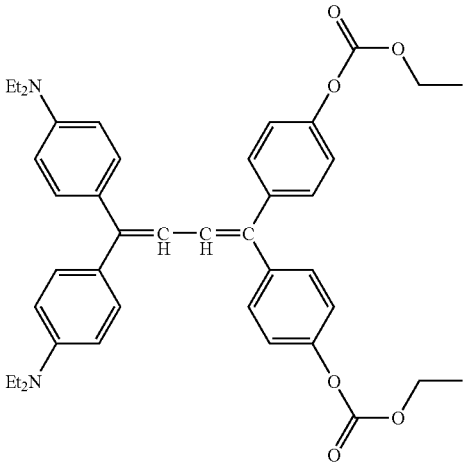
(IV-40)
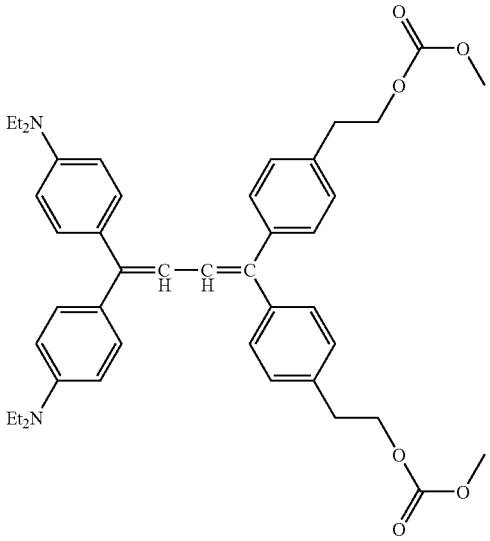

-continued
(IV-41)
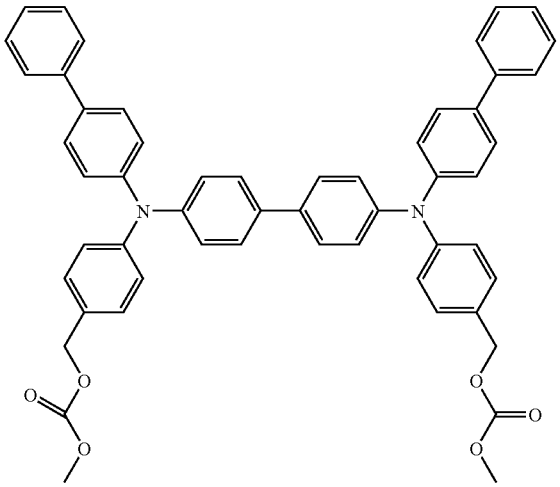
(IV-42)
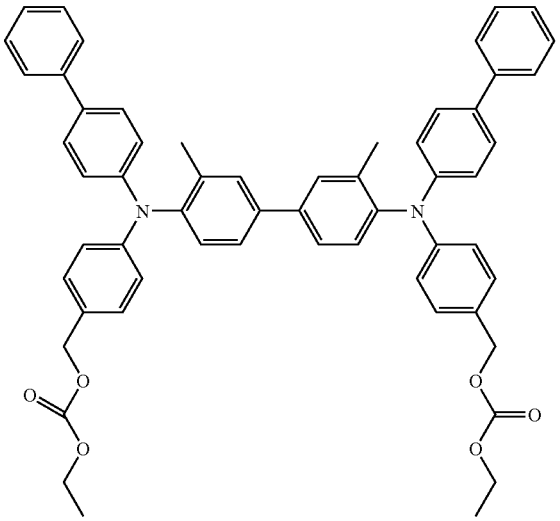
(IV-43)
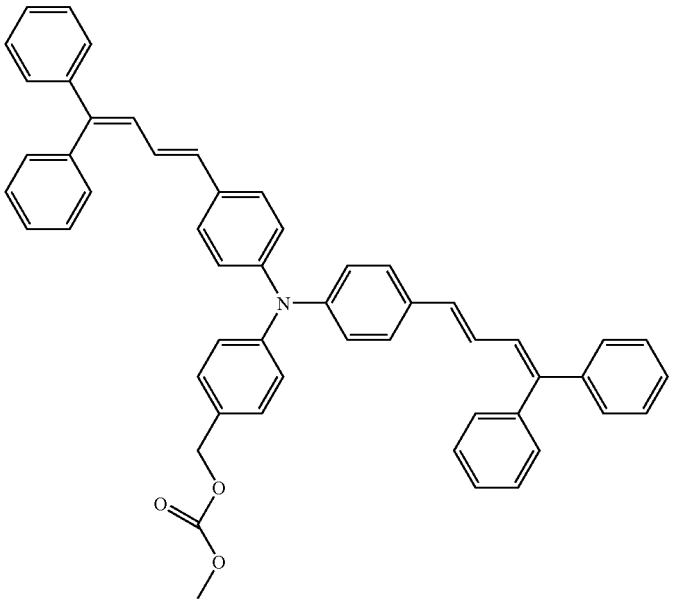

-continued
(IV-44)
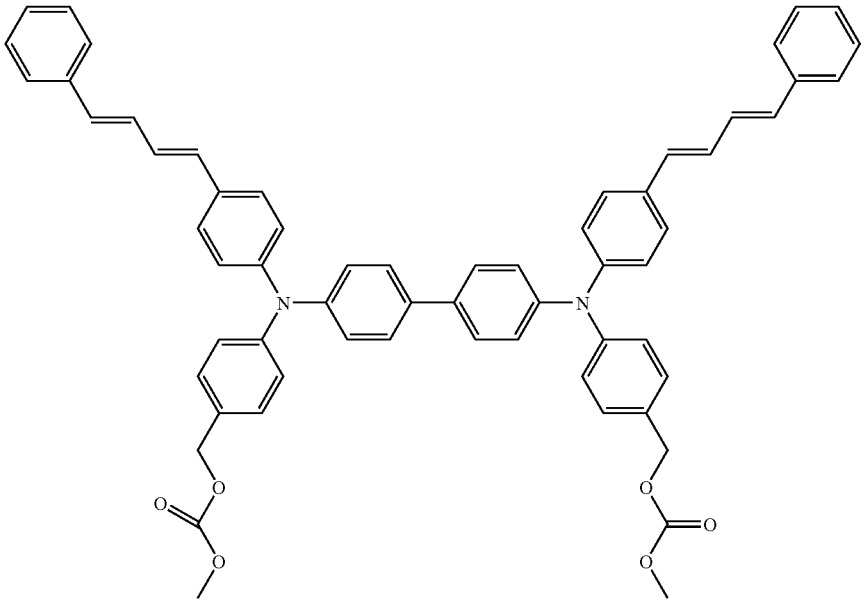
(IV-45)
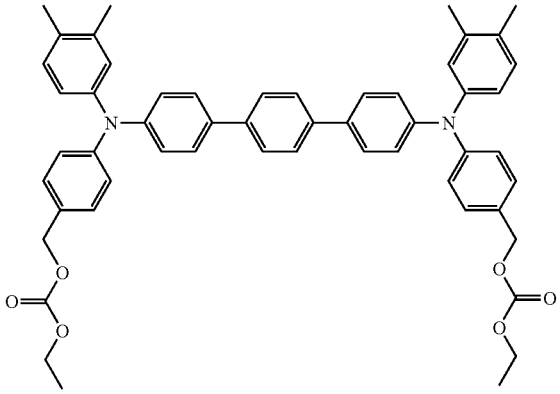
(IV-46)
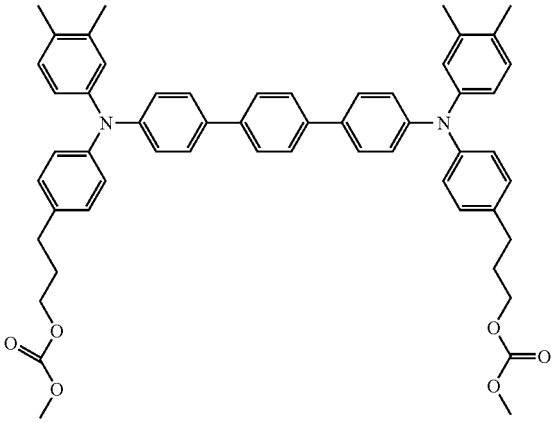
(IV-47)
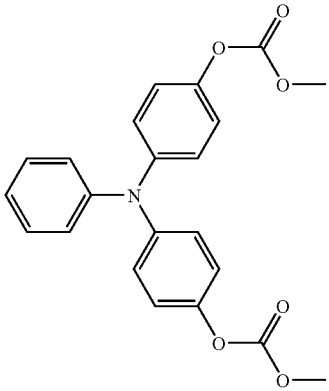
(IV-48)
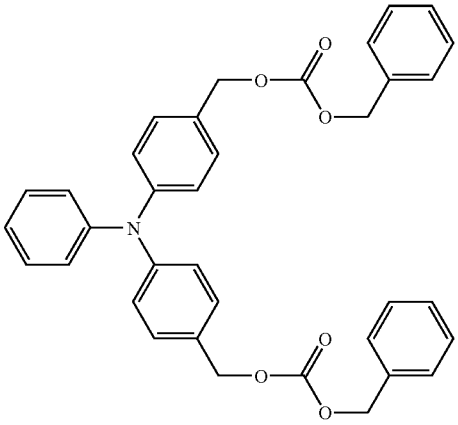

-continued
(IV-49)
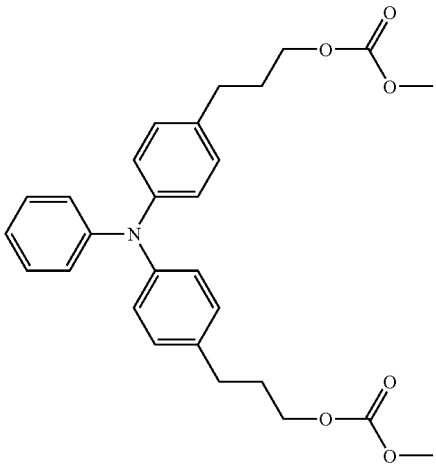
(IV-50)
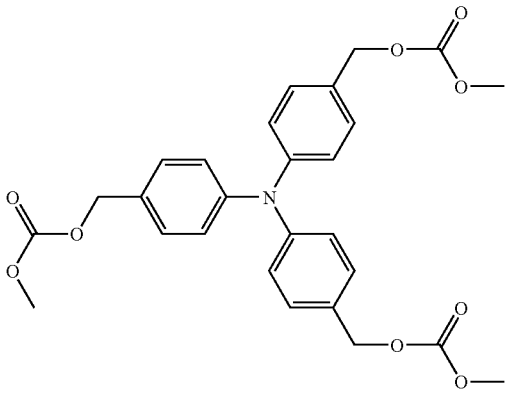
(IV-51)
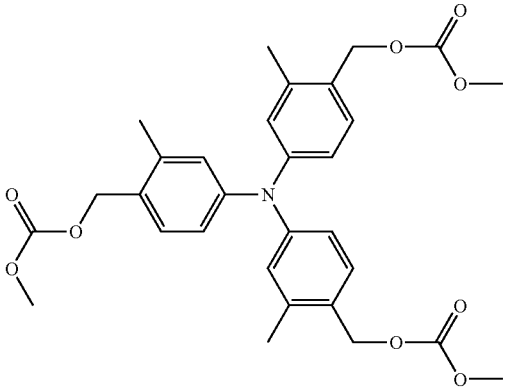
(IV-52)
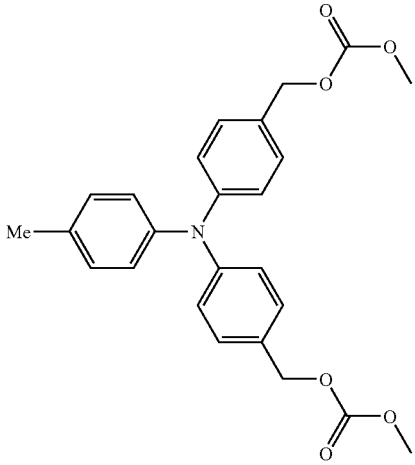
(IV-53)
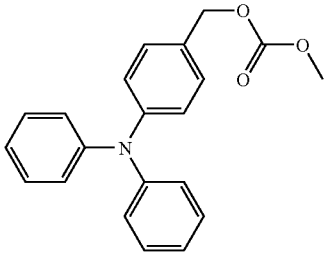
(IV-54)
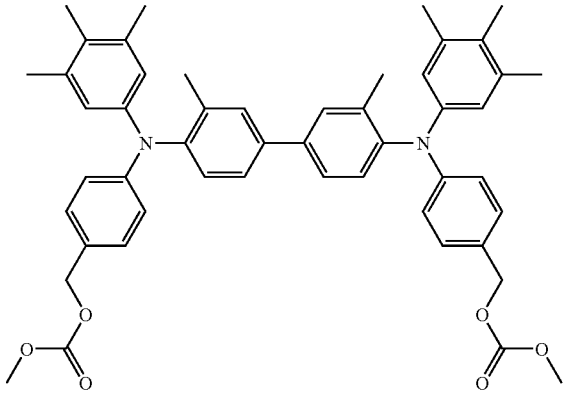

-continued
(IV-55)
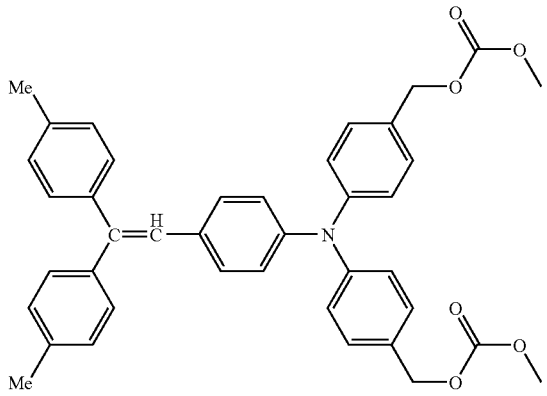
(IV-56)
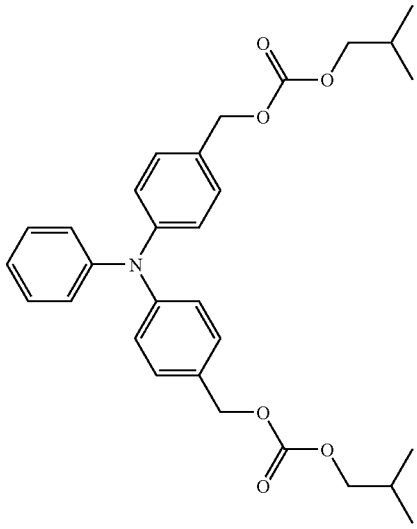
Specific examples of the compound represented by Formula (V) include the following compounds. In the following compounds, Me or a portion in which a hand to be bonded is shown but a substituent group is not denotes a methyl group, and Et denotes an ethyl group.
V-1
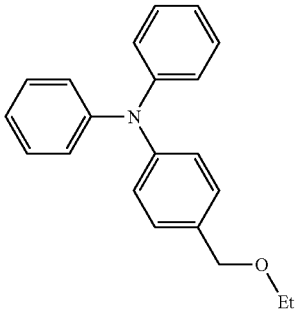
V-2
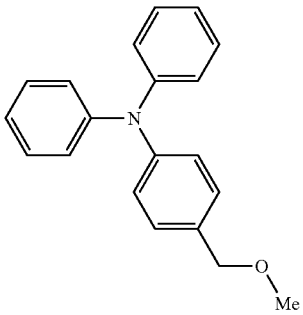
-continued
V-3
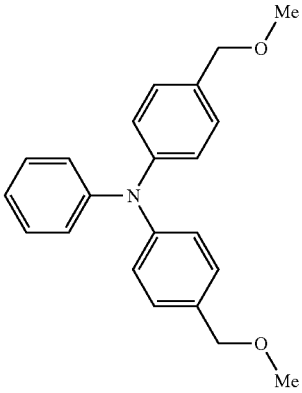
V-4
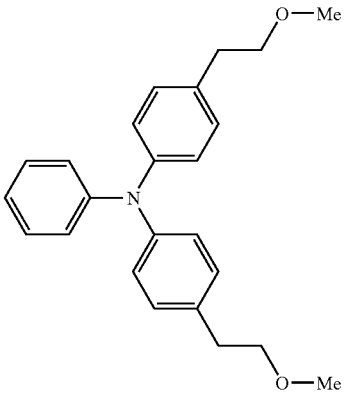

-continued
V-5
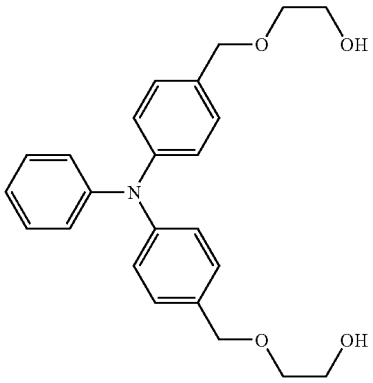
V-6
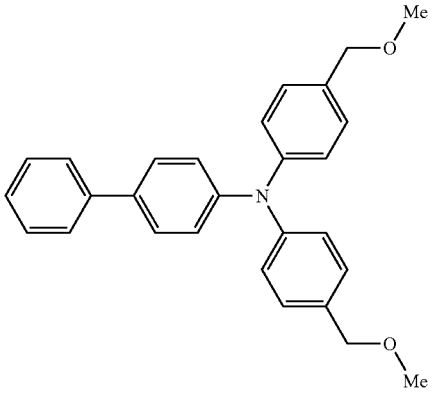
V-7
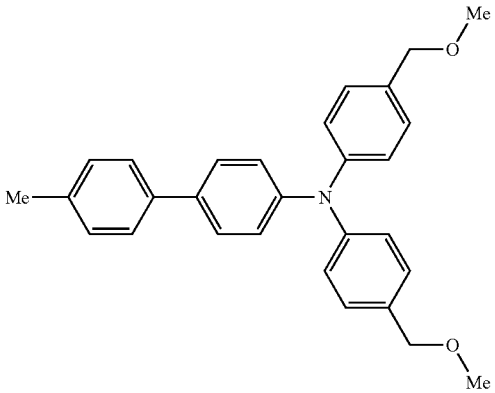
V-8
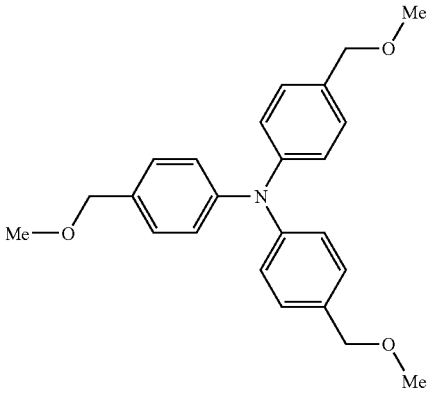
-continued
V-9
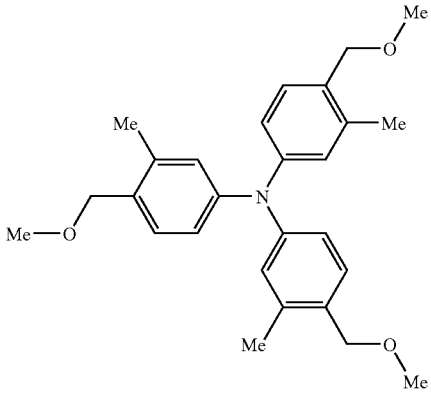
V-10
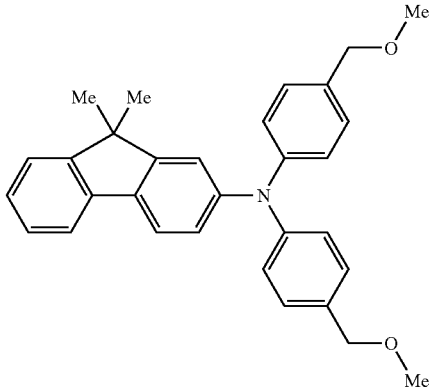
V-11
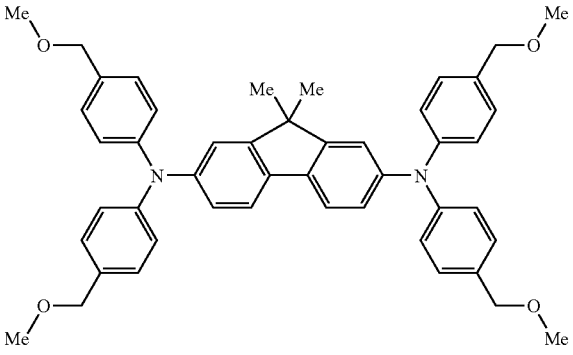
V-12
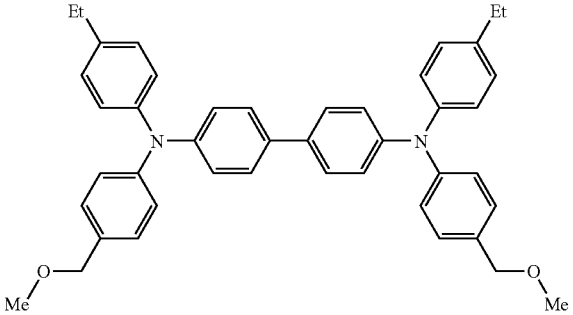

-continued

V-13

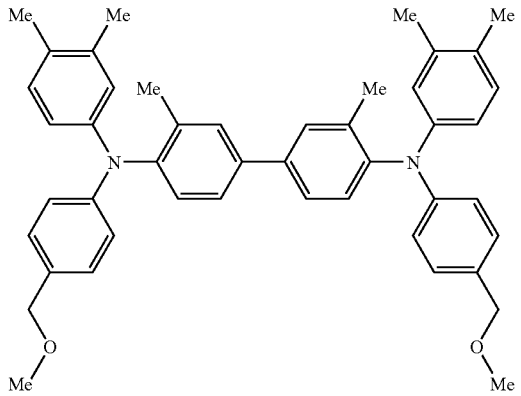

V-14

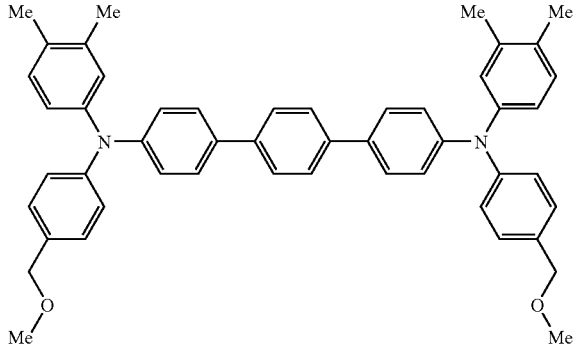

V-15

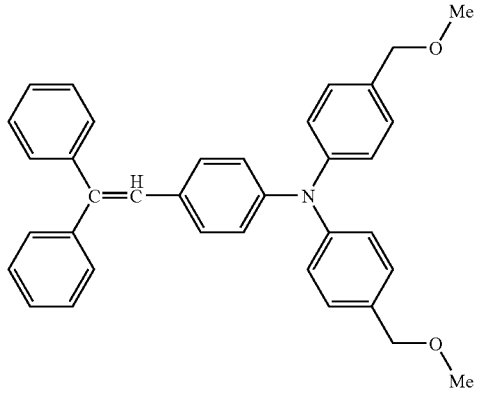

V-16

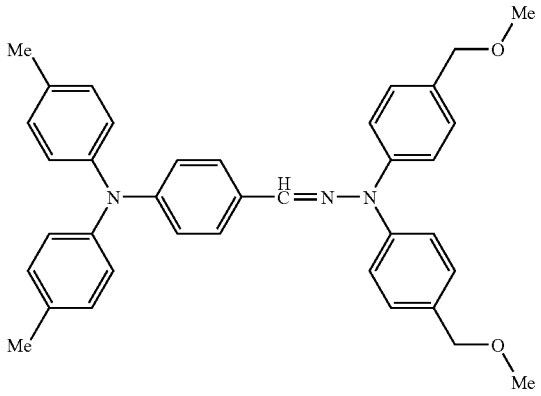

-continued

V-17

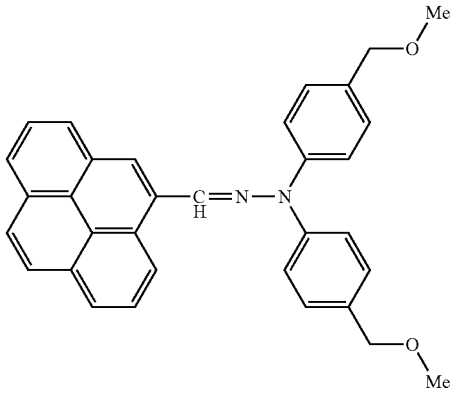

The charge-transporting material may be contained in any one of the first coating liquid and the second coating liquid or in both of the coating liquids.

Furthermore, in order to adjust the layer forming property, elasticity, lubricating property, and adhesion property of the layer, a coupling agent and a fluorine compound may be added to the protective layer. Examples of the compounds may include various types of silane coupling agents and commercially available silicon-based hard coat agents.

Examples of the silane coupling agent may include vinyltrichlorosilane, vinyltrimethoxysilane, vinyltriethoxysilane, γ-glycidoxypropylmethyldiethoxysilane, γ-glycidoxypropyltrimethoxysilane, γ-glycidoxypropyltrimethoxysilane, γ-aminopropyltriethoxysilane, γ-aminopropyltrimethoxysilane, γ-aminopropylmethyldimethoxysilane, N-β(aminoethyl)γ-aminopropyltriethoxysilane, tetramethoxysilane, methyltrimethoxysilane, and dimethyldimethoxysilane.

Examples of the commercial hard coat agent may include KP-85, X-40-9740, and X-40-2239 (manufactured by Shin-Etsu Chemical Co., Ltd.), and AY42-440, AY42-441, and AY49-208 (manufactured by Dow Corning Toray Co., Ltd.).

Additionally, in order to providing water repellent property, a fluorine-containing compound such as (tridecafluoro-1,1,2,2-tetrahydrooctyl)triethoxysilane, (3,3,3-trifluoropropyl)trimethoxysilane, 3-(heptafluoroisopropoxy) propyltriethoxysilane, 1H,1H,2H,2H-perfluoroalkyltriethoxysilane, 1H,1H,2H,2H-perfluorodecyltriethoxysilane, and 1H,1H,2H,2H-perfluorooctyltriethoxysilane may be added.

The silane coupling agent may be used in any amount. In views of the layer forming property of the crosslinking layer, it is preferable that the amount of the fluorine-containing compound be 0.25 times or less by weight relative to compounds which does not contain fluorine.

Furthermore, a resin that is dissolved in alcohol may be added to the protective layer 5 from the viewpoints of resistance to discharging gas, mechanical strength, damage resistance, particle dispersibility, and controlling viscosity, reducing torque, controlling an abrasion amount, and increasing a pot life.

Examples of the resin which is dissolved in the alcohol-based solvent may include a polyvinyl butyral resin, a polyvinyl formal resin, a polyvinyl acetal resin such as a partially acetalized polyvinyl acetal resin in which a portion of butyral is modified with formal or acetacetal (for example, S-LEC B or K manufactured by Sekisui Chemical Co., Ltd.), a polyamide resin, a cellulose resin, and a polyvinylphenol resin.

Particularly, in views of electric properties, it is preferable to use the polyvinyl acetal resin and a polyvinyl phenol resin.

In views of the solubility and the effect due to addition of the resin, the average molecular weight of the resin which is dissolved in the alcohol-based solvent is preferably 2,000 to 100,000 and more preferably 5,000 to 50,000.

Furthermore, the addition amount of the resin is set to preferably 1 to 40% by weight, more preferably 1 to 30% by weight, and even more preferably 5 to 20% by weight in order to prevent image blurring from occurring in a high temperature and high humidity environment and to ensure the effect due to the addition of the resin.

The conductive particles may be added to the protective layer 5 in order to reduce the residual electric potential. Examples of the conductive particles may include metal, metal oxides, and carbon black. It is more preferable to use the metal or the metal oxides.

Examples of the metal may include aluminum, zinc, copper, chrome, nickel, silver, stainless steel, and plastic particles, surfaces of which are vapor-deposited therewith. Examples of the metal oxides may include zinc oxides, titanium oxides, tin oxides, antimony oxides, indium oxides, bismuth oxides, tin-doped indium oxides, antimony or tantalum-doped tin oxides, and antimony-doped zirconium oxides.

They may be used alone or as a combination of two or more thereof. If two or more thereof are used together, they may be mixed with each other or may be used in a solid solution or fusion form.

In views of transparency of the protective layer, the average particle size of the conductive particles may be 0.3 μm or less and preferably 0.1 μm or less.

It is preferable that the protective layer 5 further include an antioxidant in order to prevent deterioration due to oxidizing as such as ozone generated in a charging device. If mechanical strength of the surface of the photoreceptor is improved to increase a life span of the photoreceptor, since the photoreceptor comes into contact with the oxidizing gas over a long period of time, high resistance to oxidation is required.

Examples of the antioxidant include hindered phenols and hindered amines. Furthermore, known antioxidants such as organic sulfur antioxidants, phosphite antioxidants, dithiocarbamate antioxidants, thiourea antioxidants, and benzimidazole antioxidants may be used.

The addition amount of the antioxidant is preferably 20% by weight or less and more preferably 10% by weight or less. Examples of the hindered phenol antioxidants may include 2,6-di-t-butyl-4-methylphenol, 2,5-di-t-butylhydroquinone, N,N'-hexamethylene bis(3,5-di-t-butyl-4-hydroxyhydrocinnamide, 3,5-di-t-butyl-4-hydroxy-benzylphosphonate-diethyl ester, 2,4-bis[(octylthio)methyl]-o-cresol, 2,6-di-t-butyl-4-ethylphenol, 2,2'-methylene bis(4-methyl-6-t-butylphenol), 2,2'-methylene bis(4-ethyl-6-t-butylphenol), 4,4'-butylidene bis(3-methyl-6-t-butylphenol), 2,5-di-t-amylhydroquinone, 2-t-butyl-6-(3-butyl-2-hydroxy-5-methylbenzyl)-4-methylphenylacrylate, and 4,4'-butylidene bis (3-methyl-6-t-butylphenol).

Various types of particles may be added to the protective layer 5 in order to improve the contaminant adhesion resistance of the surface of the electrophotographic photoreceptor and the lubricating property. Examples of the particles may include silicon-containing particles. The silicon-containing particles are particles that contain silicon as a constituent element. Specifically examples of the silicon-containing particles may include colloidal silica and silicone particles.

The colloidal silica, which is used as the silicon-containing particles, may be selected from colloidal silica in which silica particles having an average particle size of 1 to 100 nm and preferably 10 to 30 nm are dispersed in an acidic or basic aqueous dispersion liquid or an organic solvent such as alcohol, ketone, and ester. Alternatively, commercially available colloidal silica may be used.

The content of solids of the colloidal silica in the protective layer 5 is not limited. However, in views of the layer forming property, the electric properties, and the strength, the content may be 0.1 to 50% by weight and preferably 0.1 to 30% by weight based on the total solid content of the protective layer 5.

The silicone particles, which are used as the silicon-containing particles, may be selected from silicone resin particles, silicone rubber particles, and silicone-surface-treated silica particles. Alternatively, commercially available silica particles may be used. These silicone particles have a spherical shape and an average particle size of preferably 1 to 500 nm and more preferably 10 to 100 nm.

The silicon particles are chemically inactive and have excellent dispersibility in the resin and a small diameter. Furthermore, since the content of silicone particles that is required to ensure desirable properties is low, the surface properties of the electrophotographic photoreceptor may be improved without suppressing the crosslinking reaction. That is, while the particles are uniformly incorporated in a hard crosslinking structure, the lubricating property and the water repellency of the surface of the electrophotographic photoreceptor may be improved and thus, desirable wear resistance and contaminant adhesion resistance may be maintained over a long period of time.

The content of the silicon particles of the protective layer 5 is preferably 0.1 to 30% by weight and more preferably 0.5 to 10% by weight based on the total solid content of the protective layer 5.

Examples of other particles may include fluorine particles such as ethylene tetrafluoride, ethylene trifluoride, propylene hexafluoride, vinyl fluoride, and fluorovinylidene, particles that are made of a copolymer resin of a fluorine resin and a monomer having a hydroxyl group, which are disclosed on page 89 of the 8th polymer material forum lecture preview collection, and semi-conductive metal oxides such as ZnO—$Al_2O_3$, $SnO_2$—$Sb_2O_3$, $In_2O_3$—$SnO_2$, $ZnO_2$—$TiO_2$, ZnO—$TiO_2$, MgO—$Al_2O_3$, FeO—$TiO_2$, $TiO_2$, $SnO_2$, $In_2O_3$, ZnO, and MgO.

Furthermore, oil such as silicone oil may be added in order to obtain the above-mentioned object. Examples of silicone oil may include silicone oil such as dimethylpolysiloxane, diphenylpolysiloxane, and phenylmethylsiloxane; reactive silicone oil such as amino-modified polysiloxane, epoxy-modified polysiloxane, carboxyl-modified polysiloxane, carbinol-modified polysiloxane, methacryl-modified polysiloxane, mercapto-modified polysiloxane, and phenol-modified polysiloxane; dimethylcyclosiloxanes such as hexamethylcyclotrisiloxane, octamethylcyclotetrasiloxane, decamethylcyclopentasiloxane, and dodecamethylcyclohexasiloxane; methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane, and 1,3,5,7,9-pentamethyl-1,3,5,7,9-pentaphenylcyclopentasiloxane; phenylcyclosiloxanes such as hexaphenylcyclotrisiloxane; fluorine-containing cyclosiloxanes such as 3-(3,3,3-trifluoropropyl)methylcyclotrisiloxane; hydrosilyl group-containing cyclosiloxanes such as methylhydrosiloxane mixture, pentamethylcyclopentasiloxane, and phenylhydrocyclosiloxane; and vinyl group-containing cyclosiloxanes such as pentavinylpentamethylcyclopentasiloxane.

The protective layer 5 may be formed by coating a coating liquid containing the above-mentioned constituent materials on the charge-transporting layer 4 and drying.

The coating liquid for the protective layer 5 may be prepared without using a solvent, or may be prepared using a solvent such as an alcohol (for example, methanol, ethanol, propanol, butanol and the like), a ketone (for example, acetone, methyl ethyl ketone and the like), or an ether (for example, tetrahydrofuran, diethyl ether, or dioxane), if necessary. The solvents may be used alone or as a mixture of two or more species thereof.

The solvent may have a boiling point of 100° C. or less. The amount of solvent may be arbitrarily set. However, if the amount is excessively small, since the compounds represented by Formulae (I) to (V) are easily precipitated, the amount is preferably 10 to 50% by weight and more preferably 15 to 45% by weight relative the binder resin.

The protective layer 5 may be formed by the above described layer forming method of an exemplary embodiment of the invention. That is, the method in which two coating liquids which react with each other when mixed are separately jetted using an inkjet method and then are mixed with each other on the substrate, may be used. In this connection, the curable resin, and the curing catalyst or the curing agent are separately used in the different coating liquids.

Furthermore, it is preferable that the solvents be the same as each other so as to ensure the desirable mixing.

In order to ensure the desirable mixing of the two coating liquids, it is preferable that a difference in viscosity be small. Specifically, the difference in viscosity is preferably 100 mPa·s or less, more preferably 50 mPa·s or less, and even more preferably 40 mPa·s or less.

The viscosity of the coating liquid containing the curable resin is preferably 1 to 100 mPa·s, more preferably 2 to 50 mPa·s, and even more preferably 3 to 40 mPa·s.

The viscosity of the coating liquid containing the curing catalyst or the curing agent is preferably 1 to 100 mPa·s, more preferably 1.5 to 50 mPa·s, and even more preferably 2 to 40 mPa·s.

The desirable layer thickness may be obtained by, for example, controlling the solid content of the coating liquid, the size of overlapped liquid drops, the number of overlapping, or the like.

If the second coating liquid contains the curing catalyst, it is preferable that a concentration gradient of the curing catalyst occur in a layer thickness direction in the protective layer. In particular, it is preferable to increase a ratio of the second coating liquid to the first coating liquid so that the concentration of the curing catalyst is increased in the photosensitive layer side (i.e. a portion that is far apart from the surface of the protective layer).

When jetting of the liquid drops is controlled so that the concentration of the curing catalyst is reduced in the protective layer as moving away from the photosensitive layer side, the degree of curing is improved in the photosensitive layer side of the protective layer. Thus, a long life span may be ensured.

In addition, if the concentration gradient is continuous, as shown in FIGS. 13A to 13F, a high-quality image may be formed while excellent electrophotographic properties are ensured.

The thickness of the protective layer 5 may be 1 to 10 μm in general and preferably 2 to 8 μm.

Furthermore, the electrophotographic photoreceptor of an exemplary embodiment of the invention is not limited to the above-mentioned exemplary embodiment.

Figure 16:
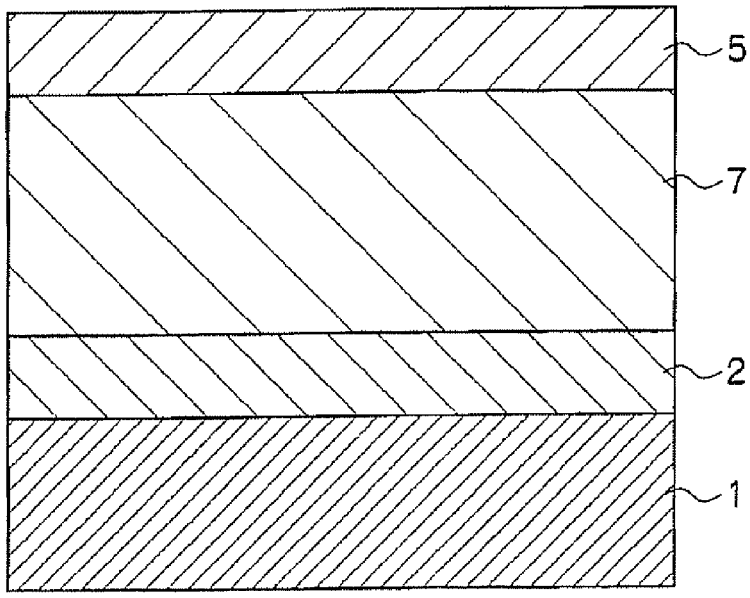
FIG. 16 is a view illustrating a section of an electrophotographic photoreceptor according to another exemplary embodiment of the invention.

For example, in the above-mentioned exemplary embodiment, a function separation type photoreceptor that includes the charge-generating layer 3 and the charge-transporting layer 4 separated from each other is illustrated in FIG. 15. The electrophotographic photoreceptor of an exemplary embodiment of the invention may be a single-layer type photoreceptor that includes a layer (charge-generating/charge-transporting layer) having both the charge-generating material and the charge-transporting material, as shown in FIG. 16. The electrophotographic photoreceptor shown in FIG. 16 includes the undercoat layer 2, the charge-generating/charge-transporting layer 7, and the protective layer 5 which are disposed on the conductive substrate 1 in this order. The charge-generating/charge-transporting, layer 7 is a first functional layer and the protective layer 5 is a second functional layer.

Furthermore, when the charge-generating layer 3, the charge-transporting layer 4, and the protective layer 5 are disposed to form a structure shown in FIG. 15, separation of the functions is ensured. Accordingly, in views of realization of better functions, the electrophotographic photoreceptor of an exemplary embodiment of the invention may be a function-separation type photoreceptor.

<Image-Forming Apparatus and Process Cartridge>

Figure 17:
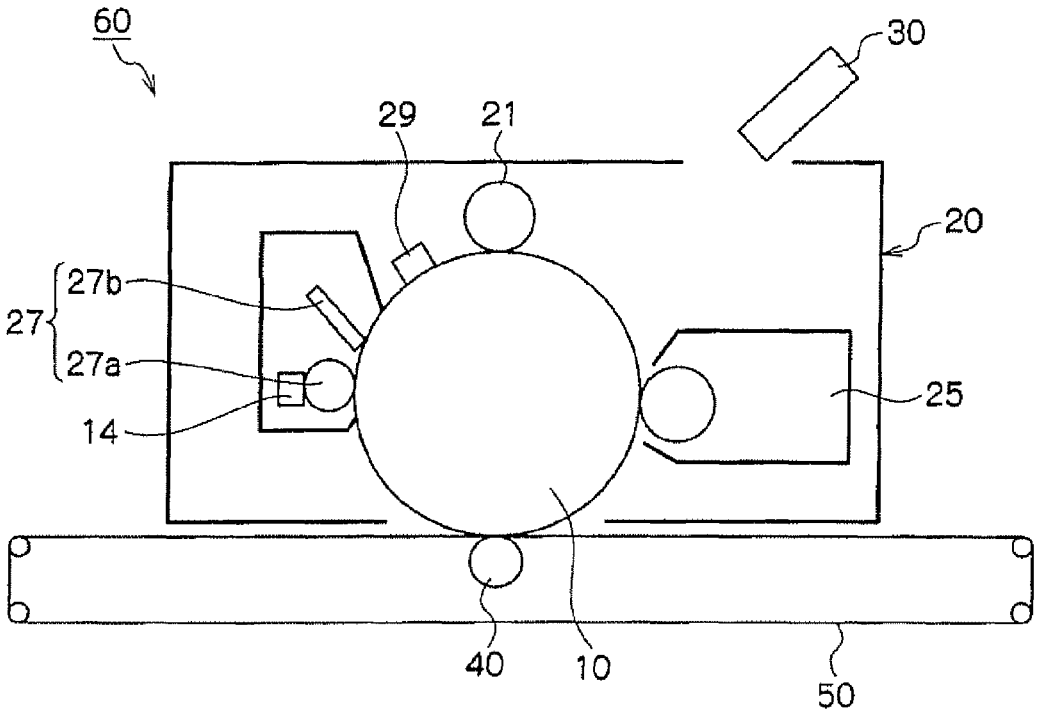
FIG. 17 is a view illustrating an image-forming apparatus according to an exemplary embodiment of the invention.

FIG. 17 is a view illustrating an image-forming apparatus according to an exemplary embodiment of the invention. An image-forming apparatus 60 shown in FIG. 17 is provided with an image-forming apparatus main body (not shown), a process cartridge 20 including the electrophotographic photoreceptor 10 according to the above described exemplary embodiment, an exposing device (latent image forming device) 30, a transfer device 40, and an intermediate transfer medium 50. In the image-forming apparatus 60, the exposing device 30 is provided so as to expose the electrophotographic photoreceptor 10 through an opening of the process cartridge 20. The transfer device 40 is disposed to face the electrophotographic photoreceptor 10 while the intermediate transfer medium 50 is interposed between the transfer device 40 and the electrophotographic photoreceptor 10. The intermediate transfer medium 50 is disposed to come into contact with the electrophotographic photoreceptor 10.

The process cartridge 20 is combined with a charging device 21, a developing device 25, a cleaning device 27, and a fiber-shaped member (flat brush shape) 29 in conjunction with the electrophotographic photoreceptor 10 in a case. The process cartridge may be attached to the image-forming apparatus main body using a rail. Furthermore, the case has an opening for exposure.

The charging device 21 shown in FIG. 17 is a contact type charging device and comes into contact with the electrophotographic photoreceptor 10. However, the charging device 21 may be a non-contact type charging device. The developing device 25 develops the electrostatic latent image on the electrophotographic photoreceptor 10 to form a toner image.

The cleaning device 27 includes a fiber-shaped member (roll shape) 27*a* or a cleaning blade (blade member) 27*b*. The cleaning device 27 shown in FIG. 17 includes the fiber-shaped member 27*a* and the cleaning blade 27*b*. However, the cleaning device may include any one of them. The fiber-shaped member 27*a* may have a brush shape instead of the roll shape. Furthermore, the fiber-shaped member 27*a* may be fixed to the cleaning device main body, rotatably supported, or supported so as to reciprocate in a photoreceptor axis direction.

In the cleaning device 27, it is required that substances (for example, discharged products) attached to the surface of the photoreceptor are removed using a cleaning blade or a cleaning brush. It is preferable that a lubricating substance (lubricating component) 14 such as metal soaps, higher alcohol, wax, and silicone oil come into contact with the fiber-shaped member 27*a* to provide the lubricating component to the surface of the electrophotographic photoreceptor.

A typical rubber blade may be used as the cleaning blade 27*b*.

The above-mentioned process cartridge 20 is removably provided in the image-forming apparatus main body, and constitutes the image-forming apparatus in conjunction with the image-forming apparatus main body.

Any exposing device may be used as the exposing device 30 as long as the charged electrophotographic photoreceptor 10 may be exposed using the exposing device to form the electrostatic latent images. Furthermore, it is preferable that a multibeam type surface emitting laser be used as a light source of the exposing device 30.

Any transfer device 40 may be used as long as the toner image on the photographic photoreceptor 10 may be transferred to the transfer-receiving medium (the intermediate transfer medium 50 is used as the transfer-receiving medium in FIG. 17, but a paper conveying belt (not shown) may be used instead of the intermediate transfer medium 50 and a paper conveyed on the paper conveying belt or a paper for direct transferring without the intermediate transfer medium 50 may be used). For example, the transfer device may be a typical roll-shaped transfer device.

A belt (intermediate transfer belt) which includes polyimide, polyamideimide, polycarbonate, polyarylate, polyester, or rubber as a constituent component and has volume resistivity of $10^2$ to $10^{11}$ Ω·cm may be used as the intermediate transfer medium 50. Furthermore, a drum may be used as the intermediate transfer medium 50 instead of the belt.

In the exemplary embodiment, the transfer-receiving, medium is not limited as long as the toner image formed on the electrophotographic photoreceptor 10 may be transferred on the medium. For example, if the image is directly transferred from the electrophotographic photoreceptor 10 onto paper or the like, the paper or the like is the transfer-receiving medium. If the intermediate transfer medium 50 is used, the intermediate transfer medium is the transfer-receiving medium.

Figure 18:
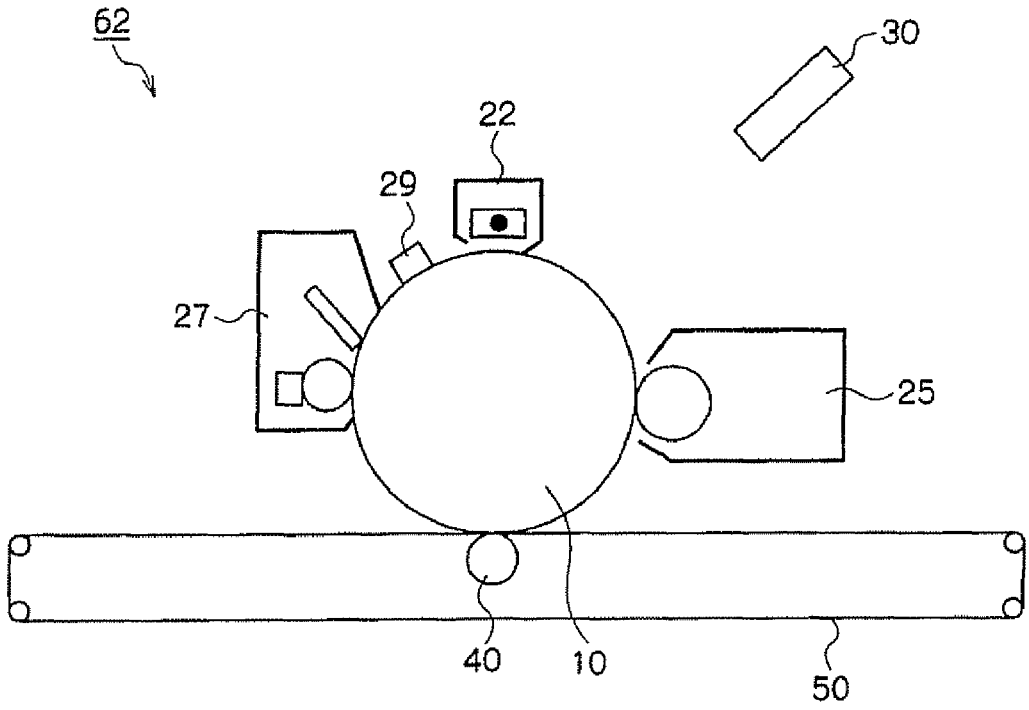
FIG. 18 is a view illustrating an image-forming apparatus according to another exemplary embodiment of the invention.

FIG. 18 is a view illustrating an image-forming apparatus according to another exemplary embodiment of the invention. In the image-forming apparatus 62 shown in FIG. 18, the electrophotographic photoreceptor 10 is fixed to the image-forming apparatus main body. The charging device 22, the developing device 25, and the cleaning device 27 are placed in a cartridge independently and provided as a charging cartridge, a developing cartridge, and a cleaning cartridge respectively. The charging device 22 of FIG. 18 is a charging device that performs charging using a corona discharging method, but a contact type charging device may be used.

In the image-forming apparatus 62, the electrophotographic photoreceptor 10 is separated from other devices. The charging device 22, the developing device 25, and the cleaning device 27 are not fixed to the image-forming apparatus main body, and may be removed from the image-forming apparatus main body by using a predetermined operation, for example, pulling and pushing.

In the electrophotographic photoreceptor of this exemplary embodiment, the charging device 22, the developing device 25 and the cleaning device 27 each are not necessarily placed in a cartridge in some cases. Therefore, when the electrophotographic photoreceptor has a structure in which the charging device 22, the developing device 25, and the cleaning device 27 are not fixed to the main body, and may be removed from the main body by using pulling and pushing, the cost for members per 1 print may be reduced. Two or more of the above devices may be placed in a cartridge which may be removed from the main body.

The image-forming apparatus 62 has the same structure as the image-forming apparatus 60, except that the charging device 22, the developing device 25, and the cleaning device 27 each are placed in a cartridge.

Figure 19:
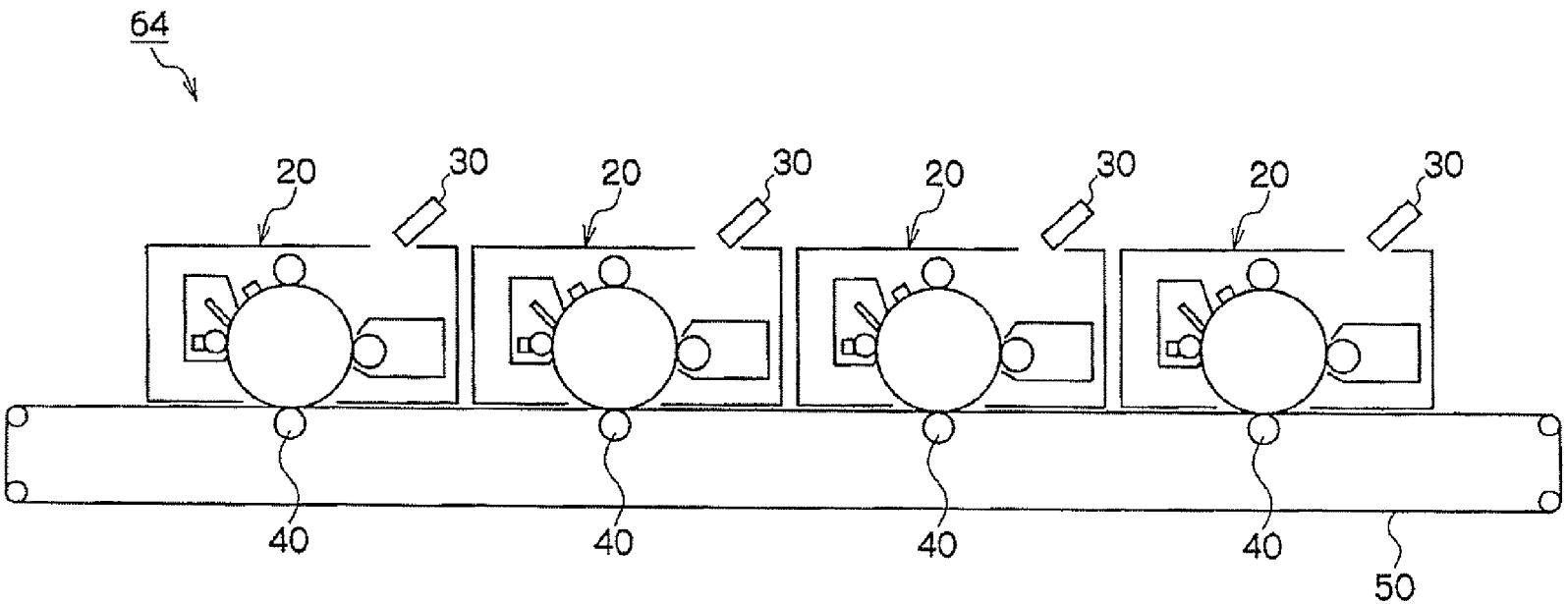
FIG. 19 is a view illustrating an image-forming apparatus according to still another exemplary embodiment of the invention.

FIG. 19 is a view illustrating an image-forming apparatus according to still another exemplary embodiment of the invention. The image-forming apparatus 64 is a tandem type full color image-forming apparatus including four process cartridges 20. In the image-forming apparatus 64, the four process cartridges 20 are disposed on the intermediate transfer medium 50 in parallel and the one electrophotographic photoreceptor is used in respects to one color. The image-forming apparatus 64 has the same structure as the image-forming apparatus 60, except that the image-forming apparatus is the tandem type.

EXAMPLES

The present invention will be explained using Examples, but the invention is not limited the Examples.

Example 1

Conductive Support

First, a cylindrical substrate which is subjected to honing treatment and made of aluminum and has a diameter of 30 mmϕ is prepared as the conductive substrate.

—Undercoat Layer—

Next, 100 parts by weight of a zirconium compound (trade name: ORGATIX ZC540, manufactured by Matsumoto Fine Chemical Co., Ltd.), 10 parts by weight of a silane compound (trade name: A1100, manufactured by Nippon Unicar Co., Ltd.), 400 parts by weight of isopropanol, and 200 parts by weight of butanol are mixed with each other to prepare the coating liquid for forming the undercoat layer. The coating liquid is coated on the external surface of the substrate made of aluminum by using a dip coating method, and heated and dried at 150° C. for 10 min to form the undercoat layer having the thickness of 0.1 μm.

—Charge-Generating Layer—

Next, 10 parts by weight of hydroxygallium phthalocyanine having a strong diffraction peak, in which a Bragg angle (2θ±0.2°) is 7.5°, 9.9°, 12.5°, 16.3°, 18.6°, 25.1°, and 28.3° in an X-ray diffraction spectrum, 10 parts by weight of polyvinylbutyral (trade name: S-LEC BM-S, manufactured by Sekisui Chemical Co., Ltd.), and 1000 parts by weight of n-butyl acetate are mixed with each other, and treated using the paint shaker in conjunction with glass beads for 1 hour to be dispersed, thus preparing the coating liquid for forming the charge-generating layer. The coating liquid thus prepared is coated on the undercoat layer by dip coating and dried at 100° C. for 10 min by heating to form the charge-generating layer having the thickness of about 0.15 μm.

—Charge-Transporting Layer—

Next, 150 parts by weight of the benzidine compound represented by the following Formula CT-1 and 350 parts by weight of bisphenol Z type polycarbonate (manufactured by Mitsubishi Gas Chemical Co., Inc., and the viscosity average molecular weight is 39,000) having a structure unit represented by the following Formula B-1 are dissolved in 500 parts by weight of tetrahydrofuran (THF) to prepare the coating liquid for forming the charge-transporting layer. The coating liquid thus prepared is coated on the charge-generating layer by using the dip coating method and heated at 150° C. for 60 min to form the charge-transporting layer having the thickness of 20 μm.

(CT-1)

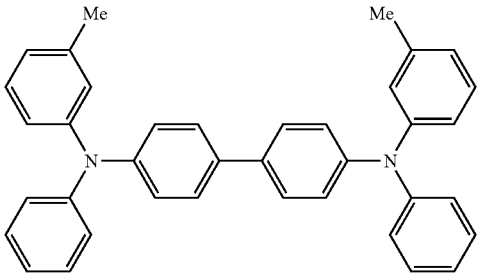

(B-1)

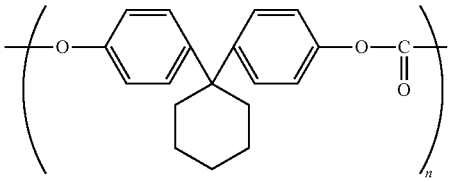

—Protective Layer—

Next, 50 g of phenol (manufactured by Wako Pure Chemical Industries, Ltd.), 100 g of formalin (manufactured by Wako Pure Chemical Industries, Ltd.), and 0.5 g of triethylamine are heated and stirred at 70° C. for 6 hours. After the mixture is cooled to room temperature, ethyl acetate is added thereto, washing is performed using water several times, the organic substances are collected, ethyl acetate is removed at reduced pressure, and thereby a synthetic phenol resin is obtained.

Next, 5 parts by weight of the above-mentioned compound (IV-7), 5 parts by weight of the synthetic phenol resin, and 40 parts by weight of methanol are mixed with each other to prepare the first coating liquid for forming the protective layer.

Furthermore, 49 parts by weight of methanol and 1 part by weight of p-toluenesulfonic acid are mixed with each other to prepare the second coating liquid for forming the protective layer.

As the liquid drop discharging head 80 for forming the protective layer, a piezo intermittence type liquid drop discharging head PIXELJET64 (manufactured by Trident, Co) which has thirty two nozzles 86×two rows is used. Among the nozzles 86 of the liquid drop discharging head 80, twenty nozzles in a row is used. Two liquid drop ejecting heads 80 as described above are prepared and the first coating liquid and the second coating liquid for forming the protective layer are charged therein. Hereinafter, the liquid drop discharging head 80 containing the first coating liquid is referred to as the liquid drop discharging head 80A, and the liquid drop discharging head 80 containing the second coating liquid is referred to as the liquid drop discharging head 80B.

The cylindrical support 82 on which the charge-transporting layer formed is placed in an apparatus that rotates horizontally, and the liquid drop discharging, head 80A and the liquid drop discharging head SOB are provided so that the liquid drops are jetted directly on the substrate from right above the substrate.

Figure 3B:
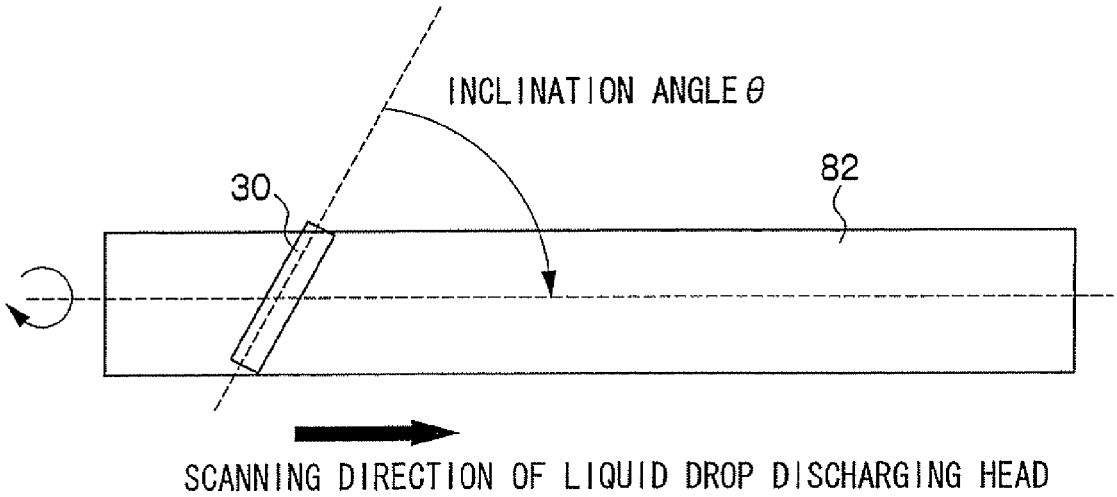

As shown in FIG. 3B, the liquid drop discharging head 80A and the liquid drop discharging head 80B are disposed at an angle of 85° in respects to the cylindrical support 82, and a distance between the liquid drop discharging head 80 and the cylindrical support 82 is 10 mm.

While the cylindrical support 82 rotates at 230 rpm, the jetting is performed at frequencies of the liquid drop discharging head 80A and the liquid drop discharging head 80B, as shown in the following Table 1, and they move horizontally from an end of the support to the end thereof at a speed of 220 mm/min.

The above-mentioned procedure is repeated six times while the frequencies are changed as shown in the following Table 1, to form a continuous concentration gradient layer. Next, the drying is performed at 150° C. for 40 min to form the protective layer having the thickness of 6 μm, thereby obtaining the photoreceptor 1.

TABLE 1

| | Liquid drop discharging head 80A | Liquid drop discharging head 80B |
|---|---|---|
| First | 2000 Hz | 2000 Hz |
| Second | 2000 Hz | 1600 Hz |
| Third | 2000 Hz | 1200 Hz |
| Fourth | 2000 Hz | 800 Hz |
| Fifth | 2000 Hz | 400 Hz |
| Sixth | 2000 Hz | 100 Hz |

Example 2

The photoreceptor 2 is manufactured using the same procedure as Example 1, except that the first coating liquid having the following composition is used instead of the first coating liquid used to form the protective layer of Example 1.

Compound (IV-7): 10 parts by weight

Synthetic epoxy resin (EPICOAT 828, manufactured by Japan Epoxy Resins Co., Ltd.): 10 parts by weight Methanol: 40 parts by weight Comparative Example 1

In Examples 1 and 2, the protective layer is manufactured by using the inkjet method. However, in Comparative Example 1, the protective layer is manufactured by using the dip coating device according to the dip coating method.

Figure 20:
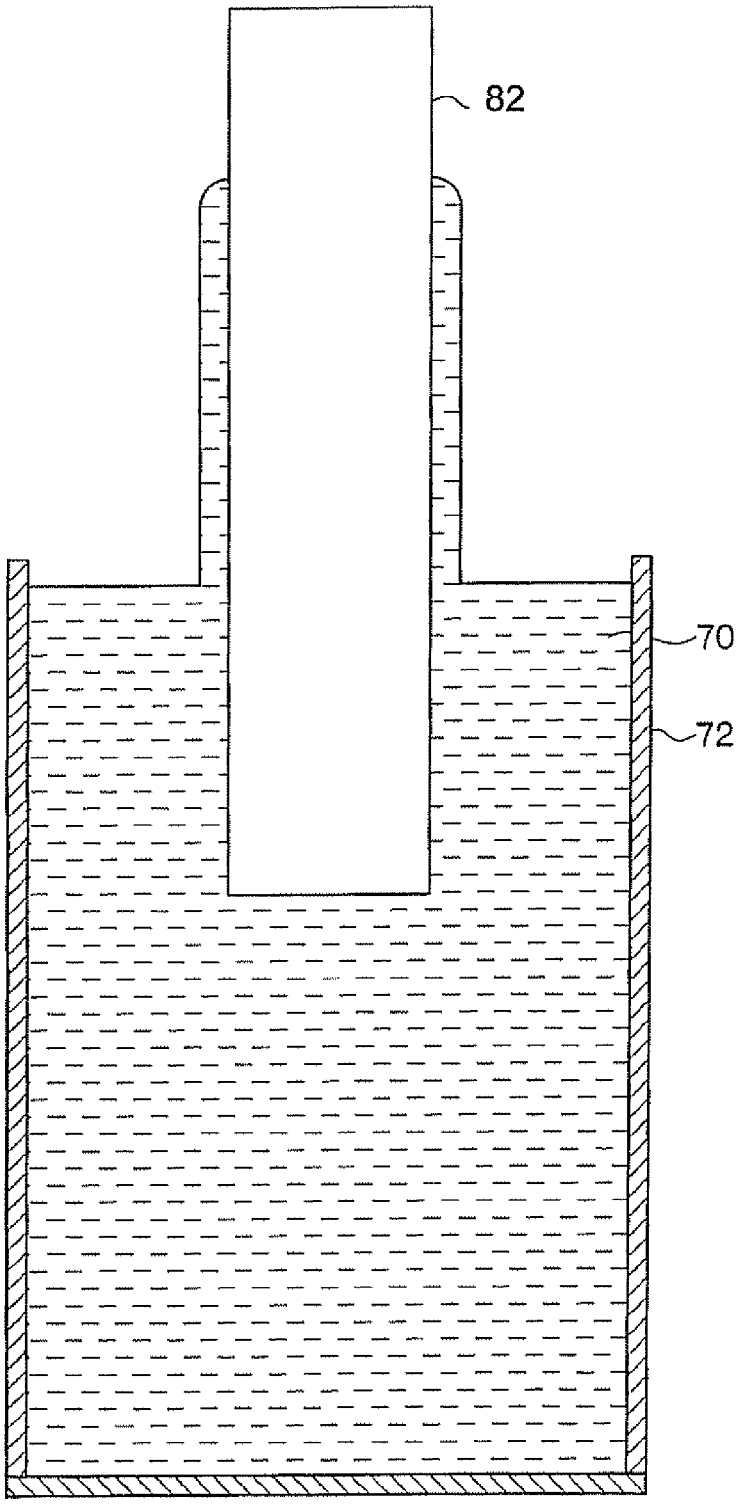
FIG. 20 is a view schematically illustrating a dip coating device used to form a protective layer in the Comparative Examples.

Furthermore, the dip coating device used in Comparative Example 1 has a configuration shown in FIG. 20. In the device, the coating liquid 70 is put in a coating bath 72 and the cylindrical support 82 is dipped and then pulled to perform the coating.

25 parts by weight of the above-mentioned compound (IV-7), 25 parts by weight of the synthetic phenol resin, and 40 parts by weight of methanol are mixed with each other to prepare a third coating liquid for forming the protective layer as the coating liquid 70.

Furthermore, 9.9 parts by weight of methanol and 0.1 part by weight of p-toluenesulfonic acid are mixed with each other to prepare a fourth coating liquid for forming the protective layer. The third and fourth coating liquids for forming the protective layer are mixed with each other at a mixing ratio of 1:1.

Like Example 1, as shown in FIG. 20, the cylindrical support 82 on which the charge-transporting layer is formed is vertically disposed, and the cylindrical support 82 is dipped in the coating liquid 70 and then pulled at a speed of 150 nm min.

Subsequently, the drying is performed at 150° C. for 40 min to form the protective layer having the thickness of 6 μm, thereby obtaining the photoreceptor 3.

Comparative Example 2

In Comparative Example 2, the coating liquid is manufactured using the same procedure as Comparative Example 1, except that the synthetic epoxy resin (EPICOAT 828, manufactured by Japan Epoxy Resins Co., Ltd.) is used instead of the synthetic phenol resin as the coating liquid 70. Like Comparative Example 1, the dip coating method is used and pulling is performed at a speed of 140 mm/min to form the protective layer, thereby obtaining the photoreceptor 4.

<Evaluation>

(Storage Stability and Layer Forming Property of the Coating Liquid)

With respect to the coating liquids for forming the protective layer, which is prepared in Examples 1 and 2 and Comparative Examples 1 and 2, storage stability when they are left for two months after preparation is evaluated. Further, the layer forming property when the coating liquids for forming the protective layer are coated one weed after they are prepared, is evaluated.

The results are described in Table 2.

TABLE 2

| | Storage stability of coating liquid | Layer forming property of photoreceptor |
|---|---|---|
| Example 1 | Stable for two months | No problem is observed |
| Example 2 | Stable for two months | No problem is observed |
| Comparative example 1 | White turbidity is observed at two weeks after the preparation | Surface smoothness is deteriorated |
| Comparative example 2 | White turbidity is observed at one week after the preparation | Surface smoothness is deteriorated |

(Evaluation of Image Degradation)

Each of the photoreceptors 1 to 4 is provided to DOCUCENTRE COLOR F450 that is a printer manufactured by Fuji Xerox Co., Ltd. to perform evaluation.

Ten thousand pieces are printed in (1) a high temperature and high humidity environment (30° C., 85% RH) and (2) a low temperature and low humidity environment (10° C., 20% RH), and are left in a printer in (3) a low temperature and humidity environment (10° C., 20% RH) for one day (24 hours). The image degradation is evaluated by visual observation of the quality of image.

The evaluation criteria are as follows. The results are described in Table 3.

A: Favorable

B: Occurrence of slight image degradation

C: Occurrence of apparent image degradation (Evaluation of the Ghost)

Figure 21A:
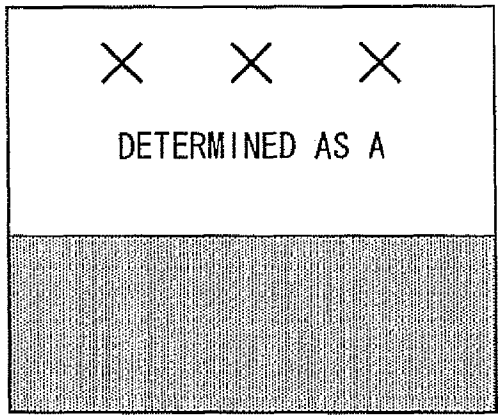
FIGS. 21A to 21C are charts for evaluating ghosts in the Examples.
Figure 21B:
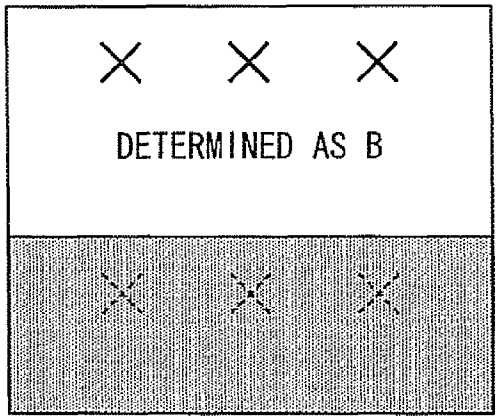
Figure 21C:
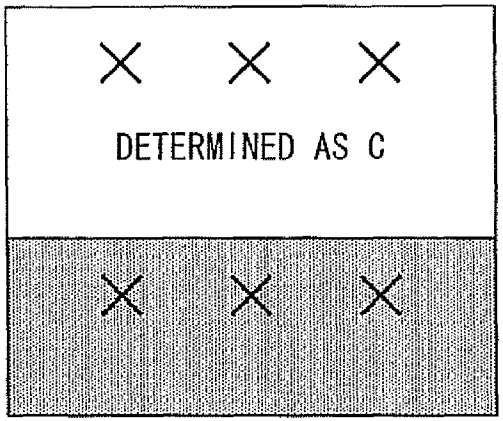

Each of the photoreceptors 1 to 4 is provided to DOCUCENTRE COLOR F450 that is a printer manufactured by Fuji Xerox Co., Ltd., and the "x" chart as shown in FIG. 21 is printed in a low temperature and low humidity environment (10° C., 20% RH) and then visually observed.

The evaluation criteria are as follows. The results are described in Table 3.

A: Favorable

B: Occurrence of slight ghost

C: Occurrence of apparent ghost (Evaluation of Stripping)

After the image degradation is evaluated, the surface of the photoreceptor is visually observed.

The evaluation criteria are as follows.

A: Favorable

C: Occurrence of stripping (Evaluation of Abrasion)

As to the evaluation of stripping, the layer thickness is measured before and after use in respects to a non-stripped portion to obtain the abrasion ratio per 1000 cycles. The results are shown in Table 3.

TABLE 3

| | | Evaluation results | | | | | |
|---|---|---|---|---|---|---|---|
| | | Image degradation | | | | | |
| | | High temperature and high humidity | Low temperature and low humidity | After leaving in printer for one day | Ghost | Stripping | Abrasion [nm/kcy] |
| Example 1 | Photoreceptor 1 | A | A | A | A | A | 0.8 |
| Example 2 | Photoreceptor 2 | B | A | B | A | A | 0.9 |
| Comparative example 1 | Photoreceptor 3 | A | B | A | C | C | 1.4 |
| Comparative example 2 | Photoreceptor 4 | B | B | B | C | C | 1.6 |

In Examples 1 and 2, even though a coating containing the curable resin which is activated after being mixed with the curing agent or the curing catalyst is used, physical properties of liquid are maintained over a long period of time, and there is no problem in respects to the film thickness nonuniformity and the curing nonuniformity.

Furthermore, in Examples 1 and 2, the wear resistance and the damage resistance are excellent and the stripping does not occur in use over a long period of time. Additionally, the image degradation or the occurrence of the ghost is sufficiently prevented in a high temperature and high humidity environment.

The foregoing description of the embodiments of the invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practice applications, thereby enabling others skilled in the art to understand invention for various embodiments and with the various modifications as are suited to the particular use contemplated. It is intended that the scope of the invention be defined by the following claims and their equivalents.

What is claimed is:

1. An electrophotographic photoreceptor comprising:

at least a photosensitive layer and a protective layer disposed on a conductive substrate in this order from the conductive substrate, the protective layer comprising a curable resin and a curing agent or a curing catalyst, and a content ratio of the curing agent or the curing catalyst increasing in the protective layer in a direction toward the photosensitive layer.

2. The electrophotographic photoreceptor according to claim 1, wherein the protective layer comprises at least one charge-transporting compound selected from any one of Formulae (I) to (V):

$$F[-(X^1)_n-(R^1)_k-Z^1H]_m \quad \text{Formula (I)}$$

wherein in Formula (I), F is an organic group which is derived from a compound having a hole-transporting property; $X^1$ is an oxygen atom or a sulfur atom; $R^1$ is an alkylene group; $Z^1$ is an oxygen atom, a sulfur atom, NH, or COO; n is 0 or 1; m is an integer from 1 to 4; and k is 0 or 1, $$F-[(X^2)_{n2}-(R^2)_{n3}-(Z^2)_{n4}G]_{n5} \quad \text{Formula (II)}$$

wherein in Formula (II), F is an organic group which is derived from a compound having a hole-transporting property; $X^2$ is an oxygen atom or a sulfur atom; $R^2$ is an alkylene group; $Z^2$ is an alkylene group, an oxygen atom, a sulfur atom, NH, or COO; G is an epoxy group; n2, n3, and n4 are each independently 0 or 1; and n5 is an integer from 1 to 4, Formula (III)

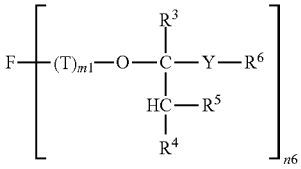

wherein in Formula (III), F is an organic group derived from a compound having a hole-transporting property; T is a divalent group; Y is an oxygen atom or a sulfur atom; $R^3$, $R^4$, and $R^5$ are each independently a hydrogen atom or a monovalent organic group; $R^6$ is a monovalent organic group; m1 is 0 or 1; n6 is an integer from 1 to 4; and $R^5$ and $R^6$ may be bonded to each other to form a heterocycle having Y as a hetero atom, Formula (IV)

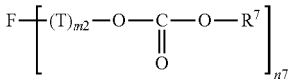

wherein in Formula (IV), F is an organic group derived from a compound having a hole-transporting property; T is a divalent group; $R^7$ is a monovalent organic group; m2 is 0 or 1; and n7 is an integer from 1 to 4, Formula (V)

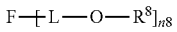

wherein in Formula (V), F is an organic group derived from a compound having a hole-transporting property; L is an alkylene group; $R^8$ is a monovalent organic group; and n8 is an integer from 1 to 4.

3. An image-forming apparatus comprising:

the electrophotographic photoreceptor of claim 1;

a charging device that charges the electrophotographic photoreceptor;

an exposing device that exposes the charged electrophotographic photoreceptor to form an electrostatic latent image;

a developing device that develops the electrostatic latent image to form a toner image; and a transfer device that transfers the toner image onto a transfer-receiving object.

4. A process cartridge comprising:

the electrophotographic photoreceptor of claim 1, and at least one selected from the group consisting of a charging device that charges the electrophotographic photoreceptor, a developing device that develops an electrostatic latent image formed due to exposure to form a toner image, and a cleaning device that removes residual toner from the electrophotographic photoreceptor.

5. The electrophotographic photoreceptor according to claim 1, wherein a concentration gradient is formed in the protective layer so that the content of the curing agent or the curing catalyst is linearly increased in a film thickness direction of the protective layer toward the photosensitive layer.

6. The electrophotographic photoreceptor according to claim 1, wherein a concentration gradient is formed in the protective layer so that the content of the curing agent or the curing catalyst is increased in a curve in a film thickness direction of the protective layer toward the photosensitive layer.

* * * * *